US009061858B2

(12) United States Patent
Yamaguchi et al.

(10) Patent No.: US 9,061,858 B2
(45) Date of Patent: Jun. 23, 2015

(54) TAPE CASSETTE

(75) Inventors: Koshiro Yamaguchi, Kakamigahara (JP); Yasuhiro Shibata, Okazaki (JP); Minoru Yamamoto, Nagoya (JP); Masato Kato, Kasugai (JP); Nobuo Kato, Nagoya (JP); Teruo Imamaki, Nisshin (JP); Tsuyoshi Nagae, Kasugai (JP); Takashi Horiuchi, Kariya (JP); Tsutomu Kato, Nagoya (JP); Yasunori Nakamura, Toyokawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 533 days.

(21) Appl. No.: 12/886,006

(22) Filed: Sep. 20, 2010

(65) Prior Publication Data

US 2011/0008090 A1 Jan. 13, 2011

Related U.S. Application Data

(63) Continuation-in-part of application No. PCT/JP2009/061599, filed on Jun. 25, 2009.

(30) Foreign Application Priority Data

Oct. 22, 2008 (JP) ..... 2008-271998
Oct. 22, 2008 (JP) ..... 2008-271999

(51) Int. Cl.
*B41J 15/04* (2006.01)
*B65H 35/06* (2006.01)
(Continued)

(52) U.S. Cl.
CPC ..... *B65H 35/06* (2013.01); *B41J 3/4075* (2013.01); *B41J 15/044* (2013.01); *B41J 17/32* (2013.01);
(Continued)

(58) Field of Classification Search
CPC ..... B41J 3/4075; B41J 15/044; B65H 41/00; B65H 2701/3772
USPC ..... 400/613, 88; 242/600, 594, 564.4
See application file for complete search history.

(56) References Cited

U.S. PATENT DOCUMENTS 4,302,787 A * 11/1981 Itani ..... 360/85
4,626,313 A * 12/1986 Karp ..... 156/362
(Continued)

FOREIGN PATENT DOCUMENTS

CN 1718443 A 1/2006
CN 101077664 A 11/2007
(Continued)

OTHER PUBLICATIONS

International Preliminary Report on Patentability and Written Opinion dated May 26, 2011 from related PCT/JP2009/061599.
(Continued)

*Primary Examiner* — Judy Nguyen
*Assistant Examiner* — Jennifer Simmons
(74) *Attorney, Agent, or Firm* — Scully, Scott, Murphy & Presser, P.C.

(57) ABSTRACT

A tape cassette includes a tape ejecting port for ejecting outside the tape with a separator being adhered to one of surfaces thereof, a tape conveying roller arranged at an upstream side of a tape conveying direction at the tape ejecting port, the tape conveying roller conveying roller pulling out and conveying the tape while getting in contact with the separator being adhered to one surface of the tape, a separator guiding portion for guiding the separator peeled off from the tape inwardly at the tape ejecting port along a peripheral surface of the tape conveying roller and a separator-take-up spool arranged so as to fix thereto a front end of the separator that has been guided inwardly along the peripheral surface of the tape conveying roller from the separator guiding portion and to take up the separator.

14 Claims, 38 Drawing Sheets

(51) Int. Cl.

| | |
|---|---|
| ***B41J 3/407*** | (2006.01) |
| ***B41J 17/32*** | (2006.01) |
| ***B41J 32/00*** | (2006.01) |
| ***B65H 37/00*** | (2006.01) |
| ***B65H 39/16*** | (2006.01) |
| ***B65H 41/00*** | (2006.01) |

(52) U.S. Cl.

CPC ..... *B41J 32/00* (2013.01); *B65H 37/002* (2013.01); *B65H 39/16* (2013.01); *B65H 41/00* (2013.01); *B65H 2301/5111* (2013.01); *B65H 2701/372* (2013.01); *B65H 2701/3772* (2013.01)

(56) References Cited

U.S. PATENT DOCUMENTS

| | | | |
|---|---|---|---|
| 5,536,092 | A | 7/1996 | Yamaguchi |
| 5,614,928 | A | 3/1997 | Matsuda |
| 5,636,926 | A | 6/1997 | Yamaguchi |
| 5,681,123 | A | 10/1997 | Yamaguchi |
| 5,730,536 | A | 3/1998 | Yamaguchi |
| 2003/0121612 | A1 | 7/2003 | McKay et al. |
| 2006/0008608 | A1 | 1/2006 | Kurashina |
| 2006/0121229 | A1 * | 6/2006 | Nagae ..... 428/40.1 |
| 2007/0274756 | A1 | 11/2007 | Motoki |
| 2008/0226374 | A1 | 9/2008 | Yamaguchi |

FOREIGN PATENT DOCUMENTS

| | | | | |
|---|---|---|---|---|
| CN | 101264702 | A | | 9/2008 |
| EP | 0557137 | A2 | | 8/1993 |
| EP | 0634275 | A2 | | 1/1995 |
| JP | 6-1006 | | | 1/1994 |
| JP | 7-68814 | | | 3/1995 |
| JP | 7-69497 | | | 3/1995 |
| JP | 8-253219 | | | 10/1996 |
| JP | 09327906 | A | * | 12/1997 |
| JP | 10016337 | A | * | 1/1998 |
| JP | 3342596 | | | 8/2002 |
| JP | 3411110 | | | 3/2003 |

OTHER PUBLICATIONS

International Search Report dated Jul. 28, 2009.

Extended European Search Report dated Jan. 27, 2014 in counterpart European Patent Application No. 09821854.8.

Chinese Office Action dated Apr. 3, 2013 in Chinese Patent Application No. 200980128528.4.

* cited by examiner

TAPE CASSETTE

CROSS-REFERENCE TO RELATED APPLICATION

The present application is a continuation-in-part application based upon and claims the benefit of the prior PCT International Patent Application No. PCT/JP2009/061599 filed on Jun. 25, 2009, the disclosure of which is herein incorporated by reference in its entirety.

TECHNICAL FIELD

The disclosure relates to a tape cassette used for a tape printing apparatus.

BACKGROUND ART

There have conventionally been proposed various tape cassettes used for tape printing apparatuses.

For instance, there has been proposed a tape cassette in which a receptor type print tape and an ink ribbon are accommodated. The receptor type print tape is wound around a tape spool. Four rollers are provided for guiding travel of the receptor type print tape so that the receptor type print tape is conveyed and discharged from a tape release portion via a print portion. The ink ribbon wound around a ribbon spool is configured to run through a detection path and is guided past the print portion and the release portion in a path substantially parallel to path of the receptor type print tape. A ribbon-take-up spool is provided for taking up the ink ribbon after it passes by the print portion.

SUMMARY

The disclosure has been made to overcome the above problems and the object of the disclosure is to provide a tape cassette capable of getting rid of time and effort to peel off a separator for pasting an after-printed printing tape on an object.

To achieve the purpose of the disclosure, there is provided a tape cassette placed in a tape printing apparatus in a replaceable manner, the tape printing apparatus comprising a tape conveying device for conveying a tape having long length and a printing device for carrying out printing on the tape, wherein the tape cassette further comprises: a tape ejecting port for ejecting outside the tape with a separator being adhered to one of surfaces thereof; a tape conveying roller arranged at an upstream side of a tape conveying direction at the tape ejecting port, the tape conveying roller pulling out and conveying the tape while getting in contact with the separator being adhered to one surface of the tape; a separator guiding portion for guiding the separator peeled off from the tape inwardly at the tape ejecting port along a peripheral surface of the tape conveying roller; and a separator-take-up spool arranged so as to fix thereto a front end of the separator that has been guided inwardly along the peripheral surface of the tape conveying roller from the separator guiding portion and to take up the separator.

DETAILED DESCRIPTION

There will be described on tape cassettes embodying the disclosure in detail based on a first embodiment through a sixteenth embodiment by referring to drawings.

[First Embodiment]

First, there will be described on the schematic configuration of a tape printing apparatus in which a tape cassette directed to a first embodiment is placed by referring to FIG. 1 through FIG. 3.

Figure 1:
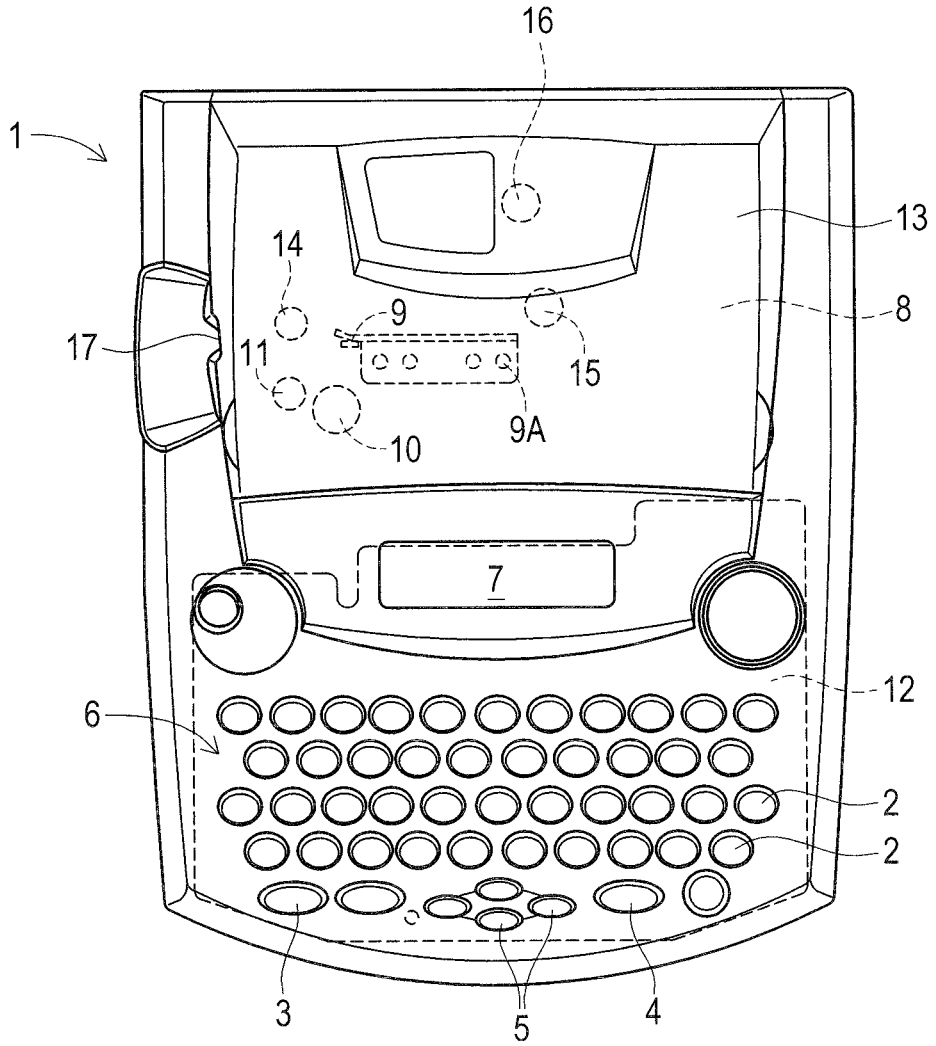
FIG. 1 is a plain view of a tape printing apparatus directed to a first embodiment.
Figure 2:
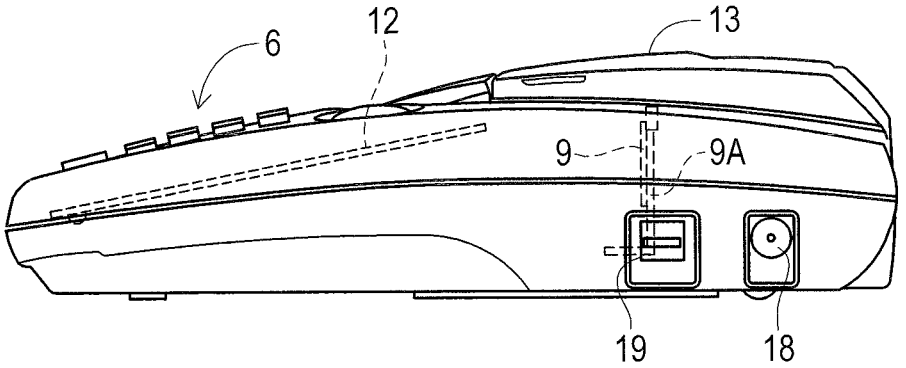
FIG. 2 is a right side view of the tape printing apparatus.
Figure 3:
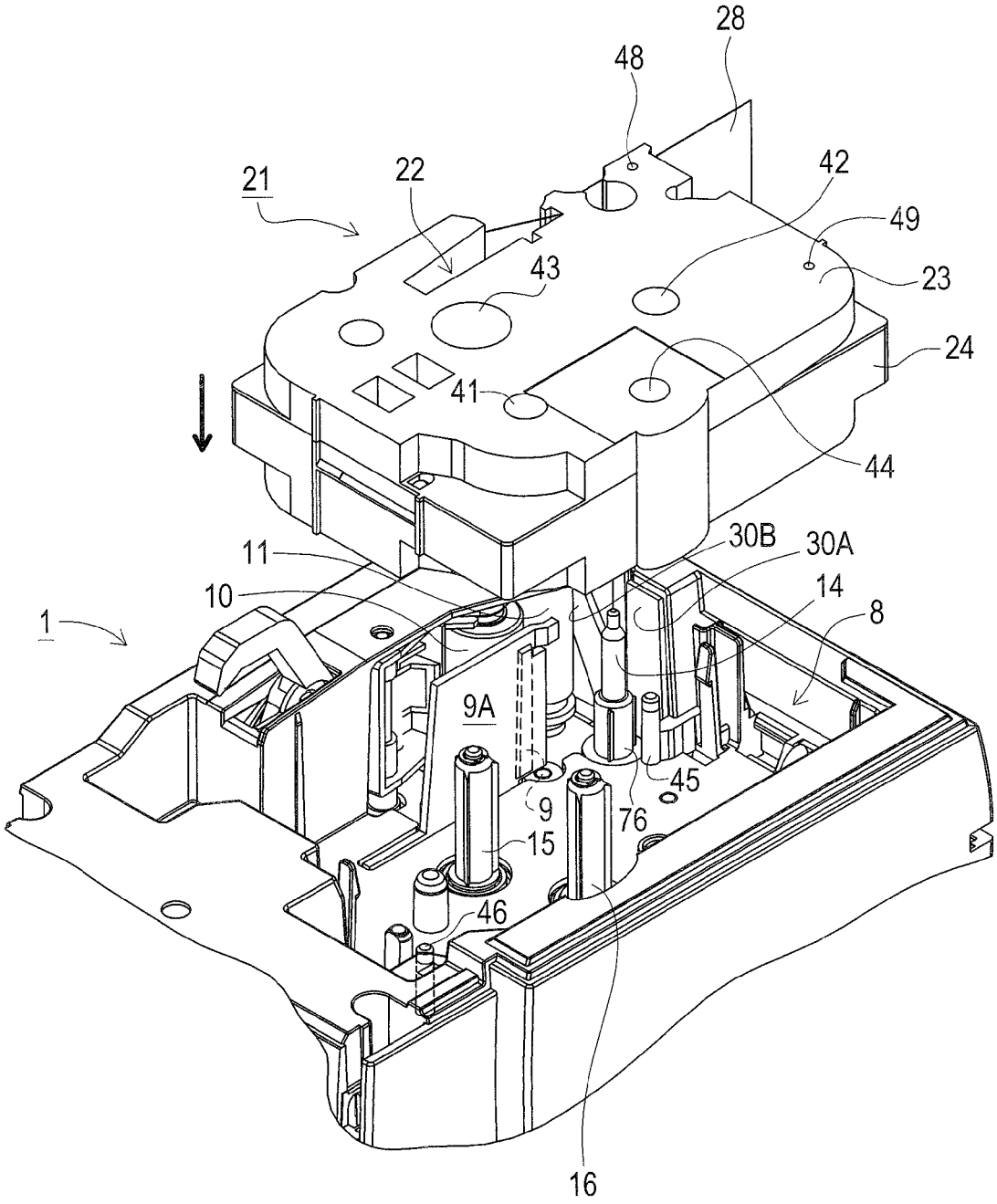
FIG. 3 is a main-part-enlarged perspective view for illustrating a state that a tape cassette is to be placed in a cassette housing portion of the tape printing apparatus.

As shown in FIG. 1 through FIG. 3, a tape printing apparatus 1 directed to the first embodiment includes a keyboard 6, a cassette housing portion 8 for housing a tape cassette 21 and a housing cover 13 for covering the cassette housing portion 8. The keyboard 6 includes: letter input keys 2 for commanding to create texts in a form of document data; a print key 3 for commanding to print out texts etc.; a return key 4 for executing a line feeding instruction and various processing and for determining a choice from candidates; cursor keys 5 for moving a cursor up, down, left or right, the cursor being indicated in a liquid crystal display (LCD) 7 that indicates letters and characters across plural lines; and the like.

Beneath the keyboard 6, there is arranged a control board 12 that constitutes a control circuit unit. At the left side of the cassette housing portion 8, there is formed a label ejecting port 17 for ejecting a tape from which a separator is peeled off, as will be described later. Further, at the right side of the cassette housing portion 8, there are arranged an adapter inlet 18 to be connected to a power supply adapter and a USB connector 19 to be connected to a USB cable for connecting the apparatus to a not-shown personal computer.

In the cassette housing portion 8, there are arranged a thermal head 9, a platen roller 10 that faces the thermal head 9, a tape sub roller 11 arranged at a downstream side for the platen roller 10, a metallic tape-driving-roller shaft 14 that faces the tape sub roller 11, a ribbon-take-up shaft 15 that conveys an ink ribbon 52 (refer to FIG. 4) to be housed inside the tape cassette 21, a separator-take-up shaft 16 that takes up a separator 53D (refer to FIG. 4) that has been peeled off from a two-sided adhesive tape 53 (refer to FIG. 4) to be described later, etc. Further, the platen roller 10 and the tape sub roller 11 are arranged so as to be able to slide integrally. Specifically, when the tape cassette 21 is placed in, the platen roller 10 and the tape sub roller 11 are pressed against the thermal head 9 and a tape conveying roller 63 (refer to FIG. 4 for the both), respectively.

The thermal head 9 is a flat plate that is substantially rectangular shaped when seen from front. Along the front left end of the thermal head 9, a predetermined number of heater elements R1-Rn (e.g., n is 128 or 256) are aligned. Further, there is arranged a radiator plate 9A that is made of plated sheet steel, stainless steel plate or the like and substantially quadrangular shaped when seen from front. The thermal head 9 is fixed to the front left end of the radiator plate 9A with adhesion or the so that the alignment of the heater elements R1-Rn runs parallel to the left side of the radiator plate 9A. The said radiator plate 9A is fixed to the lower side of the cassette housing portion 8 with a screw or the like so that the alignment of the heater elements R1-Rn crosses at substantially right angle with respect to the conveying direction of the film tape 51 (refer to FIG. 4) at an opening 22 of the tape cassette 21.

Further, the ribbon-take-up shaft 15 is driven for rotation by proper driving mechanism originated from a not-shown tape conveying motor that consists of a stepping motor or the like. As will be described later, the ribbon-take-up shaft 15 is fitted into the ribbon-take-up spool 61 that is rotatably arranged inside the tape cassette 21 (refer to FIG. 4) and driven for rotation. Further, the tape-driving-roller shaft 14 is driven for rotation by proper transmission mechanism originated from the tape conveying motor. Specifically, the tape-driving-roller shaft 14 is fitted into an electrically-conductive resin tape conveying roller 63 (refer to FIG. 4) that is rotatably arranged inside the tape cassette 21 and driven for rotation. Still further, the separator-take-up shaft 16 is driven for rotation by proper transmission mechanism originated from the tape conveying motor. Specifically, the separator-take-up shaft 16 is fitted into a separator-take-up spool 62 (refer to FIG. 4) that is rotatably arranged inside the tape cassette 21 and driven for rotation.

Meanwhile, the separator-take-up shaft 16 may be driven for rotation by proper driving mechanism originated from a not-shown separator-take-up motor that consists of a stepping motor or the like that is furnished separately from the tape conveying motor. Thereby, a separator 53D can be taken up reliably even if stretch rate of an ink ribbon 52 and that of a separator 53D differ significantly.

Further, as shown in FIG. 3, nearby a tape ejecting port 27 (refer to FIG. 4) of the tape cassette 21, a scissor-type cutter unit 30 is arranged so as to cut off an after-printed tape 28 by predetermined length in a state that a separator 53D (refer to FIG. 7) has been peeled off from the after-printed tape 28 along a peripheral surface of a separating roller 65. Thereby, a label overlaid with a two-sided adhesive tape is created in a state that a separator 53D has been peeled off from the two-sided adhesive tape. The cutter unit 30 consists of a fixed blade 30A and a movable blade 30B wherein a not-shown cutting motor serves to move the movable blade 30B toward the fixed blade 30A so as to cut off an after-printed tape 28.

On the bottom of the cassette housing portion 8, two positioning pins 45 and 46 are arranged upright with the same height. When the tape cassette 21 is placed in the cassette housing portion 8, position of the tape cassette 21 is properly fixed by the positioning pins 45 and 46 inside the cassette housing portion 8.

Figure 4:
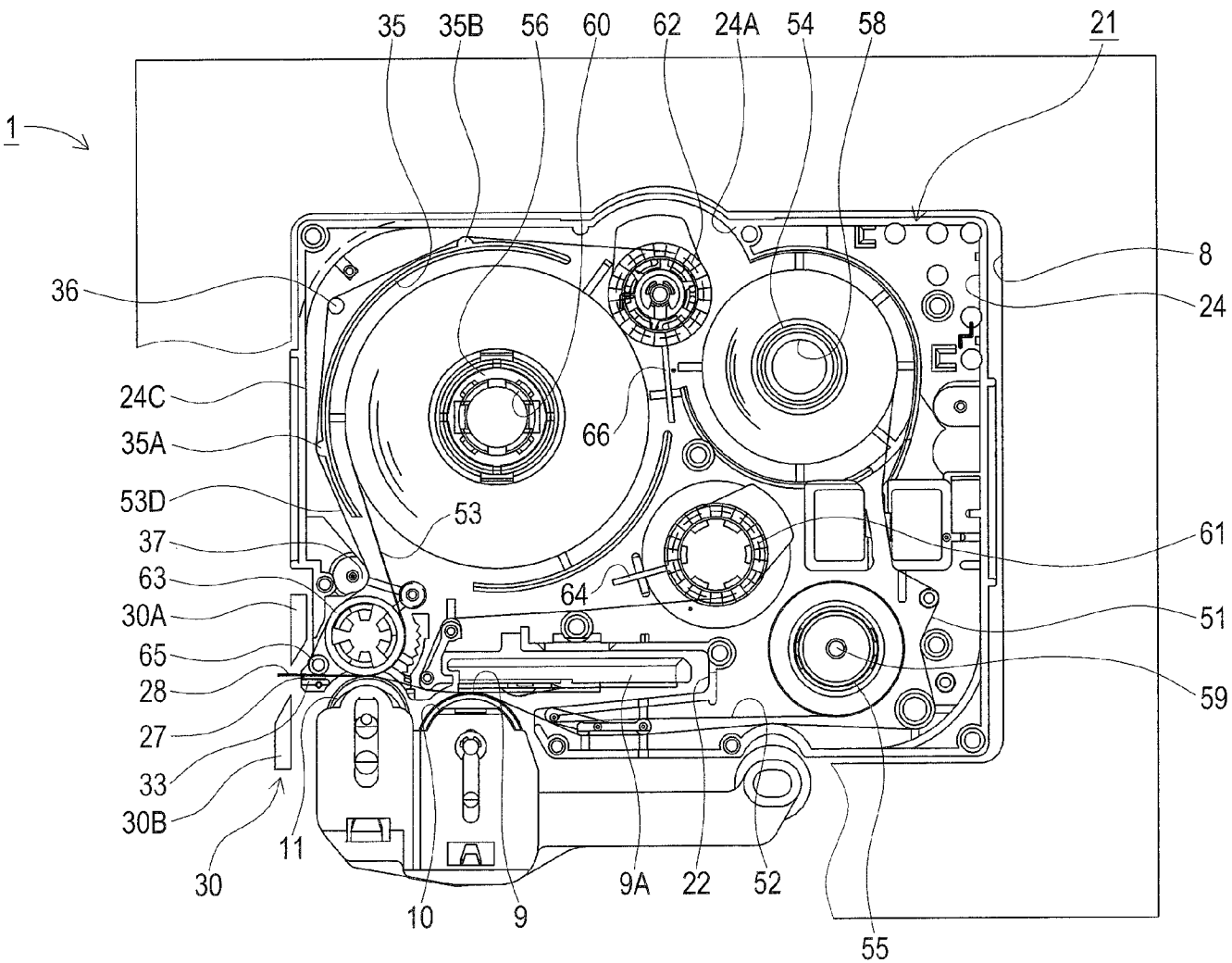
FIG. 4 is a main-part-enlarged plain view that can be seen in case an upper case of the tape cassette is removed while the tape cassette is placed in the cassette housing portion of the tape printing apparatus.

Next, there will be described on the schematic configuration of the tape cassette 21 by referring to FIG. 3 through FIG. 7. As shown in FIG. 3 and FIG. 4, the tape cassette 21 includes an upper case 23 and a lower case 24. In the tape cassette 21, a supporting hole 41 is formed so as to rotatably support a tape spool 54 on which a transparent film tape 51 as printing tape is wound. Further, in the tape cassette 21, a supporting hole 42 is formed so as to rotatably support a two-sided-adhesive-tape spool 56. A two-sided adhesive tape 53 is wound around the two-sided-adhesive tape spool 56 while its separator 53D (refer to FIG. 7) made of release paper, film or the like is put outward.

Further, in the tape cassette 21, a supporting hole 43 is formed so as to rotatably support a ribbon-take-up spool 61 that is arranged between the tape spool 54 and the two-sided-adhesive-tape spool 56 near the opening 22. For printing characters etc. on a film tape 51 with the thermal head 9, the ribbon-take-up spool 61 serves to pull out the ink ribbon 52 from the ribbon spool 55 and to take up the ink ribbon 52 therein.

Further, in the tape cassette 21, a supporting hole 44 is formed so as to rotatably support a separator-take-up spool 62 that is arranged near a side wall 24A furnished on the lower case 24 that faces the opening 22 located between the tape spool 54 and the two-sided-adhesive-tape spool 56. The separator-take-up spool 62 takes up therein a separator 53D that has been peeled off from a two-sided adhesive tape 53 along the peripheral surface of the separating roller 65. Further, the side wall 24A on the lower case 24 is formed so as to project like a semicircular arc when seen from top at a portion facing the separator-take-up spool 62.

Further, in the tape cassette 21, a supporting hole 48 is formed so as to rotatably support the separating roller 65 that is arranged at the downstream of the tape conveying direction with reference to the tape conveying roller 63, i.e., the separating roller 65 is arranged so as to be away from the tape ejecting port 27.

Figure 5:
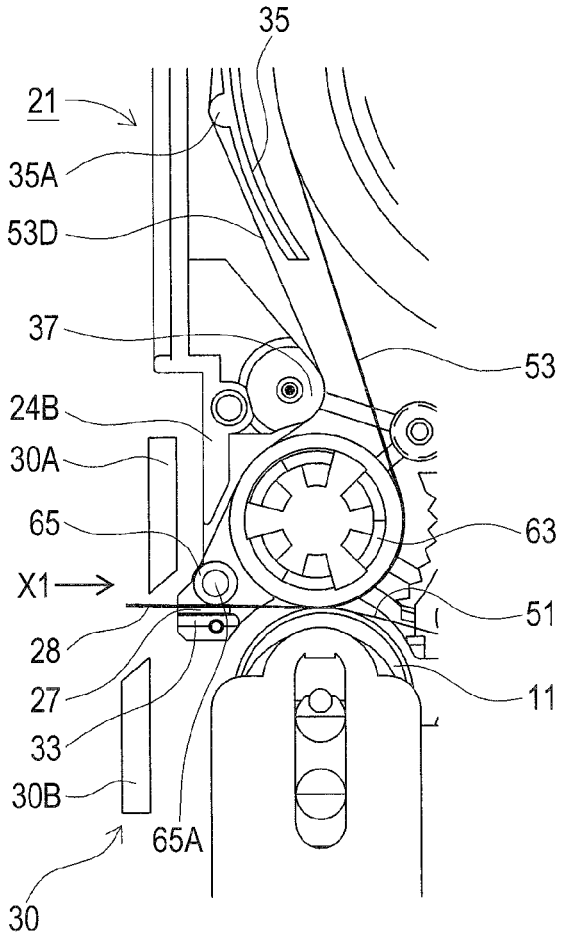
FIG. 5 is a main-part-enlarged view of surroundings of a tape ejecting port shown in FIG. 4.
Figure 6:
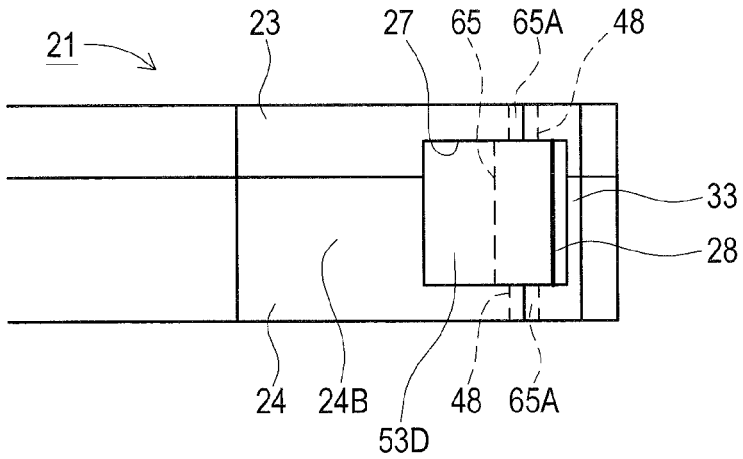
FIG. 6 is a view of the tape ejecting port seen from a view point indicated with an arrow X1 shown in FIG. 5.

Further, as shown in FIG. 5 and FIG. 6, the tape ejecting port 27 is opened so as to have two widths: one width that is wider than outside diameter of the separating roller 65 and widened in tape-thickness direction of an after-printed tape 28 that is ejected by the tape conveying roller 63 and the tape sub roller 11; and another width that is almost the same as tape width of the after-printed tape 28 and widened in tape-width direction of the after-printed tape 28.

Further, a side wall 24B is arranged orthogonally with reference to the tape conveying direction at the tape ejecting port 27 and two inner side wall portions are formed in the side wall 24B. The separating roller 65 is arranged so as to be separated away by predetermined distance from an end portion of one of the two inner side wall portions, the one located at the side of the after-printed tape 28, as well as separated away by another predetermined distance from a guide wall 33. The guide wall 33 serves to guide the after-printed tape 28 to the downstream of the tape conveying direction in contact with an outer surface of a film tape 51 overlaid on the after-printed tape 28.

Further, the separating roller 65 is circular shaped in cross section and substantially cylindrical while length thereof is almost the same as tape width of an after-printed tape 28, namely, tape width of a two-sided adhesive tape 53. Supporting shafts 65A are arranged upright on centers of both side ends of the separating roller 65 and rotatably fitted in their respective supporting holes 48. Further, the separating roller 65 is formed so as to have a silicon resin film on its peripheral surface.

With reference to the common tangent of the tape conveying roller 63 and the tape sub roller 11, the separating roller 65 is arranged so that its peripheral surface almost gets in contact with the common tangent at the side of the tape conveying roller 63. The separating roller 65 serves to guide travel of a separator 53D to the side of the tape conveying roller 63 along its peripheral surface in contact with the separator 53D that passes the tape conveying roller 63 and the tape sub roller 11 and consequently gets adhered to a film tape 51 (refer to FIG. 7).

Further, the separating roller 65 comes out in the tape conveying direction in comparison with the side wall 24B that faces the tape conveying roller 63. At the same time, the separating roller 65 is arranged so as to closely face the fixed blade 30A.

Further, the guide wall 33 faces the separating roller 65 over an after-printed tape 28 inserted therebetween. At the same time, the guide wall 33 is arranged so as to extend to the downstream of the tape conveying direction in comparison with the separating roller 65. Thereby, travel of an after-printed tape 28 from which a separator 53D has been peeled off can be guided to a position near the fixed blade 30A.

Further, the side wall 24B faces the separating roller 65 over a separator 53D inserted therebetween. An inner side surface at an edge portion of the side wall 24B is formed inwardly slantwise (diagonally upward in right, in FIG. 5) so as to be substantially parallel to a common tangent of the separating roller 65 and the tape conveying roller 63. Thereby, the configuration can prevent contact of a separator 53D with the edge portion of the side wall 24B, the separator 53D having been peeled off from a two-sided adhesive tape 53 along the peripheral surface of the separating roller 65 and guided to the tape conveying roller 63.

Further, as shown in FIG. 4, the tape cassette 21 includes a guide rib 35 within a space between an outer circumference of a two-sided adhesive tape 53 wound around the two-sided-adhesive-tape spool 56 with its greatest dimension and the side walls 24A and 24C of the lower case 24. The guide rib 35 is substantially semicircular shaped when seen from top and is arranged upright on the bottom the lower case 24 so as to partially cover the two-sided adhesive tape 53. That is, the guide rib 35 extends from where the two-sided adhesive tape 53 is to be pulled out to where the two-sided adhesive 53 faces the side wall 24A. Further, a convex part 35A and a convex part 35B are formed on the guide rib 35 so as to project from the side facing the side wall 24C and the side wall 24A of the lower case 24, by predetermined height (e.g., about 1 mm) across tape width direction.

Further, a substantially column-shaped guide pin 36 is arranged upright in a space between a corner of the lower case 24 facing two-sided adhesive tape 53 wound around the two-sided-adhesive-tape spool 56 and the guide rib 35. Further, a supporting hole 49 is formed in the upper case 23 so that an end portion of the guide pin 36 is fitted therein and the guide pin 36 is supported. Further, at another side of the tape conveying roller 63 which is the opposite side where the tape conveying roller 63 faces the tape sub roller 11, a separator guide wall 37 is arranged. The separator guide wall 37 is formed so as to get in contact with a separator 53D and its contact surface is substantially circular shaped when seen from top. The separator guide wall 37 projects inwardly while a predetermined space that extends from the side wall 24C to the tape conveying roller 63 is taken around the separator guide wall 37.

Although FIG. 3 shows only supporting holes 41, 42, 43, 44 and 48 formed on the upper case 23, supporting holes 41, 42, 43, 44 and 48 are also formed on the lower case 24 so as to meet with to the corresponding supporting holes 41, 42, 43, 44 and 48 on the upper case 23.

Further, as shown in FIG. 4, inside the tape cassette 21, there are housed a film tape 51 that is a printing tape made of a transparent tape or the like, an ink ribbon 52 for printing on the film tape 51 and a two-sided adhesive tape 53 that is to be adhered onto a printing-applied film tape 51. The film tape 51, the ink ribbon 52 and the two-sided adhesive tape 53 are wound around a tape spool 54, a ribbon spool 55 and a two-sided-adhesive-tape spool 56, respectively. At the bottom of the lower case 24, a cassette boss 58, a reel boss 59 and a cassette boss 60 are arranged upright and rotatably fitted with the tape spool 54, the ribbon spool 55 and the two-sided-adhesive-tape spool 56, respectively. Still further, inside the tape cassette 21, there are also arranged a ribbon-take-up spool 61 for taking up a used ink ribbon 52 and a separator-take-up spool 62 for taking up a separator 53D peeled off from a two-sided adhesive tape 53.

As shown in FIG. 4, a clutch spring 64 is arranged at a lower part of the ribbon-take-up spool 61. The clutch spring 64 is arranged there so as to prevent slack of an ink ribbon 52 that has been taken up into the ribbon-take-up spool 61 by rotating it inversely. Further, a clutch spring 66 is arranged at a lower part of the separator-take-up spool 62. The clutch spring 66 is arranged there so as to prevent slack of a separator 53D that has been taken up into the separator-take-up spool 62 by rotating it inversely.

As shown in FIG. 4, after pulled out from the ribbon spool 55, an unused ink ribbon 52 is overlaid with a film tape 51. Thereafter, the unused ink ribbon 52 overlaid with the film tape 51 goes into the opening 22 and passes through a path between the thermal head 9 and the platen roller 10. After that, the ink ribbon 52 is separated from the film tape 51 and guided to reach the ribbon-take-up spool 61 driven by the ribbon-take-up shaft 15 for rotation. The ink ribbon 52 guided there is taken up into the ribbon-take-up spool 61.

Figure 7:
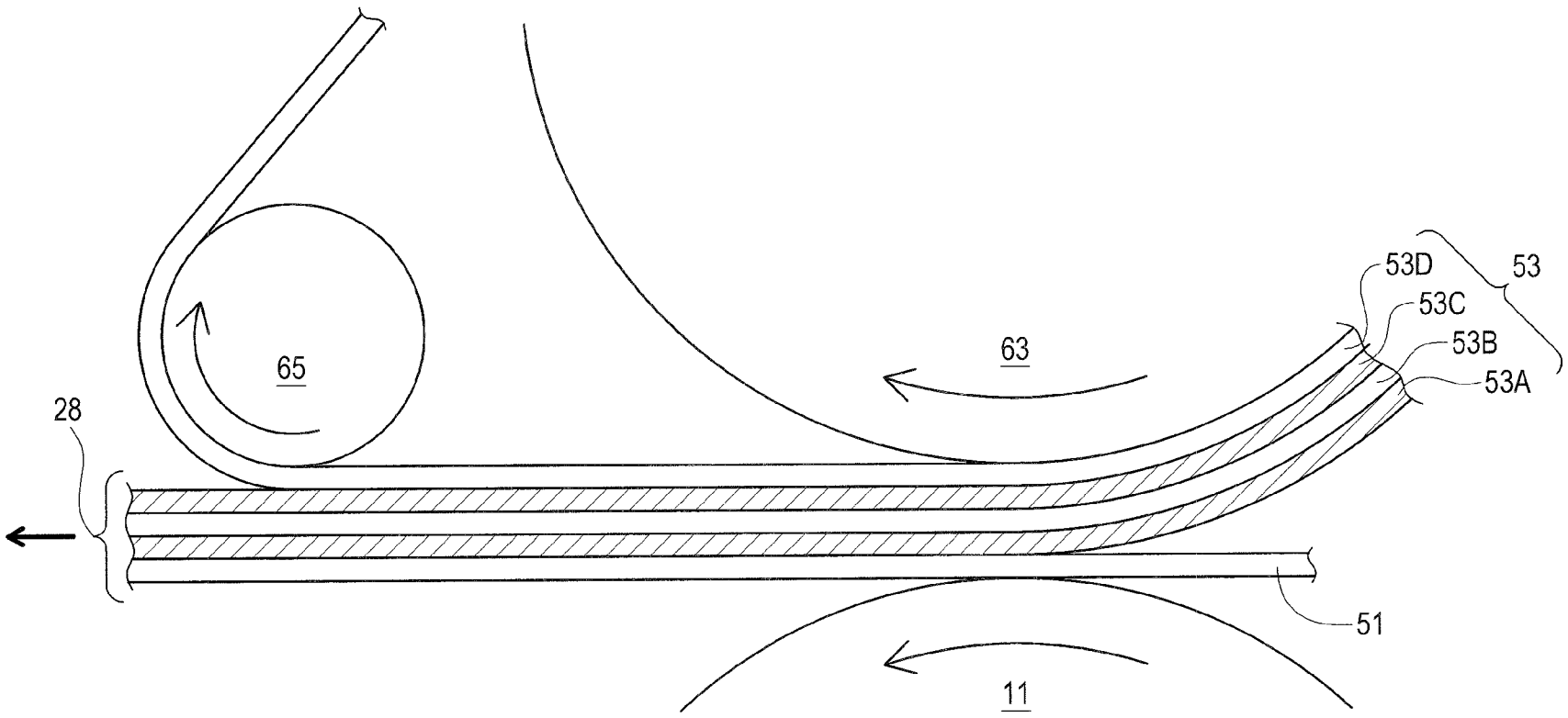
FIG. 7 is a view for exemplarily illustrating a state that a separator is peeled off at the tape ejecting port after a two-sided adhesive tape is adhered to a film tape with pressure.

Further, as shown in FIG. 7, a two-sided adhesive tape 53 is wound around the two-sided-adhesive-tape spool 56 in a state that a separator 53D is put outermost. The two-sided adhesive tape 53 consists of four layers, namely in order from the lower to top in FIG. 7: an adhesive layer 53A for bonding a film tape 51 together; a base film 53B made of colored PET (polyethylene terephthalate) or the like; an adhesive layer 53C subject to be pasted on a commercial product etc.; and a separator 53D for covering the to-be-pasted side of the adhesive layer 53C.

As shown in FIG. 4 through FIG. 7, a two-sided adhesive tape 53 that has been pulled out from the two-sided-adhesive spool 56 travels and passes through a path between the tape conveying roller 63 driven by the tape-driving-roller shaft 14 for rotation and the tape sub roller 11. Thereafter, the adhesive layer 53A on which the separator 53D is not overlaid is pressed against the printing surface of the film tape 51.

After that, the separator 53D is peeled off from the two-sided adhesive tape 53 pressed and adhered to the film tape 51, along the peripheral surface of the separating roller 65, and from there, further guided toward the two-sided adhesive spool 56 along the peripheral surface of the tape conveying roller 63, i.e., toward the pull-out direction of the two-sided adhesive tape 53 (upward direction in FIG. 4). After that, the separator 53D is further guided to reach the external of the guide rib 35 along a wall surface of the separator guide wall 37. From there, the separator 53D further travels the outside of the periphery of the wound two-sided adhesive tape 53 passing through peripheral surfaces of the convex part 35A, the guide pin 36 and the convex part 35B. The separator 53D finally reaches the separator-take-up spool 62 inwardly at a substantially right angle.

Thereafter, the front end of the separator 53D is fixedly adhered to the peripheral surface of the separator-take-up spool 62 by an adhesive tape or the like and taken up into the separator-take-up spool 62 that is driven by the separator-take-up shaft 16 for rotation. It is to be noted that the separator-take-up shaft 16 is driven for rotation in synchronous with rotation of the tape-driving-roller shaft 14 and the ribbon-take-up shaft 15.

After passing through the path between the tape conveying roller 63 driven by the tape-driving-roller shaft 14 for rotation and the tape sub roller 11, a film tape 51 reaches the separating roller 65 in a state that an adhesive layer 53A, a base film 53B, an adhesive layer 53C and a separator 53D are overlaid on a printing surface of the film tape 51. Thereafter, the separator 53D is peeled off from the film tape 51 along the peripheral surface of the separating roller 65 and the film tape 51 is consequently placed in a state that the adhesive layer 53A, the base film 53B and the adhesive layer 53C are overlaid on the printing surface thereof, i.e., in a state of a sticky after-printed tape 28 from which the separator 53D has been peeled off. The film tape 51 in the above such state is guided along the guide wall 33 that faces the separating roller 65 over an after-printed tape 28 inserted therebetween and conveyed to the outside of the tape cassette 21 through the tape ejecting port 27. After that, through the cutter unit 30, the sticky after-printed tape 28 from which the separator 53D has been peeled off is conveyed outside from the label ejecting port 17 of the tape printing apparatus 1.

The after-printed tape 28 is conveyed by predetermined length and a not-shown cutting motor is driven for operating the movable blade 30B. Consequently, from the label ejecting port 17, there is ejected the predetermined length of the sticky after-printed tape 28 from which the separator 53D has been peeled off.

Next, there will be described on positioning relation with respect to the tape spool 54, the two-sided-adhesive-tape spool 56 and the separator-take-up spool 62 of the tape cassette 21 by referring to FIG. 8. As is already described, in the tape cassette 21, the film tape 51 wound around the tape spool 54 is pulled out from there every time the tape printing apparatus 1 carries out printing. Accordingly, when the tape cassette 21 is used for the first time, the film tape 51 is wound around the tape spool 54 with its greatest dimension (refer to FIG. 4). It is to be noted that a region occupied by the film tape 51 that is wound around the tape spool 54 with its greatest dimension when the tape cassette 21 is used for the first time is referred to as "film tape occupying region 67". Further, the radius of the film tape occupying region 67 is referred to as "wound film tape radius R1".

Further, in similar with the film tape 51, the two-sided adhesive tape 53 wound around the two-sided-adhesive-tape spool 56 is pulled out from there every time the tape printing apparatus 1 carries out printing. Accordingly, when the tape cassette 21 is used for the first time, the two-sided adhesive tape 53 is wound around the two-sided-adhesive-tape spool 56 with its greatest dimension (refer to FIG. 4). It is to be noted that a region occupied by the two-sided adhesive tape 53 that is wound around the two-sided-adhesive-tape spool 56 with its greatest dimension when the tape cassette 21 is used for the first time is referred to as "two-sided adhesive tape occupying region 68". Further, the radius of the two-sided adhesive tape occupying region 68 is referred to as "wound two-sided adhesive tape radius R2".

In the tape cassette 21, the separator 53D is peeled off from the two-sided adhesive tape 53 and taken up into the separator-take-up spool 62 every time the tape printing apparatus 1 carries out printing. Accordingly, when the tape cassette 21 is used up (i.e., when the film tape 51 etc. in the tape cassette 21 are used up for creating labels), the separator 53D is thoroughly wound around the separator-take-up spool 62 with its greatest dimension so as to occupy the greatest space inside the tape cassette 21. In the following description, the radius of the greatest space occupied by the separator 53D thoroughly wound around the separator-take-up spool 62 is referred to as "wound separator radius R3".

As described in the above, the separator-take-up spool 62 is rotatably arranged between the tape spool 54 and the two-sided-adhesive-tape spool 56. Further, as shown in FIG. 8, the tape cassette 21 is configured so that straight line distance between rotational central axis of the tape spool 54 and that of the separator-take-up spool 62 (termed as first axial distance L1, hereinafter) is smaller than a sum of the wound separator radius R3 and the wound film tape radius R1. Accordingly, when the tape cassette 21 is used up, the separator 53D thoroughly wound around the separator-take-up spool 62 occupies a part of the film tape occupying region 67.

That is, since the first axial distance L1 is made smaller than the sum of the wound separator radius R3 and the wound film tape radius R1, there arises a first overlap region 69 to be shared by the film tape 51 and the separator 53D. The preparation of the first overlap region 69 makes it possible to prevent the tape cassette 21 from growing in size in proportion to the size of the first overlap region 69. Further, by preventing the tape cassette 21 from growing in size, the tape cassette 21 can prevent the main body of the tape printing apparatus 1 from growing in size, as well.

Further, the tape cassette 21 is configured so that straight line distance between rotational central axis of the two-sided-adhesive-tape spool 56 and that of the separator-take-up spool 62 (termed as second axial distance L2) is smaller than a sum of the wound separator radius R3 and the wound two-sided adhesive tape radius R2. Accordingly, when the tape cassette 21 is used up, the separator 53D thoroughly wound around the separator-take-up spool 62 occupies a part of the two-sided adhesive tape occupying region 68.

That is, since the second axial distance L2 is made smaller than the sum of the wound separator radius R3 and the wound two-sided adhesive tape radius R2, there arises a second overlap region 70 to be shared by the two-sided adhesive tape 53 and the separator 53D. The preparation of the second overlap region 70 makes it possible to prevent the tape cassette 21 from growing in size in proportion to the size of the second overlap region 70. Further, by preventing the tape cassette 21 from growing in size, the tape cassette 21 can prevent the main body of the tape printing apparatus 1 from growing in size, as well.

Figure 8:
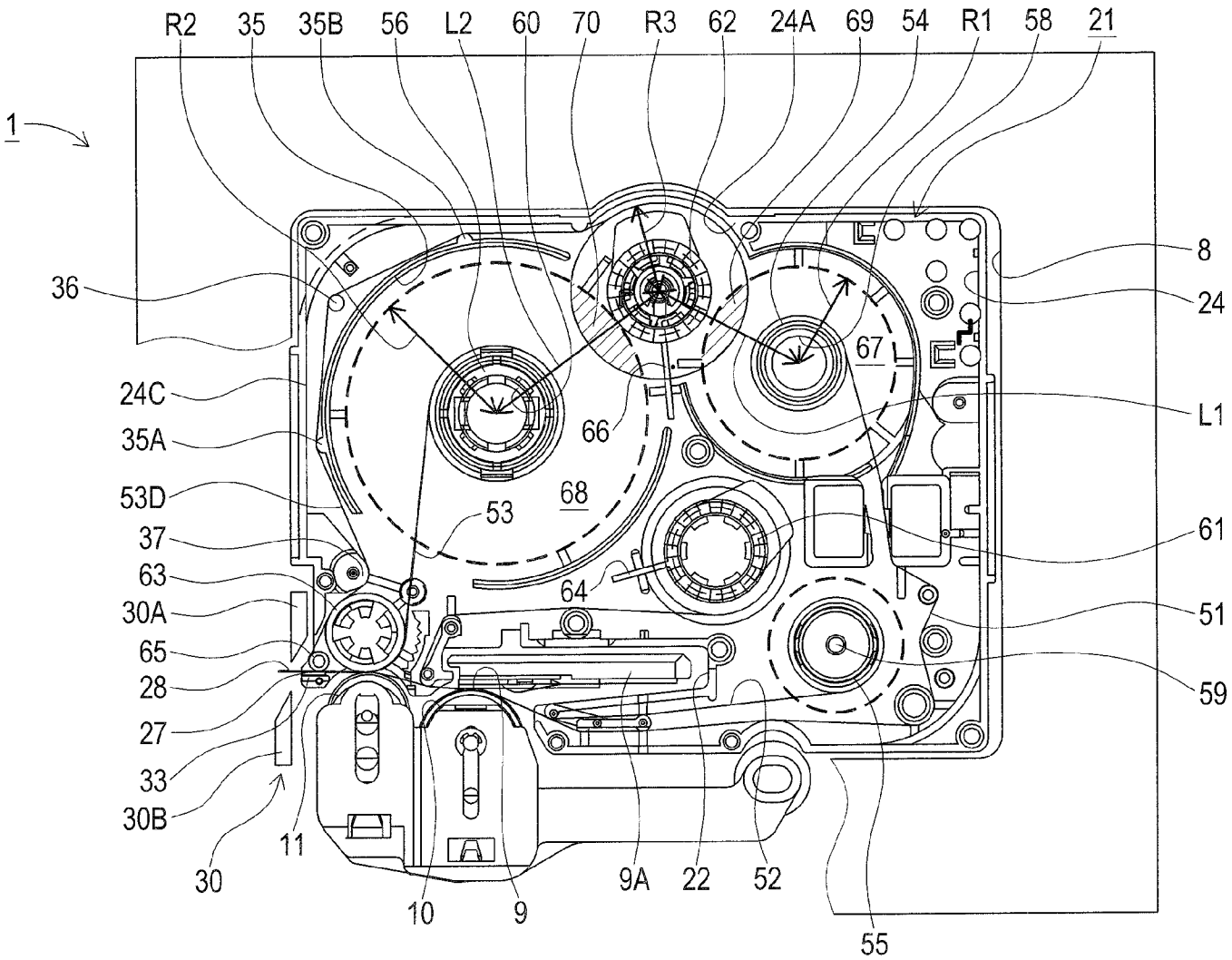
FIG. 8 is a view for illustrating positioning relation of a tape spool, a two-sided-adhesive-tape spool and a separator-take-up spool inside the tape cassette directed to the first embodiment.

Accordingly, as shown in FIG. 8, since the tape cassette 21 allows both the first overlap region 69 and the second overlap region 70 to arise, the preparation of the first overlap region 69 and the second overlap region 70 makes it possible to prevent the tape cassette 21 from growing in size in proportion to the sizes of those overlap regions. Consequently, thus configured tape cassette 21 can prevent the tape printing apparatus 1 from growing in size, as well.

It is to be noted that, by making the distance between the tape spool 54 and the two-sided adhesive tape spool 56 larger than as shown in FIG. 8, the location of the separator-take-up spool 62 may be shifted inwardly inside the tape cassette 21. Further, the first axial distance L1 may be made larger than a sum of the wound separator radius R3 and the wound film tape radius R1 and the second axial distance L2 may be made smaller than a sum of the wound separator radius R3 and the wound two-sided adhesive tape radius R2. Vice versa, the first axial distance L1 may be made smaller than a sum of the wound separator radius R3 and the wound film tape radius R1 and the second axial distance L2 may be made larger than a sum of the wound separator radius R3 and the wound two-sided adhesive tape radius R2.

Thereby, since the tape cassette 21 allows either the first overlap region 69 or the second overlap region 70 to arise, the preparation of either one of the first overlap region 69 and the second overlap region 70 makes it possible to prevent the tape cassette 21 from growing in size in proportion to the sizes of those overlap regions. Consequently, thus configured tape cassette 21 can prevent the tape printing apparatus 1 from growing in size, as well.

Accordingly, in the tape cassette 21 directed to the first embodiment, after the two-sided adhesive tape 53 is adhered to the printing surface of the film tape 51 by pressure of the tape conveying roller 63 and the tape sub roller 11, the after-printed tape 28 is conveyed in a state that the separator 53D is peeled off from the two-sided adhesive tape 53 at the tape ejecting port 27. Thereby, time and effort to peel off the separator 53D is made eliminable when the after-printed tape 28 cut in predetermined length is to be pasted on a commercial product etc.

The separator 53D that has been peeled off from the two-sided adhesive tape 53 along the peripheral surface of the separating roller 65 at the tape ejecting port 27 is guided to a space between the tape conveying roller 63 and the separator guide wall 37, i.e., to the side of the two-sided adhesive spool 56. From there, the separator 53D further travels the outside of the periphery of the wound two-sided adhesive tape 53. By the aid of the convex part 35A, the guide pin 36 and the convex part 35, the separator 53D is guided inwardly at a substantially right angle to reach the separator-take-up spool 62 and taken up into there. Since the peeled-off separator 53D can be housed inside the tape cassette 21, a user can be relieved from time and effort to discard the separator 53D peeled off from the two-sided adhesive tape 53.

Further, the separator 53D is peeled off from the two-sided adhesive tape 53 along the peripheral surface of the separating roller 65 at the tape ejecting port 27 and subsequently guided to the space between the tape conveying roller 63 and the separator guide wall 37, i.e., to the side of the two-sided-adhesive-tape spool 56. Thereby, such configuration surely makes it possible to prevent a situation that the separator 53D bows toward the after-printed tape 28 and again sticks to the adhesive layer 53C of the two-sided adhesive tape 53. Consequently, the after-printed tape 28 can be smoothly ejected outside from the tape ejecting port 27.

Further, the separating roller 65 is made rotatable, which can lower load working on the after-printed tape 28 when conveyed. Consequently, the after-printed tape 28 can be smoothly ejected outside from the tape ejecting port 27. Further, the separating roller 65 is arranged so as to come out more in the tape conveying direction than the tape ejecting port 27, whereby outside diameter of the separating roller 65 can be made large. Consequently, such configuration can facilitate assembly of the separating roller 65 and can more surely prevent a situation that the sticky after-printed tape 28 from which the separator 53D has been peeled off gets jammed at the tape ejecting port 27.

Further, since the separating roller 65 is arranged so as to closely face the fixed blade 30A, distance between a tape cutting position and an end-of-printing position on an after-printed tape 28 can be shortened. Thereby, margins of the after-printed tape 28 can be shortened.

Further, the guide wall 33 faces the separating roller 65 over an after-printed tape 28 inserted therebetween, and extends at downstream side of the tape conveying direction in comparison with the separating roller 65. Therefore, a surface opposite to the printing surface of an after-printed tape 28 can more surely be guided. Further, since the separating roller 65 is arranged so as to be close to the fixed blade 30A, the surface opposite to the printing surface of the after-printed tape 28 can surely be guided to the tape cutting position, namely, the vicinity of the front edge of the fixed blade 30A.

Further, the separator-take-up spool 62 is arranged between the two-sided adhesive-tape spool 56 and the tape spool 54. Therefore, the greatest dimension of a separator 53D for allowing the separator-take-up spool 62 to take up the separator 53D in the course of tape printing by the tape printing apparatus 1 can easily be made large and downsizing of the tape cassette 21 is made feasible, accordingly.

Further, along the peripheral surface of the separating roller 65, a peeled-off separator 53D is guided to the space between the tape conveying roller 63 and the separator guide wall 37, i.e., toward the two-sided-adhesive-tape spool 56. From there, the peeled-off separator 53D is further guided to travel the outside of the periphery of the wound two-sided adhesive tape 53 by the aid of the separator guide wall 37, the convex part 35A, the guide pin 36 and the convex part 35B and finally guided to reach the separator-take-up spool 62. Thus, spaces inside the tape cassette 21 can be used effectively and further downsizing of the tape cassette 21 is made feasible, accordingly.

[Second Embodiment]

Figure 9:
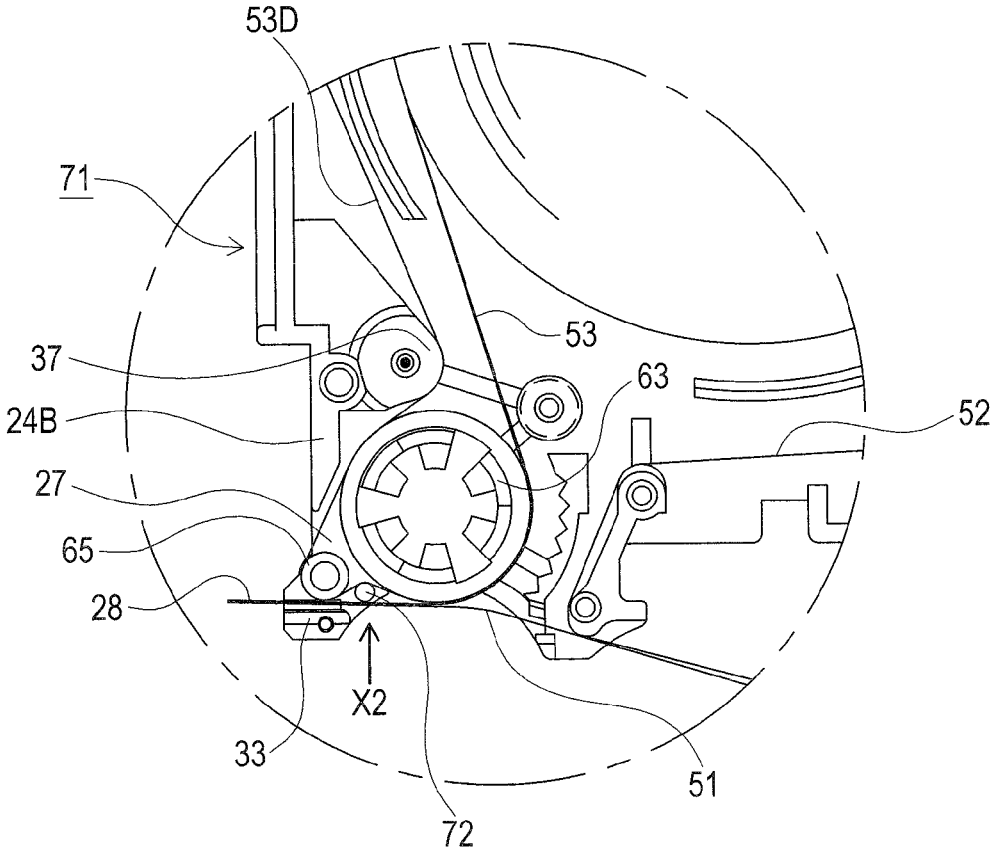
FIG. 9 is a main-part-enlarged view showing an example of a tape cassette directed to a second embodiment.
Figure 10:
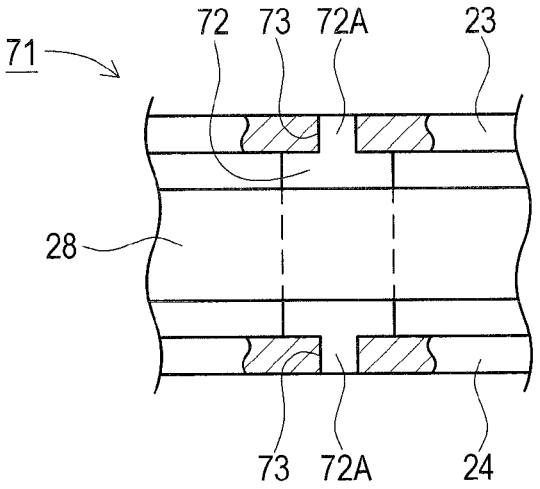
FIG. 10 is an enlarged view seen from a view point indicated with an arrow X2 shown in FIG. 9.

Next, there will be described on a tape cassette 71 directed to a second embodiment by referring to FIG. 9 and FIG. 10. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment.

The schematic configuration of the tape cassette 71 directed to the second embodiment is almost the same as that of the tape cassette 21 directed to the first embodiment. However, as shown in FIG. 9 and FIG. 10, an auxiliary separating pin 72, as an example of auxiliary separating member, is arranged between the tape conveying roller 63 and the separating roller 65 in the path of an after-printed tape 28 with a two-sided adhesive tape 53 being adhered to a printing surface of a film tape 51. The auxiliary separating pin 72 is arranged so as to be inserted between a separator 53D and an adhesive layer 53C of the two-sided adhesive tape 53.

That is, the separator 53D is peeled off from the two-sided adhesive tape 53 by the auxiliary separating pin 72 once. The separator 53D once peeled off from the two-sided adhesive tape 53 by the auxiliary separating pin 72 passes through the auxiliary separating pin 72 and thereafter, gets adhered to the adhesive layer 53C of the two-sided adhesive tape 53 and gets peeled off again along the peripheral surface of the separating roller 65.

The auxiliary separating pin 72 is a substantially cylindrical form of which length is longer than tape width of the two-sided adhesive tape 53 and of which cross section is a circle. Supporting shafts 72A are arranged upright at the centers of both ends of the auxiliary separating pin 72. Further, the peripheral surface of the auxiliary separating pin 72 is coated with a silicon resin film. Further, supporting holes 73 for rotatably supporting the supporting shafts 72A of the auxiliary separating pin 72 are arranged in both the upper case 23 and the lower case 24 of the tape cassette 71. Each supporting shaft 72A of the auxiliary separating pin 72 is rotatably inserted in each supporting hole 73.

Therefore, in the tape cassette 71 directed to the second embodiment, the auxiliary separating pin 72 is rotatably supported at both ends thereof and configured to get in contact with the adhesive layer 53C and the separator 53D of the two-sided adhesive tape 53 across the full width thereof.

Thereby, the tape cassette 71 directed to the second embodiment brings working effect as below, in addition to the afore-mentioned working effect of the tape cassette 21 directed to the first embodiment. Specifically, after peeled off from the two-sided adhesive tape 53 by the auxiliary separating pin 72 once, the separator 53D gets adhered to the adhesive layer 53C of the two-sided adhesive tape 53 again and conveyed to the separating roller 65. Thereby, the after-printed tape 28 can be conveyed to the separating roller 65 with adhesibility of the two-sided adhesive tape 53 to the separator 53D being weakened.

Accordingly, it is made easy to peel off the separator 53D from the two-sided adhesive tape 53 that has been adhered to the film tape 51 along the peripheral surface of the separating roller 65. Consequently, it is made possible to convey the sticky after-printed tape 28 from which the separator 53D has been peeled off to the tape ejecting port 27 smoothly.

[Third Embodiment]

Figure 11:
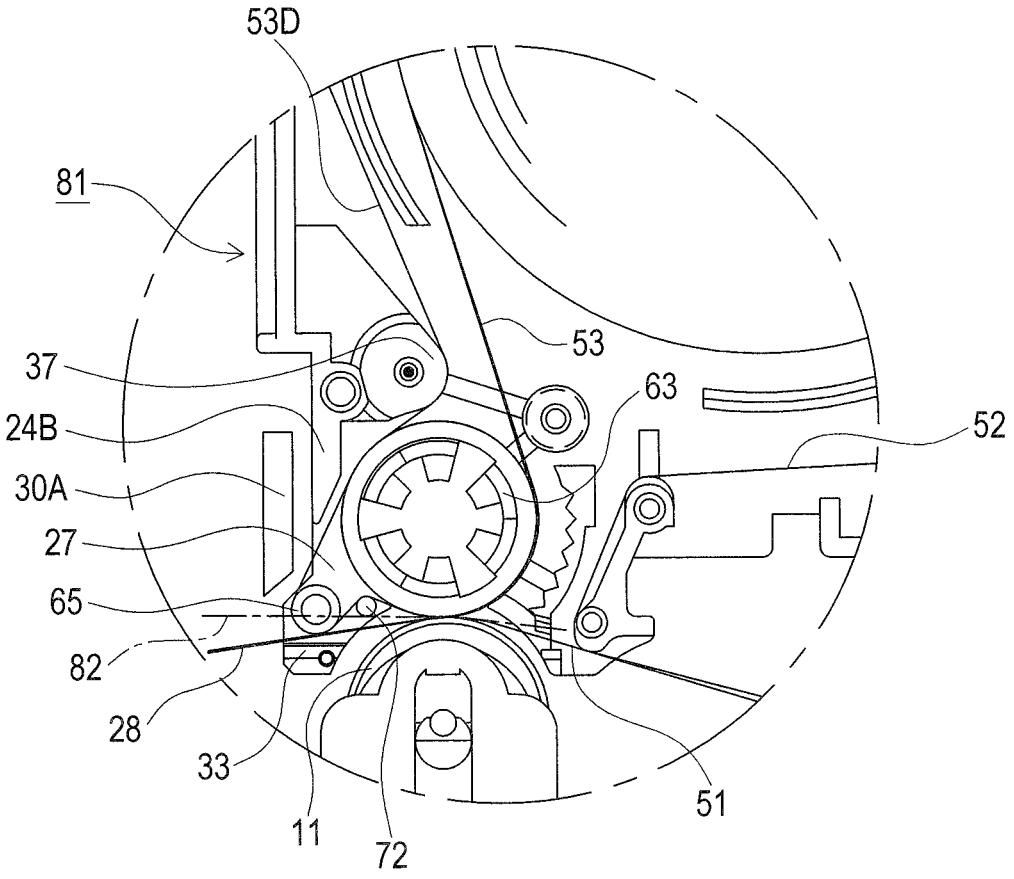
FIG. 11 is a main-part-enlarged view showing an example of a tape cassette directed to a third embodiment.

Next, there will be described on a tape cassette 81 directed to a third embodiment by referring to FIG. 11. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment. Further, there are numerals and signs identical with those assigned to constituent elements of the tape cassette 71 directed to the second embodiment illustrated with FIG. 9 and FIG. 10 and those identical numerals and signs are assigned to constituent elements of the present embodiment that are completely or substantially identical with those constituting the tape cassette 71 directed to the second embodiment.

The schematic configuration of the tape cassette 81 directed to the third embodiment is almost the same as that of the tape cassette 71 directed to the second embodiment. However, as shown in FIG. 11, position of the separating roller 65 is moved in a tape thickness direction so that the peripheral surface of the separating roller 65 deviates to the side of the tape sub roller 11 rather than to a common tangent 82 of the tape conveying roller 63 and the tape sub roller 11. Further, the guide wall 33 is formed so that its surface facing the separating roller 65 at the downstream side of the tape conveying direction, namely, its exit side end portion, is positioned almost on a common tangent of the peripheral surface of the separating roller 65 and that of the tape conveying roller 63.

Accordingly, in the tape cassette 81 directed to the third embodiment, the separator 53D once peeled off from the two-sided adhesive tape 53 by the auxiliary separating pin 72 passes through the auxiliary separating pin 72 and thereafter, gets adhered to the adhesive layer 53C of the two-sided adhesive tape 53 and gets peeled off again along the peripheral surface of the separating roller 65. Further, the after-printed tape 28 in a state that its separator 53D has been peeled off from its two-sided adhesive tape 53 by the auxiliary separating pin 72 reaches the peripheral surface of the separating roller 65, passing through the common tangent of the peripheral surface of the separating roller 65 and that of the tape conveying roller 63.

After the separator 53D is peeled off along the peripheral surface of the separating roller 65, the after-printed tape 28 is ejected outside in contact with the exit side end portion of the guide wall 33. That is, the after-printed tape 28 with its separator 53D peeled off from the two-sided adhesive tape 53 is ejected outside from the tape ejecting port 27 with inclination to a direction of one surface thereof on which the two-sided adhesive tape 53 is not adhered.

Thereby, the tape cassette 81 directed to the third embodiment brings working effect as below, in addition to the aforementioned working effect of the tape cassette 71 directed to the second embodiment. Specifically, even though the after-printed tape 28 is attracted toward the separator 53D due to its adhesibility when the separator 53D is peeled off from the two-sided adhesive tape 53 along the peripheral surface of the separating roller 65, the after-printed tape 28 is allowed to travel deviating to the tape sub roller 11 rather than to the common tangent of the tape-conveying roller 63 and the tape sub roller 11. Thereby, it is made possible for the after-printed tape 28 to surely go into a space between the fixed blade 30A and the movable blade 30B.

It is to be noted that the auxiliary separating pin 72 in the tape cassette 81 may be omitted. Thereby, the tape cassette 81 without the auxiliary separating pin 72 brings working effect as below, in addition to the afore-mentioned working effect of the tape cassette 21 directed to the first embodiment. Specifically, even though the after-printed tape 28 is attracted toward the separator 53D due to its adhesibility when separator 53D is peeled off from the two-sided adhesive tape 53 along the peripheral surface of the separating roller 65, the after-printed tape 28 is allowed to travel deviating to the tape sub roller 11 rather than to the common tangent of the tape-conveying roller 63 and the tape sub roller 11. Thereby, it is made possible for the after-printed tape 28 to surely go into a space between the fixed blade 30A and the movable blade 30B.

[Fourth Embodiment]

Figure 12:
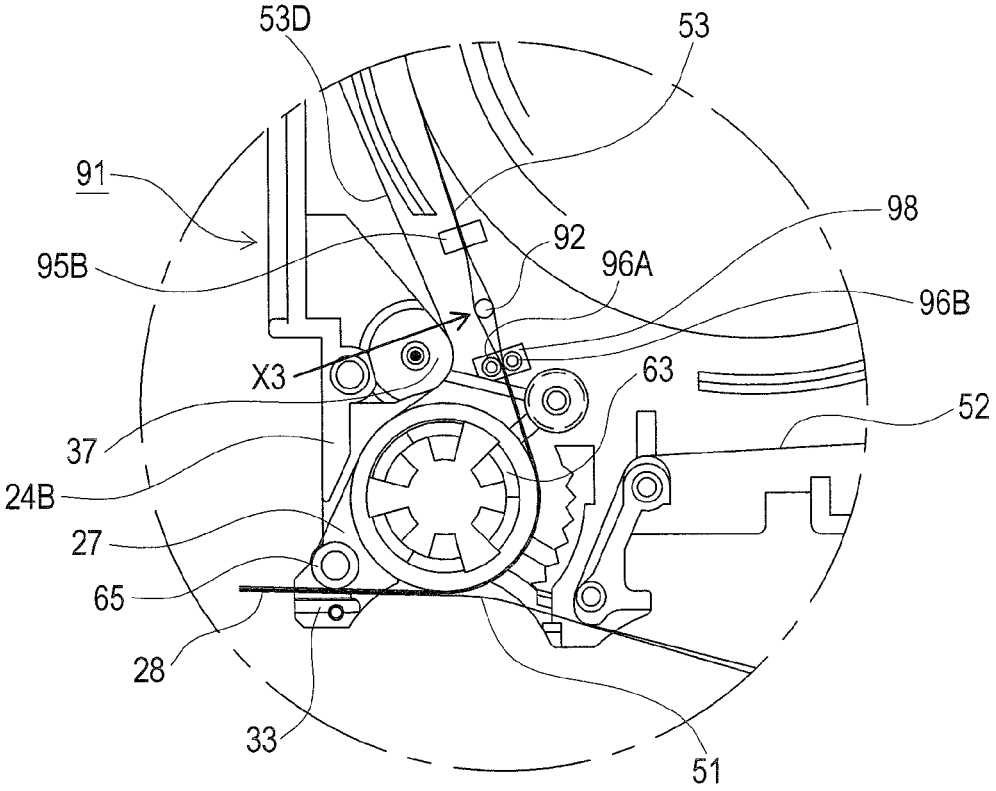
FIG. 12 is a main-part-enlarged view showing an example of a tape cassette directed to a fourth embodiment.
Figure 13:
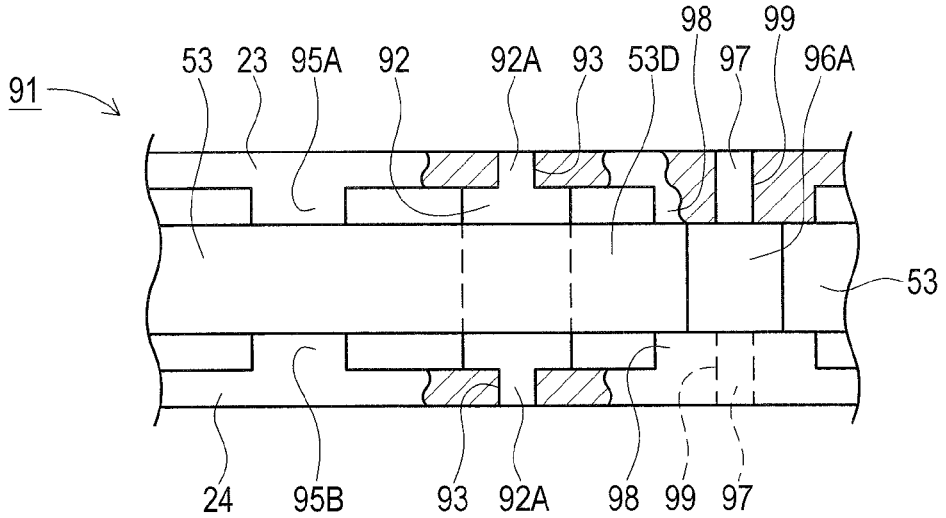
FIG. 13 is an enlarged view seen from a view point indicated with an arrow X3 shown in FIG. 12.

Next, there will be described on a tape cassette 91 directed to a fourth embodiment by referring to FIG. 12 and FIG. 13. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment.

The schematic configuration of the tape cassette 91 directed to the fourth embodiment is almost the same as that of the tape cassette 21 directed to the first embodiment. However, as shown in FIG. 12 and FIG. 13, an auxiliary separating pin 92, as an example of auxiliary separating member, is arranged between the two-sided-adhesive-tape spool 56 and the tape conveying roller 63 in the path of a two-sided adhesive tape 53, namely between a pull-out port of the two sided adhesive tape 53 and the tape conveying roller 63. The auxiliary separating pin 92 is arranged so as to be inserted between a separator 53D and an adhesive layer 53C of the two-sided adhesive tape 53.

At the upstream for the auxiliary separating pin 92 with reference to the conveying direction of the two-sided adhesive tape 53, a pair of upstream side guiding members 95A and 95B are arranged so as to protrude from the upper case 23 and the lower case 24 of the tape cassette 91, respectively, and face each other with a distance almost the same as the width of the two-sided adhesive tape 53. Each of the pair of upstream side guiding members 95A and 95B is substantially rectangular shaped when seen from top. Thereby, the pair of upstream side guiding members 95A and 95B make it possible to restrict the two-sided adhesive tape 53 to moving in its width directions and to fluently guide the two-sided adhesive tape 53 to the auxiliary separating pin 92. It is to be noted that arrangement of the pair of upstream side guiding members 95A and 95B is optional.

Further, at the downstream for the auxiliary separating pin 92 with reference to the conveying direction of the two-sided adhesive tape 53, a pair of downstream side rollers 96A and 96B for holding the two-sided adhesive tape 53 are arranged so as to face each other with a distance almost the same as the thickness of the two-sided adhesive tape 53. Through the space between the pair of the downstream side rollers 96A and 96B, there are pulled out the separator 53D once peeled off from the two-sided adhesive tape 53 by the auxiliary separating pin 92 and the two-sided adhesive tape 53 from which the separator 53D is peeled off.

That is, the two-sided adhesive tape 53 pulled out from the two-sided-adhesive-tape spool 56 passes through the space between the pair of upstream side guiding members 95A and 95B that restrict the two-sided adhesive tape 53 to moving in its width directions and further travels to reach the auxiliary separating pin 92. Thereafter, the separator 53D is once peeled off from the two-sided adhesive tape 53 by the auxiliary separating pin 92. The separator 53D once peeled off from the two-sided adhesive tape 53 by the auxiliary separating pin 92 as well as the two-sided adhesive tape 53 from which the separator 53D is peeled off pass through the auxiliary separating pin 92 and further travel to pass through the space between the pair of downstream side rollers 96A and 96B. Thereafter, the separator 53D passing through the space between the pair of downstream side rollers 96A and 96B is adhered to the adhesive layer 53C of the two-sided adhesive tape 53 again and pulled out along the peripheral surface of the tape conveying roller 63.

The auxiliary separating pin 92 is a substantially cylindrical form of which length is longer than tape width of the two-sided adhesive tape 53 and of which cross section is a circle. Supporting shafts 92A are arranged upright at the centers of both ends of the auxiliary separating pin 92. Further, the peripheral surface of the auxiliary separating pin 92 is coated with a silicon resin film. Further, supporting holes 93 for rotatably supporting the supporting shafts 92A of the auxiliary separating pin 92 are arranged in both the upper case 23 and the lower case 24 of the tape cassette 91.

Since, each supporting shaft 92A of the auxiliary separating pin 92 is rotatably inserted in each supporting hole 93, the auxiliary separating pin 92 is rotatably supported at both ends thereof and configured to get in contact with the adhesive layer 53C and the separator 53D of the two-sided adhesive tape 53 across the full width thereof.

Further, each of the pair of downstream side rollers 96A and 96B is a substantially cylindrical form of which length is almost the same as the tape width of the two-sided adhesive tape 53 and of which cross section is a circle. Supporting shafts 97 are arranged upright at the centers of both ends with respect to each of the pair of downstream side rollers 96A and 96B. Further, the peripheral surfaces of the pair of downstream side rollers 96A and 96B are coated with a silicon resin film. Further, stepped portions 98, 98 are arranged in the upper case 23 and the lower case 24 of the tape cassette 91, respectively. The stepped portions 98, 98, rectangular shaped when seen from top, are configured to protrude from the upper case 23 and the lower case 24, respectively, in contact with longitudinal two edges of the two-sided adhesive tape 53 so as to restrict to moving in width direction of the two-sided adhesive tape 53 and guide the two-sided adhesive tape 53 in its conveying direction fluently.

Further, a pair of supporting holes 99 are formed in their respective stepped portions 98, 98 so as to rotatably support the supporting shafts 97 of the pair of downstream side rollers 96A 96B. Further, the supporting shafts 97 of the pair of downstream side rollers 96A 96B are inserted in their respective supporting holes 99 and rotatably supported thereat. In addition, the pair of downstream side rollers 96A and 96B are arranged so as to face each other with a distance almost the same as the thickness of the two-sided adhesive tape 53. Out of the pair of downstream side rollers 96A and 96B, at least the downstream side roller 96B may be configured to have a peripheral surface coated with a silicon resin film, as the downstream side roller 96B gets in contact with the adhesive layer 53A of the two-sided adhesive tape 53.

Accordingly, in the tape cassette 91 directed to the fourth embodiment, the two-sided adhesive tape 53 pulled out from the two-sided-adhesive-tape spool 56 passes through the space between the pair of upstream side guiding members 95A and 95B that restrict the two-sided adhesive tape 53 to moving in its width directions and further travels to reach the auxiliary separating pin 92. Thereafter, the separator 53D is peeled off from the two-sided adhesive tape 53 by the auxiliary separating pin 92 of which end portions are rotatably supported. After that, the separator 53D as well as the two-sided adhesive tape 53 from which the separator 53 has been peeled off travel to pass through the space between the stepped portions 98, 98 and the space between the pair of downstream side rollers 96A and 96B. Thereafter, the separator 53D gets adhered to the adhesive layer 53C of the two-sided adhesive tape 53 again and pulled out along the peripheral surface of the tape conveying roller 63.

Thereby, the tape cassette 91 directed to the fourth embodiment brings working effect as below, in addition to the aforementioned working effect of the tape cassette 21 directed to the first embodiment. Specifically, after peeled off from the two-sided adhesive tape 53 by the auxiliary separating pin 92 once, the separator 53D gets adhered to the adhesive layer 53C of the two-sided adhesive tape 53 again and conveyed to the tape conveying roller 63. Thereby, the two-sided adhesive tape 53 can get adhered to the printing surface of the film tape 51 by pressure with adhesibility of the two-sided adhesive tape 53 to the separator 53D being weakened.

Accordingly, it is made easy to peel off the separator 53D from the two-sided adhesive tape 53 that has been adhered to the film tape 51 along the peripheral surface of the separating roller 65. Consequently, it is made possible to convey the sticky after-printed tape 28 from which the separator 53D has been peeled off to the tape ejecting port 27 smoothly.

[Fifth Embodiment]

Figure 14:
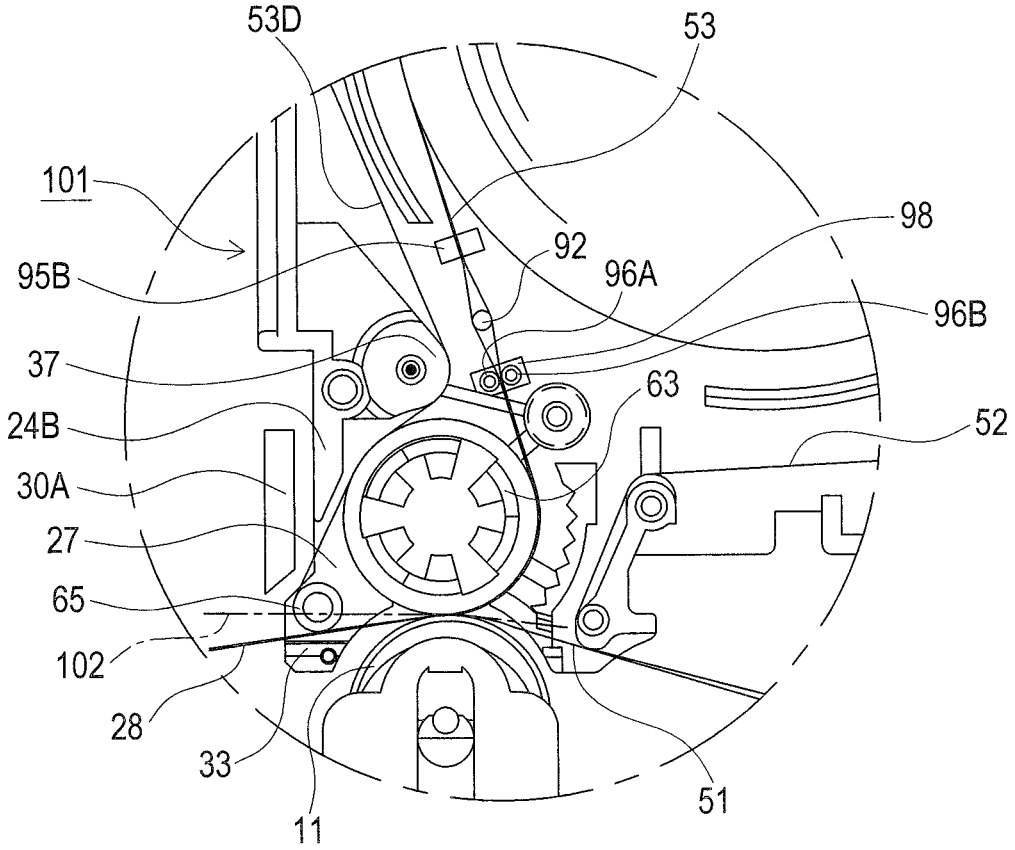
FIG. 14 is a main-part-enlarged view showing an example of a tape cassette directed to a fifth embodiment.
Figure 15:
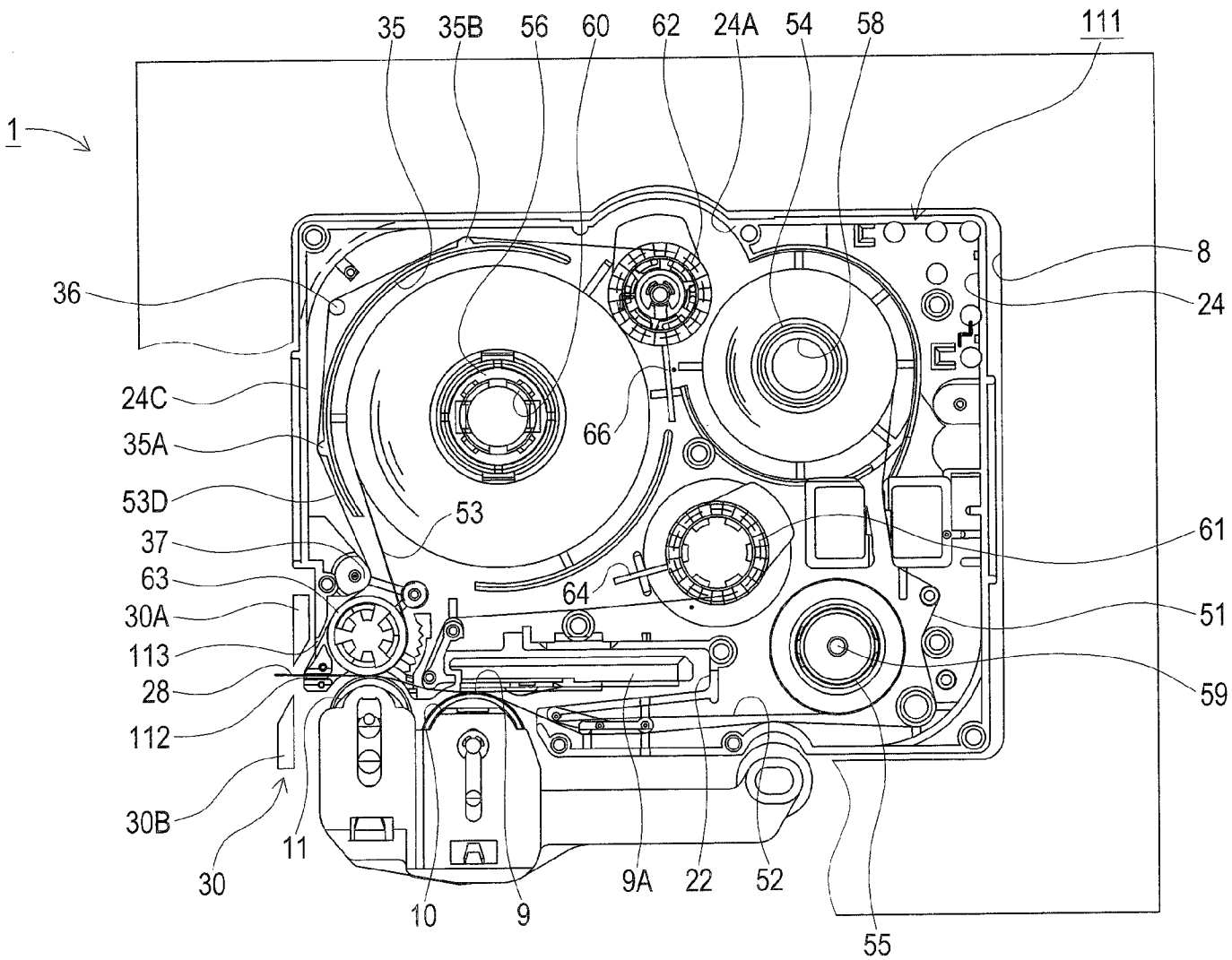
FIG. 15 is a main-part-enlarged plain view that can be seen in case an upper case of a tape cassette directed to a sixth embodiment is removed while the tape cassette is placed in a cassette housing portion of a tape printing apparatus.
Figure 16:
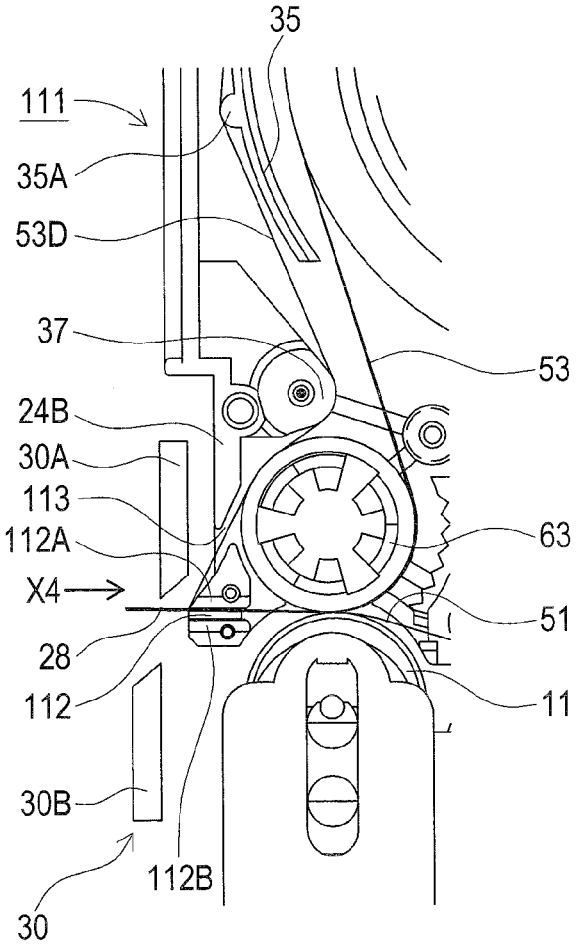
FIG. 16 is a main-part-enlarged view of surroundings of a tape ejecting port shown in FIG. 15.
Figure 17:
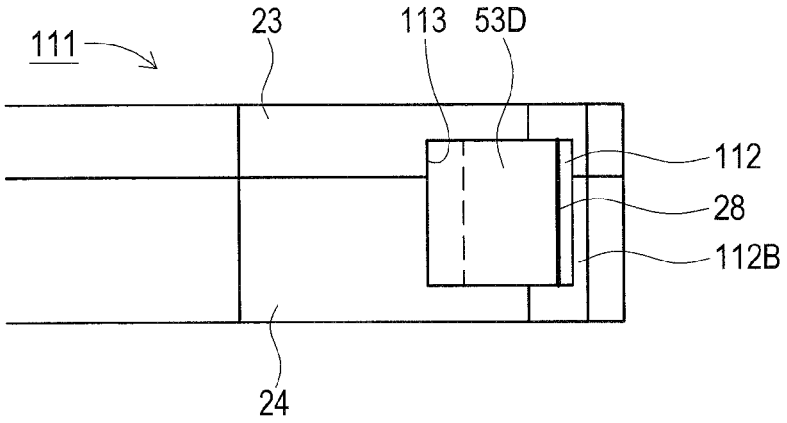
FIG. 17 is a view of the tape ejecting port seen from a view point indicated with an arrow X4 shown in FIG. 16.
Figure 18:
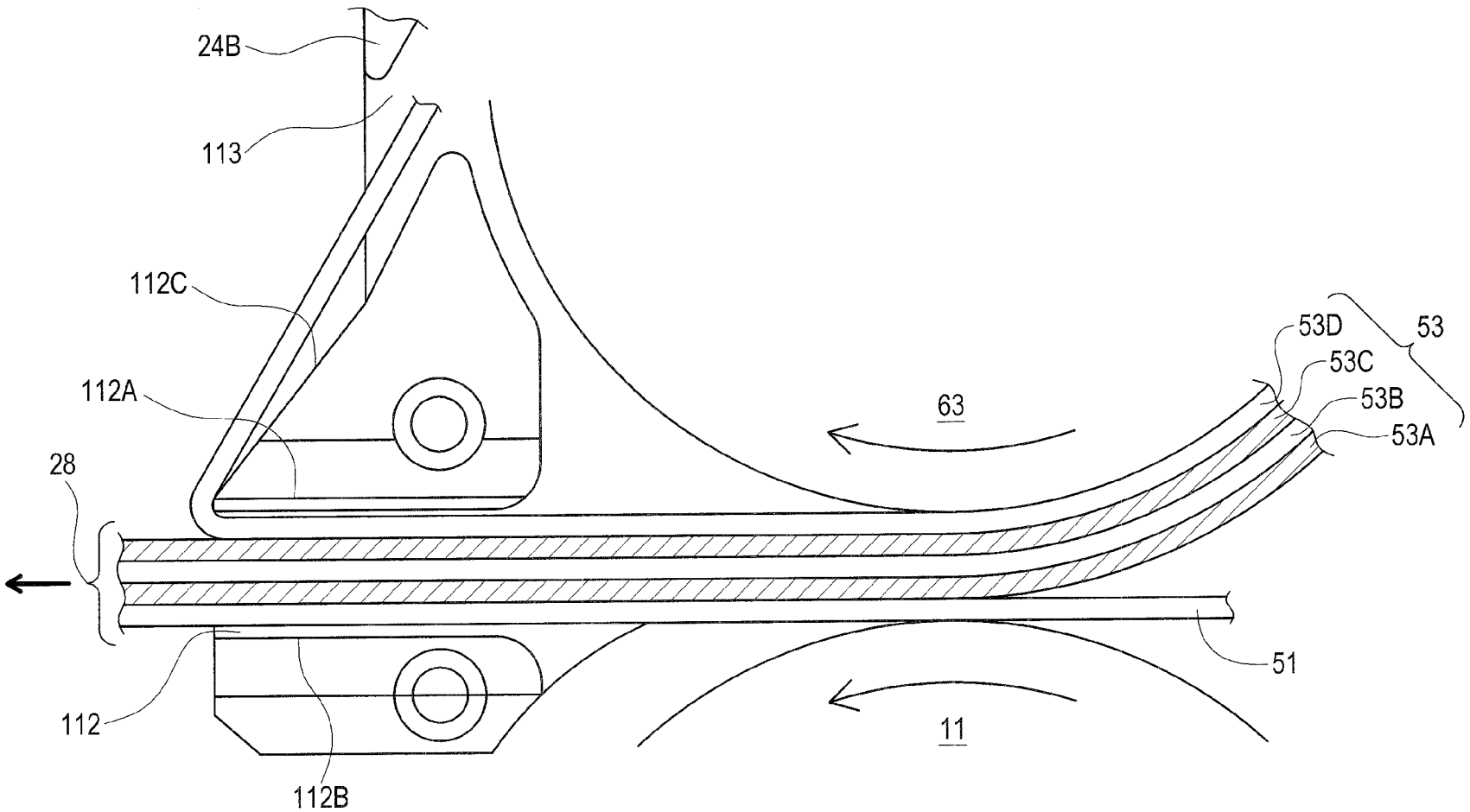
FIG. 18 is a view for exemplarily illustrating a state that a separator is peeled off at the tape ejecting port after a two-sided adhesive tape is adhered to a film tape with pressure.

Next, there will be described on a tape cassette 101 directed to a fifth embodiment by referring to FIG. 14. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment. Further, there are numerals and signs identical with those assigned to constituent elements of the tape cassette 91 directed to the fourth embodiment illustrated with FIG. 12 and FIG. 13 and those identical numerals and signs are assigned to constituent elements of the present embodiment that are completely or substantially identical with those constituting the tape cassette 91 directed to the fourth embodiment.

The schematic configuration of the tape cassette 101 directed to the fifth embodiment is almost the same as that of the tape cassette 91 directed to the fourth embodiment. However, as shown in FIG. 14, position of the separating roller 65 is moved in a tape thickness direction so that the peripheral surface of the separating roller 65 deviates to the side of the tape sub roller 11 rather than to a common tangent 102 of the tape conveying roller 63 and the tape sub roller 11. Further, the guide wall 33 is formed so that its surface facing the separating roller 65 at the downstream side of the tape conveying direction, namely, its exit side end portion, is positioned almost on a common tangent of the peripheral surface of the separating roller 65 and that of the tape conveying roller 63.

Accordingly, in the tape cassette 101 directed to the fifth embodiment, the two-sided adhesive tape 53 pulled out from the two-sided-adhesive-tape spool 56 passes through the space between the pair of upstream side guiding members 95A and 95B that restrict the two-sided adhesive tape 53 to moving in its width directions and further travels to reach the auxiliary separating pin 92. There, the separator 53D is once peeled off from the two-sided adhesive tape 53 by the auxiliary separating pin 92 of which end portions are rotatably supported. After that, the separator 53D as well as the two-sided adhesive tape 53 from which the separator 53 is peeled off pass through the space between the stepped portions 98, 98 and the space between the pair of downstream side rollers 96A and 96B, whereby the separator 53D is adhered to the adhesive layer 53C of the two-sided adhesive tape 53 again and pulled out along the peripheral surface of the tape conveying roller 63.

Further, the after-printed tape 28 in a state that its separator 53D has been peeled off from its two-sided adhesive tape 53 once by the auxiliary separating pin 92 travels to reach the peripheral surface of the separating roller 65, passing through the common tangent of the peripheral surface of the separating roller 65 and that of the tape conveying roller 63. After the separator 53D is peeled off along the peripheral surface of the separating roller 65, the after-printed tape 28 is ejected outside in contact with the exit side end portion of the guide wall 33. That is, the after-printed tape 28 with its separator 53D peeled off from the two-sided adhesive tape 53 is ejected outside from the tape ejecting port 27 with inclination to a direction of one surface thereof on which the two-sided adhesive tape 53 is not adhered.

Thereby, the tape cassette 101 directed to the fifth embodiment brings working effect as below, in addition to the aforementioned working effect of the tape cassette 91 directed to the fourth embodiment. Specifically, even though the after-printed tape 28 is attracted toward the separator 53D due to its adhesibility when the separator 53D is peeled off from the two-sided adhesive tape 53 along the peripheral surface of the separating roller 65, the after-printed tape 28 is allowed to travel deviating to the tape sub roller 11 rather than to the common tangent of the tape-conveying roller 63 and the tape sub roller 11. Thereby, it is made possible for the after-printed tape 28 to surely go into a space between the fixed blade 30A and the movable blade 30B.

[Sixth Embodiment]

Next, there will be described on a tape cassette 111 directed to a sixth embodiment by referring to FIG. 15 through FIG. 19. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment.

The schematic configuration of the tape cassette 111 directed to the sixth embodiment is almost the same as that of the tape cassette 21 directed to the first embodiment. However, as shown in FIG. 15 through FIG. 18, the tape ejecting port 112 for ejecting the after-printed tape 28 therefrom is formed so as to have a slit-like shape when seen from front, with predetermined width (e.g., about 3 mm of width) in the tape conveying direction. Near the tape ejecting port 112, the side wall 24B is configured to stretch to the guide wall 112A that gets in contact with the separator 53D of the two-sided adhesive tape 53. At the part where the side wall 24B faces the tape conveying roller 63, a separator entrance 113 is formed so as to run through. The separator entrance 113 allows entry of the separator 53D that has been peeled off from the two-sided adhesive tape 53 at the exit side edge portion of the guide wall 112A.

Further, the tape ejecting port 112 is constituted by the guide wall 112A and the guide wall 112B that faces the guide wall 112A over the after-printed tape 28. The guide wall 112A and the guide wall 112B are arranged so as to be away from each other by predetermined distance (e.g., about 1 mm). The guide wall 112B guides the after-printed tape 28 to the downstream of the tape conveying direction while getting in contact with outer surface of the film tape 51. Further, the exit side edge portion of the guide wall 112A and that of the guide wall 112B are configured to come out in the downstream of the tape conveying direction in comparison with the side wall 24B so as to closely face the fixed blade 30A.

Further, the guide wall 112A constituting the tape ejecting port 112 is configured to have an inclined surface 112C that inclines toward the separator entrance 113 and includes an acute-angled front edge when seen from top (e.g., front edge angle thereof is about between 30 degrees to 50 degrees). The inclined surface 112C corresponds to a part of the guide wall 112A at the downstream side of the tape conveying direction, namely, the exit side edge portion of the guide wall 112A. The inclined surface 112C is formed so as to incline to the after-printed tape 28 rather than to the common tangent of the exit side edge portion of the guide wall 112A and the tape conveying roller 63, whereby the inclined surface 1120 does not get contact with the peeled-off separator 53D.

Further, the separator entrance 113 includes an after-printed-tape-28-side inner side surface that stretches to a tape-conveying-roller-63-side edge portion of the inclined surface 112C. Still further, the separator entrance 113 includes two inner side wall portions that face each other over the separator 53D placed therebetween. The two inner side wall portions are formed so as to be away from each other by predetermined distance (e.g., about 2 mm) in substantially parallel to the common tangent of the exit side edge portion of the guide wail 112A and the tape conveying roller 63.

As shown in FIG. 15 through FIG. 18, the two-sided adhesive tape 53 that has been pulled out from the two-sided-adhesive spool 56 travels and passes through a path between the tape conveying roller 63 driven by the tape-driving-roller shaft 14 for rotation and the tape sub roller 11. Thereafter, the adhesive layer 53A on which the separator 53D is not overlaid is pressed against the printing surface of the film tape 51.

After that, the separator 53D is peeled off from the two-sided adhesive tape 53 pressed and adhered to the film tape 51, along the exit side edge portion of the guide wall 112A of the tape ejecting port 112. From there, the separator 53D is allowed to enter the separator entrance 113 and further guided toward the two-sided-adhesive-tape spool 56 along the peripheral surface of the tape conveying roller 63, i.e., toward the pull-out direction (upward direction in FIG. 15). After that, the separator 53D is further guided to reach the external of the guide rib 35 along a wall surface of the separator guide wall 37. From there, the separator 53D further travels the outside of the periphery of the wound two-sided adhesive tape 53 passing through peripheral surfaces of the convex part 35A, the guide pin 36 and the convex part 35B. The separator 53D finally reaches the separator-take-up spool 62 inwardly at a substantially right angle.

Thereafter, the front end of the separator 53D is fixedly adhered to the peripheral surface of the separator-take-up spool 62 by an adhesive tape or the like and taken up into the separator-take-up spool 62 that is driven by the separator-take-up shaft 16 for rotation. It is to be noted that the separator-take-up shaft 16 is driven for rotation in synchronous with rotation of the tape-driving-roller shaft 14 and the ribbon-take-up shaft 15.

The separator 53D is peeled off from the film tape 51 at the exit side edge portion of the tape ejecting port 112 and the film tape 51 is consequently placed in a state that the adhesive layer 53A, the base film 53B and the adhesive layer 53C are overlaid on the printing surface thereof, i.e., in a state of a sticky after-printed tape 28 from which the separator 53D has been peeled off. The film tape 51 in the above such state is conveyed to the outside of the tape cassette 21 through the tape ejecting port 27. After that, through the cutter unit 30, the sticky after-printed tape 28 from which the separator 53D has been peeled off is conveyed outside from the label ejecting port 17 of the tape printing apparatus 1.

The after-printed tape 28 is conveyed by predetermined length and a not-shown cutting motor is driven for operating the movable blade 30B. Consequently, from the label ejecting port 17, there is ejected the predetermined length of the sticky after-printed tape 28 from which the separator 53D has been peeled off.

Next, there will be described on positioning relation with respect to the tape spool 54, the two-sided-adhesive-tape spool 56 and the separator-take-up spool 62 of the tape cassette 111 by referring to FIG. 19.

As is already described, in the tape cassette 111, the film tape 51 wound around the tape spool 54 is pulled out from there every time the tape printing apparatus 1 carries out printing. Accordingly, when the tape cassette 111 is used for the first time, the film tape 51 is wound around the tape spool 54 with its greatest dimension (refer to FIG. 15). It is to be noted that a region occupied by the film tape 51 that is wound around the tape spool 54 with its greatest dimension when the tape cassette 111 is used for the first time is referred to as "film tape occupying region 115". Further, the radius of the film tape occupying region 115 is referred to as "wound film tape radius R4".

Further, in similar with the film tape 51, the two-sided adhesive tape 53 wound around the two-sided-adhesive-tape spool 56 is pulled out from there every time the tape printing apparatus 1 carries out printing. Accordingly, when the tape cassette 111 is used for the first time, the two-sided adhesive tape 53 is wound around the two-sided-adhesive-tape spool 56 with its greatest dimension (refer to FIG. 15). It is to be noted that a region occupied by the two-sided adhesive tape 53 that is wound around the two-sided-adhesive-tape spool 56 with its greatest dimension when the tape cassette 111 is used for the first time is referred to as "two-sided adhesive tape occupying region 116". Further, the radius of the two-sided adhesive tape occupying region 116 is referred to as "wound two-sided adhesive tape radius R5".

In the tape cassette 111, the separator 53D is peeled off from the two-sided adhesive tape 53 and taken up into the separator-take-up spool 62 every time the tape printing apparatus 1 carries out printing. Accordingly, when the tape cassette 111 is used up (i.e., when the film tape 51 etc in the tape cassette 111 are used up for creating labels), the separator 53D is thoroughly wound around the separator-take-up spool 62 with its greatest dimension so as to occupy the greatest space inside the tape cassette 111. In the following description, the radius of the greatest space occupied by the separator 53D thoroughly wound around the separator-take-up spool 62 is referred to as "wound separator radius R6".

As described in the above, the separator-take-up spool 62 is rotatably arranged between the tape spool 54 and the two-sided-adhesive-tape spool 56. Further, as shown in FIG. 19, the tape cassette 111 is configured so that straight line distance between rotational central axis of the tape spool 54 and that of the separator-take-up spool 62 (termed as third axial distance L3, hereinafter) is smaller than a sum of the wound separator radius R6 and the wound film tape radius R4. Accordingly, when the tape cassette 111 is used up, the separator 53D thoroughly wound around the separator-take-up spool 62 occupies a part of the film tape occupying region 115.

That is, since the first axial distance L3 is made smaller than the sum of the wound separator radius R6 and the wound film tape radius R4, there arises a third overlap region 117 to be shared by the film tape 51 and the separator 53D. The preparation of the third overlap region 117 makes it possible to prevent the tape cassette 111 from growing in size in proportion to the size of the third overlap region 117. Further, by preventing the tape cassette 111 from growing in size, the tape cassette 111 can prevent the main body of the tape printing apparatus 1 from growing in size, as well.

Further, the tape cassette 111 is configured so that straight line distance between rotational central axis of the two-sided-adhesive-tape spool 56 and that of the separator-take-up spool 62 (termed as fourth axial distance L4) is smaller than a sum of the wound separator radius R6 and the wound two-sided adhesive tape radius R5. Accordingly, when the tape cassette 111 is used up, the separator 53D thoroughly wound around the separator-take-up spool 62 occupies a part of the two-sided adhesive tape occupying region 116.

That is, since the fourth axial distance L4 is made smaller than the sum of the wound separator radius R6 and the wound two-sided adhesive tape radius R5, there arises a fourth overlap region 118 to be shared by the two-sided adhesive tape 53 and the separator 53D. The preparation of the fourth overlap region 118 makes it possible to prevent the tape cassette 111 from growing in size in proportion to the size of the fourth overlap region 118. Further, by preventing the tape cassette 111 from growing in size, the tape cassette 111 can prevent the main body of the tape printing apparatus 1 from growing in size, as well.

Figure 19:
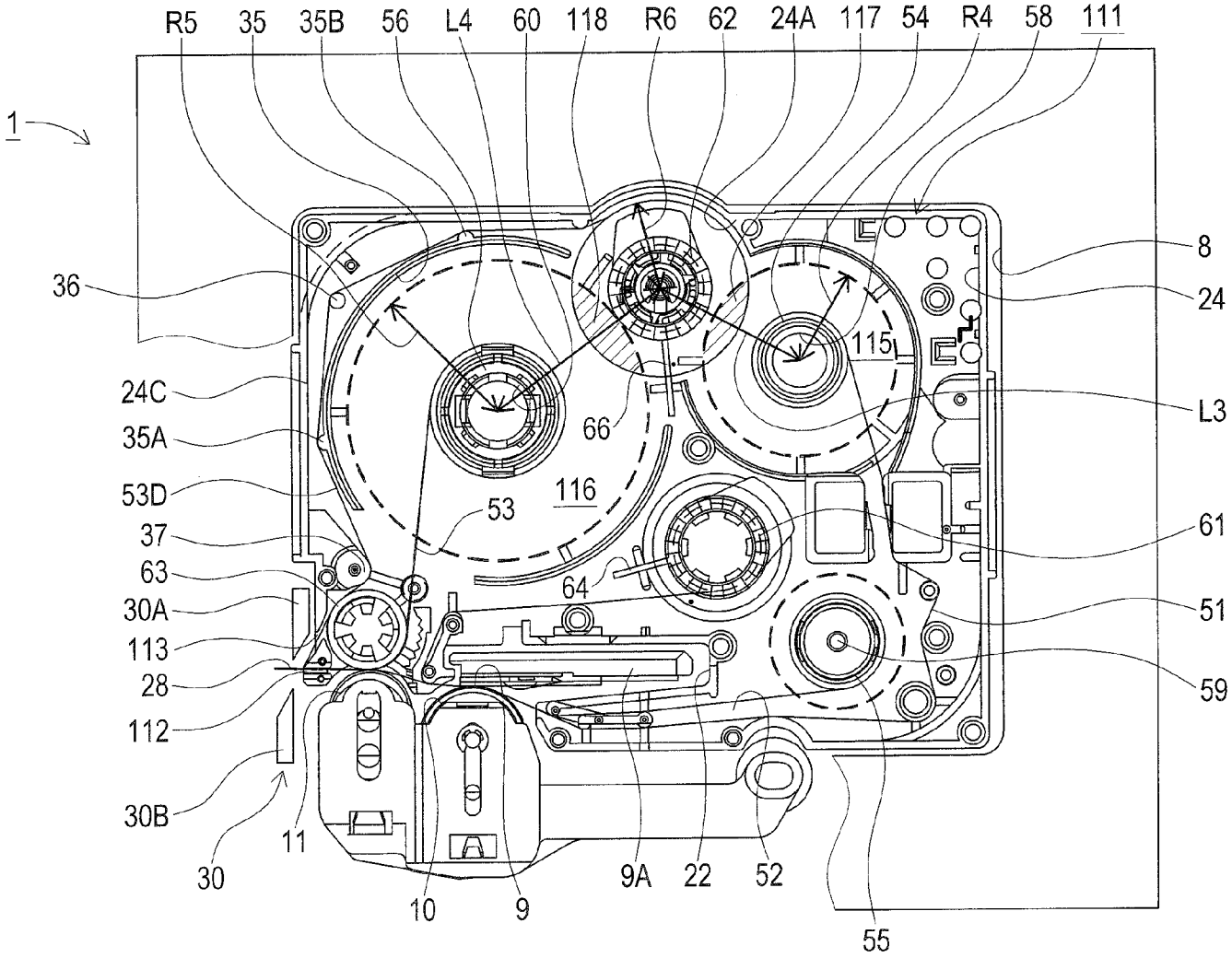
FIG. 19 is a view for illustrating positioning relation of a tape spool, a two-sided-adhesive-tape spool and a separator-take-up spool inside the tape cassette directed to the sixth embodiment.

Accordingly, as shown in FIG. 19, since the tape cassette 111 allows both the third overlap region 117 and the fourth overlap region 118 to arise, the preparation of the third overlap region 117 and the fourth overlap region 118 makes it possible to prevent the tape cassette 111 from growing in size in proportion to the sizes of those overlap regions. Consequently, thus configured tape cassette 111 can prevent the tape printing apparatus 1 from growing in size, as well.

It is to be noted that, by making the distance between the tape spool 54 and the two-sided adhesive tape spool 56 larger than as shown in FIG. 19, the location of the separator-take-up spool 62 may be shifted inwardly inside the tape cassette 111. Further, the third axial distance L3 may be made larger than a sum of the wound separator radius R6 and the wound film tape radius R4 and the fourth axial distance L4 may be made smaller than a sum of the wound separator radius R6 and the wound two-sided adhesive tape radius R5. Vice versa, the third axial distance L3 may be made smaller than a sum of the wound separator radius R6 and the wound film tape radius R4 and the fourth axial distance L4 may be made larger than a sum of the wound separator radius R6 and the wound two-sided adhesive tape radius R5.

Thereby, since the tape cassette 111 allows either the third overlap region 117 or the fourth overlap region 118 to arise, the preparation of either one of the third overlap region 117 and the fourth overlap region 118 makes it possible to prevent the tape cassette 111 from growing in size in proportion to the sizes of those overlap regions. Consequently, thus configured tape cassette 111 can prevent the tape printing apparatus 1 from growing in size, as well.

Accordingly, in the tape cassette 111 directed to the sixth embodiment, after the two-sided adhesive tape 53 is adhered to the printing surface of the film tape 51 by pressure of the tape conveying roller 63 and the tape sub roller 11, the two-sided adhesive tape 53 is conveyed in a state that the separator 53D is peeled off from the two-sided adhesive tape 53 at the exit side edge portion of the tape ejecting port 112. Thereby, time and effort to peel off the separator 53D is made eliminable when the after-printed tape 28 cut in predetermined length is to be pasted on a commercial product etc.

The separator 53D that has been peeled off from the two-sided adhesive tape 53 along the exit side edge portion of the guide wall 112A at the tape ejecting port 112 is allowed to enter the tape cassette 111 through the separator entrance 113 and subsequently guided to a space between the tape conveying roller 63 and the separator guide wall 37, i.e., to the side of the two-sided adhesive spool 56. From there, the separator 53D further travels the outside of the periphery of the wound two-sided adhesive tape 53. By the aid of the convex part 35A, the guide pin 36 and the convex part 35, the separator 53D is guided inwardly at a substantially right angle to reach the separator-take-up spool 62 and taken up into there. Since the separator 53D that has been peeled off from the two-sided adhesive tape 53 at the tape ejecting port 112 can be housed inside the tape cassette 111 smoothly, a user can be relieved from time and effort to discard the separator 53D peeled off from the two-sided adhesive tape 53.

Further, the separator 53D is peeled off from the two-sided adhesive tape 53 that has been adhered to the film tape 51 along the exit side edge portion of the guide wall 112A at the tape ejecting port 112. After that the separator 53D is allowed to enter the separator entrance 113 and subsequently guided to the side of the two-sided-adhesive-tape spool 56 along the peripheral surface of the tape conveying roller 63. Thereby, such configuration surely makes it possible to prevent a situation that the separator 53D bows toward the after-printed tape 28 and again sticks to the adhesive layer 53C of the two-sided adhesive tape 53. Consequently, the after-printed tape 28 can be smoothly ejected outside from the tape ejecting port 112.

Further, the exit side edge portion of the guide wall 112A and that of the guide wall 112B are configured to come out to the downstream of the tape conveying direction in comparison with the side wall 24B so as to closely face the fixed blade 30A. Thereby, distance between a tape cutting position and an end-of-printing position on an after-printed tape 28 can be shortened. Further, margins of the after-printed tape 28 can be shortened.

Since the exit side edge portion of the guide wall 112A and that of the guide 112B are arranged so as to closely face the fixed blade 30A, the surface opposite to the printing surface of the after-printed tape 28 can surely be guided to the tape cutting position, namely, the vicinity of the front edge of the fixed blade 30A.

Further, the separator-take-up spool 62 is arranged between the two-sided adhesive-tape spool 56 and the tape spool 54. Therefore, the greatest dimension of the separator 53D allowing the separator-take-up spool 62 to take up in the course of tape printing by the tape printing apparatus 1 can easily be made large and downsizing of the tape cassette 111 is made feasible, accordingly.

Further, along the peripheral surface of the tape conveying roller 63, the separator 53D that has been allowed to enter the tape cassette 111 through the separator entrance 113 is guided to the space between the tape conveying roller 63 and the separator guide wall 37, i.e., to the side of the two-sided-adhesive-tape spool 56. From there, the separator 53D is further guided to travel the outside of the periphery of the wound two-sided adhesive tape 53 by the aid of the separator guide wall 37, the convex part 35A, the guide pin 36 and the convex part 35B and finally guided to reach the separator-take-up spool 62. Thus, spaces inside the tape cassette 111 can be used effectively and further downsizing of the tape cassette 111 is made feasible, accordingly.

[Seventh Embodiment]

Figure 20:
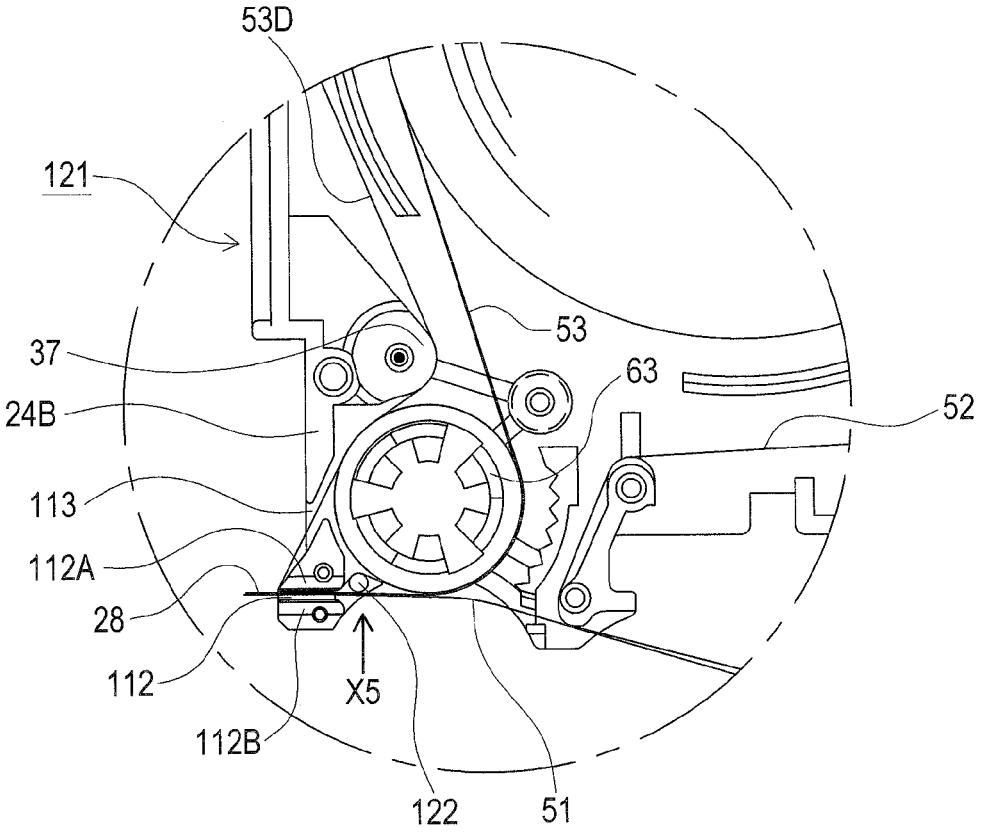
FIG. 20 is a main-part-enlarged view showing an example of a tape cassette directed to a seventh embodiment.
Figure 21:
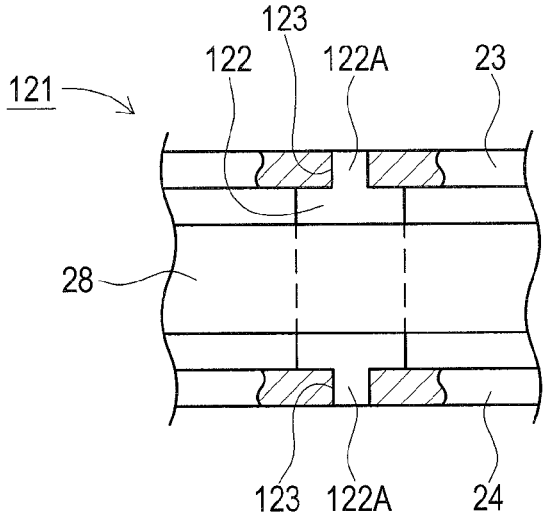
FIG. 21 is an enlarged view seen from a view point indicated with an arrow X5 shown in FIG. 20.

Next, there will be described on a tape cassette 121 directed to a seventh embodiment by referring to FIG. 20 and FIG. 21. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment. Further, there are numerals and signs identical with those assigned to constituent elements of the tape cassette 111 directed to the sixth embodiment illustrated with FIG. 15 through FIG. 19 and those identical numerals and signs are assigned to constituent elements of the present embodiment that are completely or substantially identical with those constituting the tape cassette 111 directed to the sixth embodiment.

The schematic configuration of the tape cassette 121 directed to the seventh embodiment is almost the same as that of the tape cassette 111 directed to the sixth embodiment. However, as shown in FIG. 20 and FIG. 21, an auxiliary separating pin 122, as an example of auxiliary separating member, is arranged between the tape conveying roller 63 and an entrance side edge portion of the tape ejecting port 112 in the path of an after-printed tape 28 with a two-sided adhesive tape 53 being adhered to a printing surface of a film tape 51. The auxiliary separating pin 122 is arranged so as to be inserted between a separator 53D and an adhesive layer 53C of the two-sided adhesive tape 53.

That is, the separator 53D is peeled off from the two-sided adhesive tape 53 by the auxiliary separating pin 122 once. The separator 53D once peeled off from the two-sided adhesive tape 53 by the auxiliary separating pin 122 passes through the auxiliary separating pin 122. After that, the separator 53D is adhered to the adhesive layer 53C of the two-sided adhesive tape 53 again and conveyed into the tape ejecting port 112. Thereafter, the separator 53D is guided to reach the exit side edge portion of the guide wall 112A for the tape ejecting port 112 and peeled off thereat.

The auxiliary separating pin 122 is a substantially cylindrical form of which length is longer than tape width of the two-sided adhesive tape 53 and of which cross section is a circle. Supporting shafts 122A are arranged upright at the centers of both ends of the auxiliary separating pin 122. Further, the peripheral surface of the auxiliary separating pin 122 is coated with a silicon resin film. Further, supporting holes 123 for rotatably supporting the supporting shafts 122A of the auxiliary separating pin 122 are arranged in both the upper case 23 and the lower case 24 of the tape cassette 121. Each supporting shaft 122A of the auxiliary separating pin 122 is rotatably inserted in each supporting hole 123.

Therefore, in the tape cassette 121 directed to the seventh embodiment, the auxiliary separating pin 122 is rotatably supported at both ends thereof and configured to get in contact with the adhesive layer 53C and the separator 53D of the two-sided adhesive tape 53 across the full width thereof.

Thereby, the tape cassette 121 directed to the seventh embodiment brings working effect as below, in addition to the afore-mentioned working effect of the tape cassette 111 directed to the sixth embodiment. Specifically, after peeled off from the two-sided adhesive tape 53 by the auxiliary separating pin 122 once, the separator 53D gets adhered to the adhesive layer 53C of the two-sided adhesive tape 53 again and conveyed to the exit side of the tape ejecting port 112. Thereby, the after-printed tape 28 can be conveyed to the exit side edge portion of the guide wall 112A with adhesibility of the two-sided adhesive tape 53 to the separator 53D being weakened.

Accordingly, it is made easy to peel off the separator 53D from the two-sided adhesive tape 53 that has been adhered to the film tape 51, along the exit side edge portion of the guide wall 112A for the tape ejecting port 112. It is also made possible to allow the peeled-off separator 53D to go into the separator entrance 113 smoothly. Further, it is made possible to smoothly eject the sticky after-printed tape 28 from which the separator 53D has been peeled off, from the exit side edge portion of the tape ejecting port 112.

[Eighth Embodiment]

Figure 22:
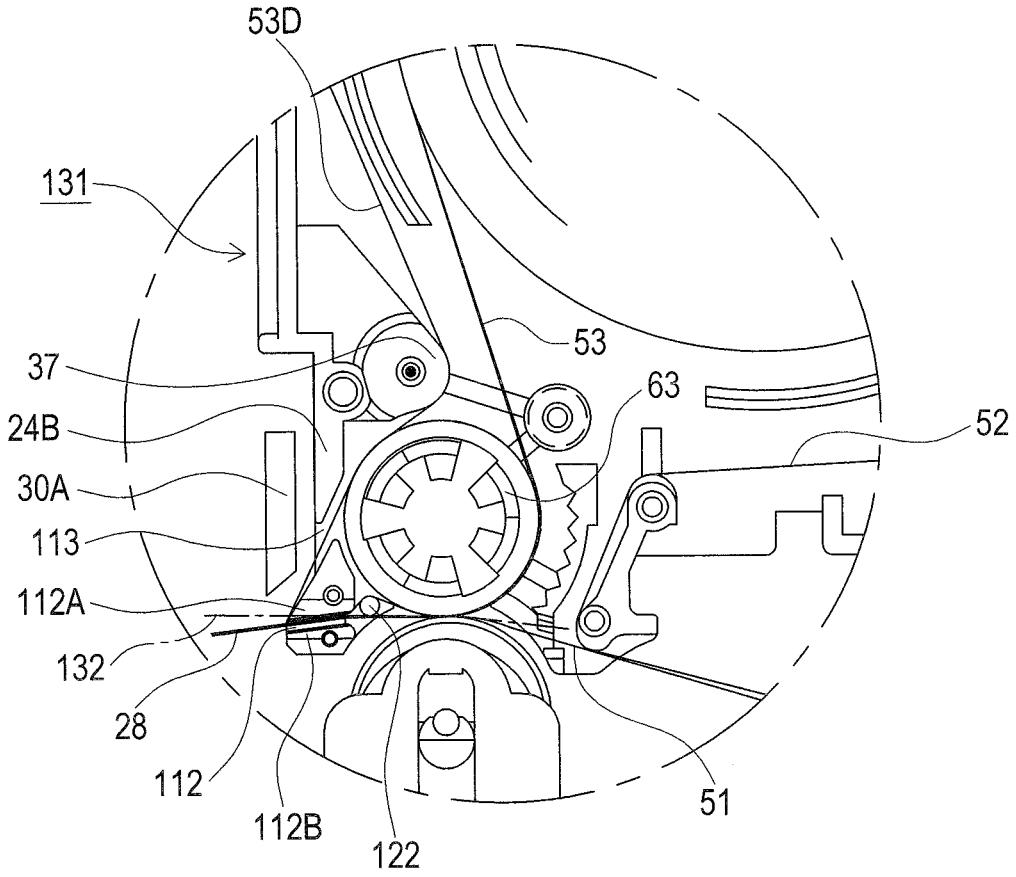
FIG. 22 is a main-part-enlarged view showing an example of a tape cassette directed to an eighth embodiment.

Next, there will be described on a tape cassette 131 directed to an eighth embodiment by referring to FIG. 22. In the following description, there are numerals and signs identical with those assigned to constituent elements of the tape cassette 111 directed to the sixth embodiment illustrated with FIG. 15 through FIG. 19. Those identical numerals and signs are assigned to constituent elements of the present embodiment that are completely or substantially identical with those constituting the tape cassette 111 directed to the sixth embodiment. Further, there are numerals and signs identical with those assigned to constituent elements of the tape cassette 121 directed to the seventh embodiment illustrated with FIG. 20 and FIG. 21 and those identical numerals and signs are assigned to constituent elements of the present embodiment that are completely or substantially identical with those constituting the tape cassette 121 directed to the seventh embodiment.

The schematic configuration of the tape cassette 131 directed to the eighth embodiment is almost the same as that of the tape cassette 121 directed to the seventh embodiment. However, as shown in FIG. 22, the exit side of the tape ejecting port 112 is configured to deviate to the tape sub roller 11 rather than to a common tangent 132 of the tape conveying roller 63 and the tape sub roller 11. Specifically, guide surfaces of the guide walls 112A and 112B both facing the after-printed tape 28 are formed slantwise to the outside.

Accordingly, in the tape cassette 131 directed to the eighth embodiment, the separator 53D once peeled off from the two-sided adhesive tape 53 by the auxiliary separating pin 122 passes through the auxiliary separating pin 122 and thereafter, gets adhered to the adhesive layer 53C of the two-sided adhesive tape 53 and peeled off again along the exit side edge portion of the guide 112A. Further, the after-printed tape 28 in a state that its separator 53D has been peeled off from its two-sided adhesive tape 53 by the auxiliary separating pin 122 reaches the entrance side edge portion of the tape ejecting port 112, passing through the common tangent of the peripheral surface of the auxiliary separating pin 122 and that of the tape conveying roller 63.

After the separator 53D is peeled off along the exit side edge portion of the guide wall 112A, the after-printed tape 28 is ejected outside from the tape ejecting port 112. That is, the after-printed tape 28 with its separator 53D peeled off from the two-sided adhesive tape 53 is ejected outside from the tape ejecting port 112 with inclination to a direction of one surface thereof on which the two-sided adhesive tape 53 is not adhered.

Thereby, the tape cassette 131 directed to the eighth embodiment brings working effect as below, in addition to the afore-mentioned working effect of the tape cassette 121 directed to the seventh embodiment. Specifically, even though the after-printed tape 28 is attracted toward the separator 53D due to its adhesibility when the separator 53D is peeled off from the two-sided adhesive tape 53 at the exit side edge portion of the tape ejecting port 112 along the exit side edge portion of the guide wall 112A, the after-printed tape 28 is allowed to travel deviating to the tape sub roller 11 rather than to the common tangent 132 of the tape conveying roller 63 and the tape sub roller 11. Thereby, it is made possible for the after-printed tape 28 to surely go into a space between the fixed blade 30A and the movable blade 30B.

It is to be noted that the auxiliary separating pin 122 in the tape cassette 131 may be omitted. Thereby, the tape cassette 131 without the auxiliary separating pin 122 brings working effect as below, in addition to the afore-mentioned working effect of the tape cassette 111 directed to the sixth embodiment. Specifically, even though the after-printed tape 28 is attracted toward the separator 53D due to its adhesibility when the separator 53D is peeled off from the two-sided adhesive tape 53 at the exit side edge portion of the tape ejecting port 112 along the exit side edge portion of the guide wall 112A, the after-printed tape 28 is allowed to travel deviating to the tape sub roller 11 rather than to the common tangent 132 of the tape-conveying roller 63 and the tape sub roller 11. Thereby, it is made possible for the after-printed tape 28 to surely go into a space between the fixed blade 30A and the movable blade 30B.

[Ninth Embodiment]

Next, there will be described on a tape cassette 141 directed to a ninth embodiment by referring to FIG. 23 and FIG. 24. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment. Further, there are numerals and signs identical with those assigned to constituent elements of the tape cassette 111 directed to the sixth embodiment illustrated with FIG. 15 through FIG. 19 and those identical numerals and signs are assigned to constituent elements of the present embodiment that are completely or substantially identical with those constituting the tape cassette 111 directed to the sixth embodiment.

The schematic configuration of the tape cassette 141 directed to the ninth embodiment is almost the same as that of the tape cassette 111 directed to the sixth embodiment.

Figure 23:
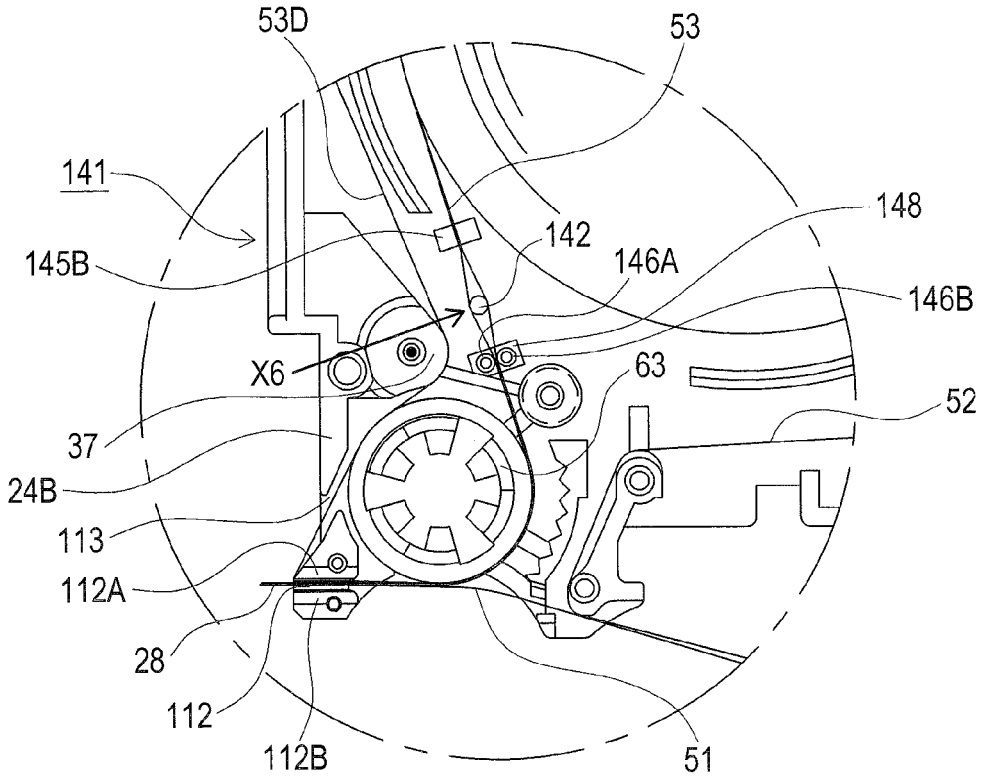
FIG. 23 is a main-part-enlarged view showing an example of a tape cassette directed to a ninth embodiment.
Figure 24:
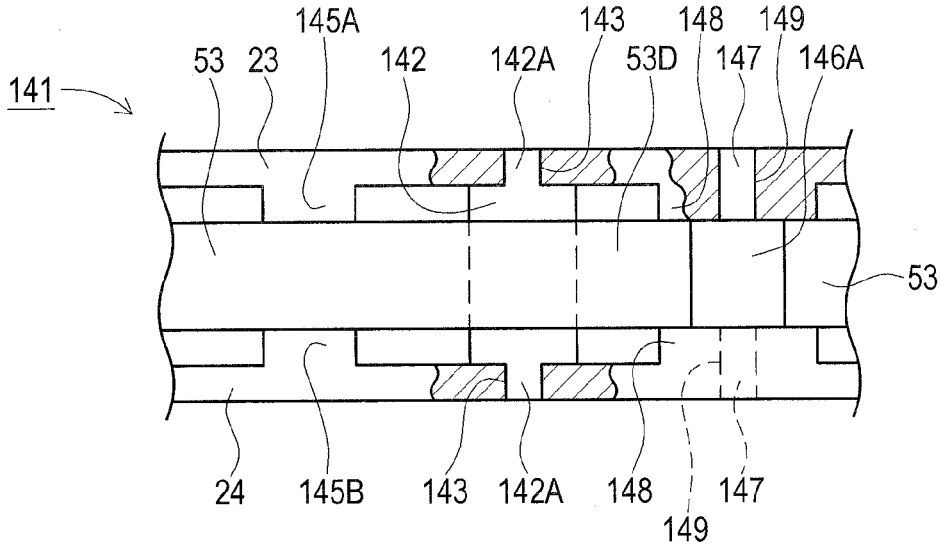
FIG. 24 is an enlarged view seen from a view point indicated with an arrow X6 shown in FIG. 23.

However, as shown in FIG. 23 and FIG. 24, an auxiliary separating pin 142, as an example of auxiliary separating member, is arranged between the two-sided-adhesive-tape spool 56 and the tape conveying roller 63 in the path of a two-sided adhesive tape 53, namely between a pull-out port of the two sided adhesive tape 53 and the tape conveying roller 63. The auxiliary separating pin 142 is arranged so as to be inserted between a separator 53D and an adhesive layer 53C of the two-sided adhesive tape 53.

At the upstream for the auxiliary separating pin 142 with reference to the conveying direction of the two-sided adhesive tape 53, a pair of upstream side guiding members 145A and 145B are arranged so as to protrude from the upper case 23 and the lower case 24 of the tape cassette 141, respectively, and face each other with a distance almost the same as the width of the two-sided adhesive tape 53. Each of the pair of upstream side guiding members 145A and 145B is substantially rectangular shaped when seen from top. Thereby, the pair of upstream side guiding members 145A and 145B make it possible to restrict the two-sided adhesive tape 53 to moving in its width directions and to fluently guide the two-sided adhesive tape 53 to the auxiliary separating pin 142. It is to be noted that arrangement of the pair of upstream side guiding members 145A and 145B is optional.

Further, at the downstream for the auxiliary separating pin 142 with reference to the conveying direction of the two-sided adhesive tape 53, a pair of downstream side rollers 146A and 146B for holding the two-sided adhesive tape 53 are arranged so as to face each other with a distance almost the same as the thickness of the two-sided adhesive tape 53. Through the space between the pair of the downstream side rollers 146A and 146B, there are pulled out the separator 53D once peeled off from the two-sided adhesive tape 53 by the auxiliary separating pin 142 and the two-sided adhesive tape 53 from which the separator 53D is peeled off.

That is, the two-sided adhesive tape 53 pulled out from the two-sided-adhesive-tape spool 56 passes through the space between the pair of upstream side guiding members 145A and 145B that restrict the two-sided adhesive tape 53 to moving in its width directions and further travels to reach the auxiliary separating pin 142. Thereafter, the separator 53D is once peeled off from the two-sided adhesive tape 53 by the auxiliary separating pin 142. The separator 53D once peeled off from the two-sided adhesive tape 53 by the auxiliary separating pin 142 as well as the two-sided adhesive tape 53 from which the separator 53D is peeled off pass through the auxiliary separating pin 142 and further travel to pass through the space between the pair of downstream side rollers 146A and 146B. Thereafter, the separator 53D passing through the space between the pair of downstream side rollers 146A and 146B is adhered to the adhesive layer 53C of the two-sided adhesive tape 53 again and pulled out along the peripheral surface of the tape conveying roller 63.

The auxiliary separating pin 142 is a substantially cylindrical form of which length is longer than tape width of the two-sided adhesive tape 53 and of which cross section is a circle. Supporting shafts 142A are arranged upright at the centers of both ends of the auxiliary separating pin 142. Further, the peripheral surface of the auxiliary separating pin 142 is coated with a silicon resin film. Further, supporting holes 143 for rotatably supporting the supporting shafts 142A of the auxiliary separating pin 142 are arranged in both the upper case 23 and the lower case 24 of the tape cassette 141. Each supporting shaft 142A of the auxiliary separating pin 142 is rotatably inserted in each supporting hole 143.

Each supporting shaft 142A of the auxiliary separating pin 142 is rotatably inserted in each supporting 143, whereby the auxiliary separating pin 142 is rotatably supported at both ends thereof and configured to get in contact with the adhesive layer 53C and the separator 53D of the two-sided adhesive tape 53 across the full width thereof.

Further, each of the pair of downstream side rollers 146A and 146B is a substantially cylindrical form of which length is almost the same as the tape width of the two-sided adhesive tape 53 and of which cross section is a circle. Supporting shafts 147 are arranged upright at the center of both ends with respect to each of the pair of downstream side rollers 146A and 146B. Further, the peripheral surfaces of the pair of downstream side rollers 146A and 146B each are coated with a silicon resin film. Further, stepped portions 148, 148 are arranged in the upper case 23 and the lower case 24 of the tape cassette 141, respectively. The stepped portions 148, 148, rectangular shaped when seen from top, are configured to protrude from the upper case 23 and the lower case 24, respectively, in contact with longitudinal two edges of the two-sided adhesive tape 53 so as to restrict to moving in width direction of the two-sided adhesive tape 53 and guide the two-sided adhesive tape 53 in its conveying direction fluently.

Further, a pair of supporting holes 149 are formed in their respective stepped portions 148, 148 so as to rotatably support the supporting shafts 147 of the pair of downstream side rollers 146A and 146B. Further, the supporting shafts 147 of the pair of downstream side rollers 146A and 146B are inserted in their respective supporting holes 149 and rotatably supported thereat. In addition, the pair of downstream side rollers 146A and 146B are arranged so as to face each other with a distance almost the same as the thickness of the two-sided adhesive tape 53. Out of the downstream side rollers 146A and 146B, at least the downstream side roller 146B may be configured to have a peripheral surface coated with a silicon resin film, as the downstream side roller 146B gets in contact with the adhesive layer 53A of the two-sided adhesive tape 53.

Accordingly, in the tape cassette 141 directed to the ninth embodiment, the two-sided adhesive tape 53 pulled out from the two-sided-adhesive-tape spool 56 passes through the space between the pair of upstream side guiding members 145A and 145B that restrict the two-sided adhesive tape 53 to moving in its width directions and further travels to reach the auxiliary separating pin 142. Thereafter, the separator 53D is once peeled off from the two-sided adhesive tape 53 by the auxiliary separating pin 142 of which end portions are rotatably supported. After that, the separator 53D as well as the two-sided adhesive tape 53 from which the separator 53 is peeled off travel to pass through the space between the stepped portions 148, 148 and the space between the pair of downstream side rollers 146A and 146B. Thereafter, the separator 53D gets adhered to the adhesive layer 53C of the two-sided adhesive tape 53 again and pulled out along the peripheral surface of the tape conveying roller 63.

Thereby, the tape cassette 141 directed to the ninth embodiment brings working effect as below, in addition to the aforementioned working effect of the tape cassette 111 directed to the sixth embodiment. Specifically, after peeled off from the two-sided adhesive tape 53 by the auxiliary separating pin 142 once, the separator 53D gets adhered to the adhesive layer 53C of the two-sided adhesive tape 53 again and conveyed to the tape conveying roller 63. Thereby, the two-sided adhesive tape 53 can get adhered to the printing surface of the film tape 51 by pressure with adhesibility of the two-sided adhesive tape 53 to the separator 53D being weakened.

Accordingly, it is made easy to peel off the separator 53D from the two-sided adhesive tape 53 that has been adhered to the film tape 51, along the exit side edge portion of the guide wall 112A for the tape ejecting port 112. It is also made possible to allow the peeled-off separator 53D to go into the separator entrance 113 smoothly. Further, it is made possible to smoothly eject the sticky after-printed tape 28 from which the separator 53D has been peeled off, from the exit side edge portion of the tape ejecting port 112.

[Tenth Embodiment]

Figure 25:
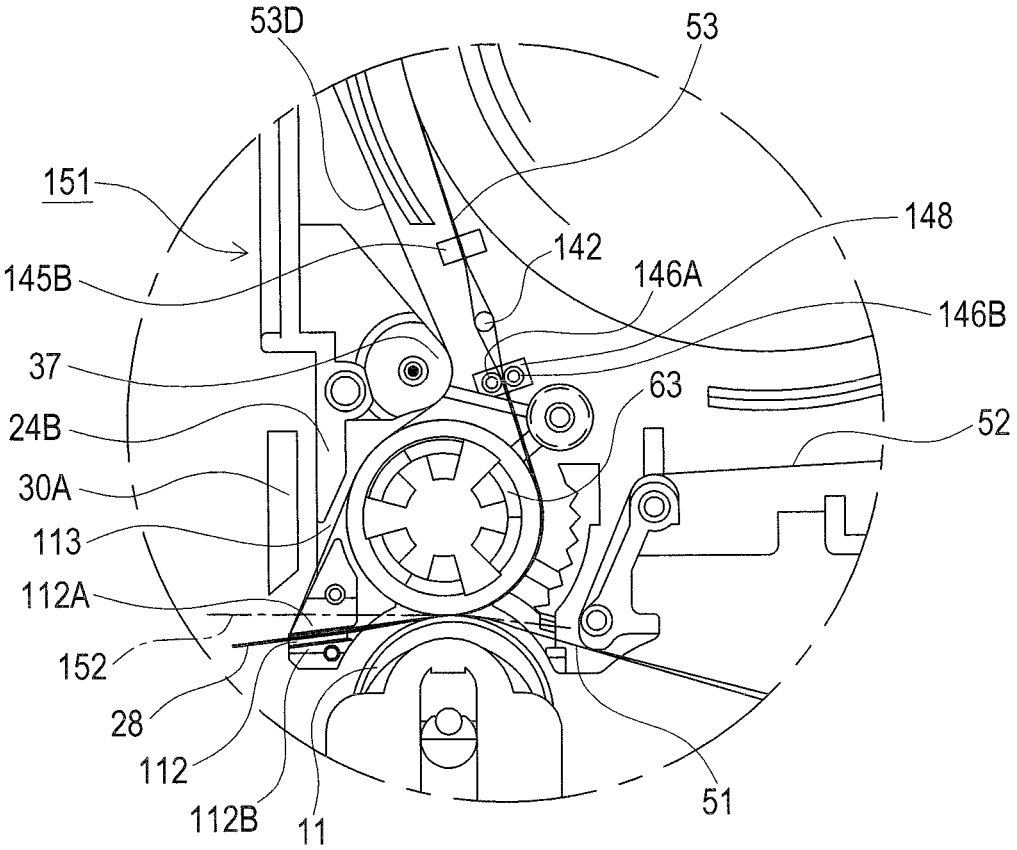
FIG. 25 is a main-part-enlarged view showing an example of a tape cassette directed to a tenth embodiment.

Next, there will be described on a tape cassette 151 directed to a tenth embodiment by referring to FIG. 25. In the following description, there are numerals and signs identical with those assigned to constituent elements of the tape cassette 111 directed to the sixth embodiment illustrated with FIG. 15 through FIG. 19. Those identical numerals and signs are assigned to constituent elements of the present embodiment that are completely or substantially identical with those constituting the tape cassette 111 etc. directed to the sixth embodiment. Further, there are numerals and signs identical with those assigned to constituent elements of the tape cassette 141 directed to the ninth embodiment illustrated with FIG. 23 through FIG. 24 and those identical numerals and signs are assigned to constituent elements of the present embodiment that are completely or substantially identical with those constituting the tape cassette 141 directed to the ninth embodiment.

The schematic configuration of the tape cassette 151 directed to the tenth embodiment is almost the same as that of the tape cassette 141 directed to the ninth embodiment. However, as shown in FIG. 25, the exit side of the tape ejecting port 112 is formed so as to deviate to the tape sub roller 11 rather than to a common tangent 152 of the tape conveying roller 63 and the tape sub roller 11. Specifically, guide surfaces of the guide walls 112A and 112B both facing the after-printed tape 28 are formed slantwise to the outside with reference to the common tangent 152.

Accordingly, in the tape cassette 151 directed to the tenth embodiment, the two-sided adhesive tape 53 pulled out from the two-sided-adhesive-tape spool 56 passes through the space between the pair of upstream side guiding members 145A and 145B that restrict the two-sided adhesive tape 53 to moving in its width directions and further travels to reach the auxiliary separating pin 142. Thereafter, the separator 53D is once peeled off from the two-sided adhesive tape 53 by the auxiliary separating pin 142 of which end portions are rotatably supported. After that, the separator 53D as well as the two-sided adhesive tape 53 from which the separator 53 is peeled off travel to pass through the space between the stepped portions 148, 148 and the space between the pair of downstream side rollers 146A and 146B. Thereafter, the separator 53D gets adhered to the adhesive layer 53C of the two-sided adhesive tape 53 again and pulled out along the peripheral surface of the tape conveying roller 63.

After that, the after-printed tape 28 in a state that the two-sided adhesive tape 53 has been adhered to the film tape 51 travels to reach the entrance side edge portion of the tape ejecting port 112. After the separator 53D is peeled off along the exit side edge portion of the guide wall 112A for the tape ejecting port 112, the after-printed tape 28 is ejected outside from the tape ejecting port 112. That is, the after-printed tape 28 with its separator 53D peeled off from the two-sided adhesive tape 53 is ejected outside from the tape ejecting port 112 with inclination to a direction of one surface thereof on which the two-sided adhesive tape 53 is not adhered.

Thereby, the tape cassette 151 directed to the tenth embodiment brings working effect as below, in addition to the aforementioned working effect of the tape cassette 141 directed to the ninth embodiment. Specifically, even though the after-printed tape 28 is attracted toward the separator 53D due to its adhesibility when the separator 53D is peeled off from the two-sided adhesive tape 53 at the exit side edge portion of the tape ejecting port 112 along the exit side edge portion of the guide wall 112A, the after-printed tape 28 is allowed to travel deviating to the tape sub roller 11 rather than to the common tangent 152 of the tape conveying roller 63 and the tape sub roller 11. Thereby, it is made possible for the after-printed tape 28 to surely go into a space between the fixed blade 30A and the movable blade 30B.

[Eleventh Embodiment]

Next, there will be described on a tape cassette 161 directed to an eleventh embodiment by referring to FIG. 26 through FIG. 32. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1, etc. directed to the first embodiment.

Figure 26:
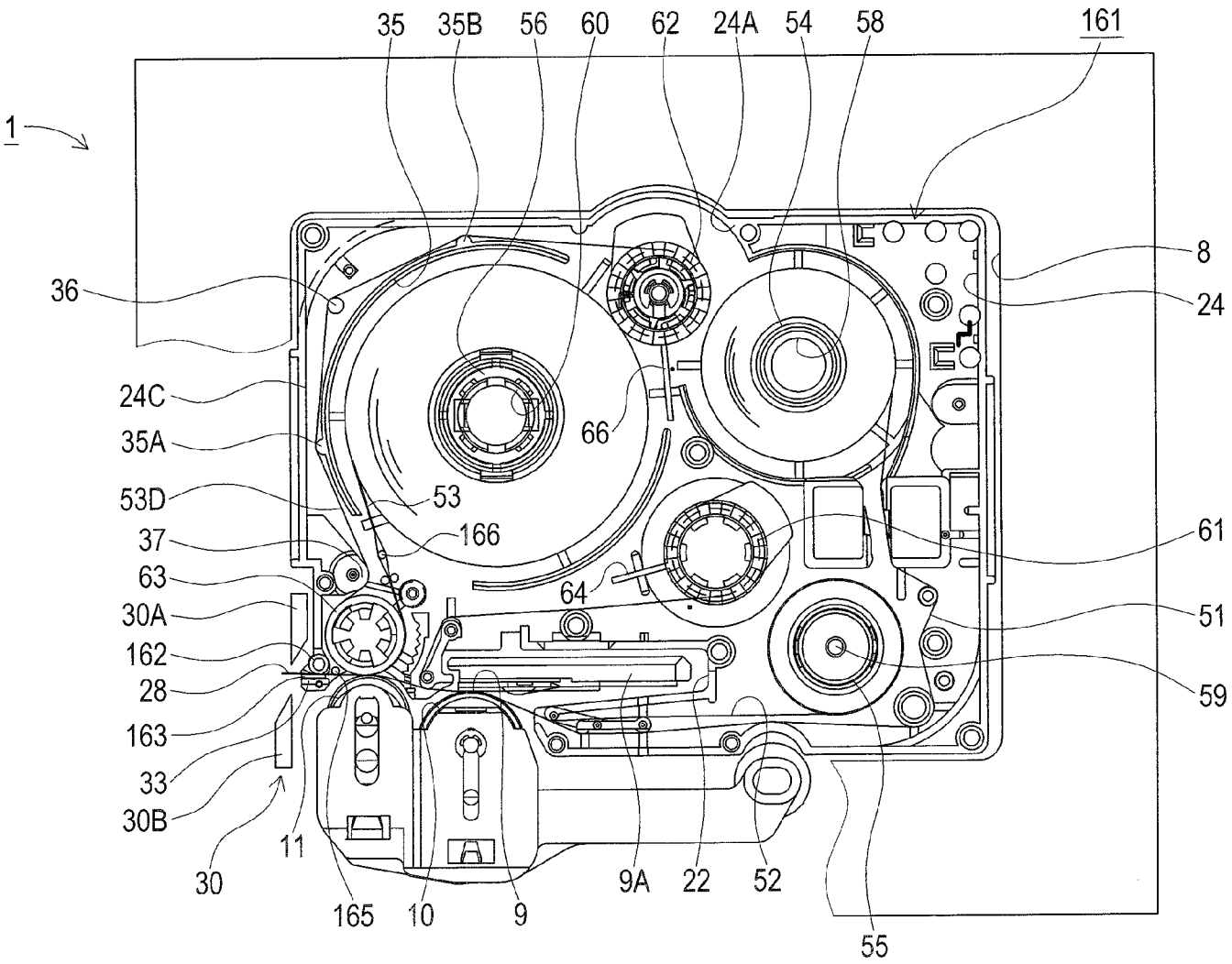
FIG. 26 is a main-part-enlarged plain view that can be seen in case an upper case of a tape cassette directed to an eleventh embodiment is removed while the tape cassette is placed in a cassette housing portion of a tape printing apparatus.
Figure 27:
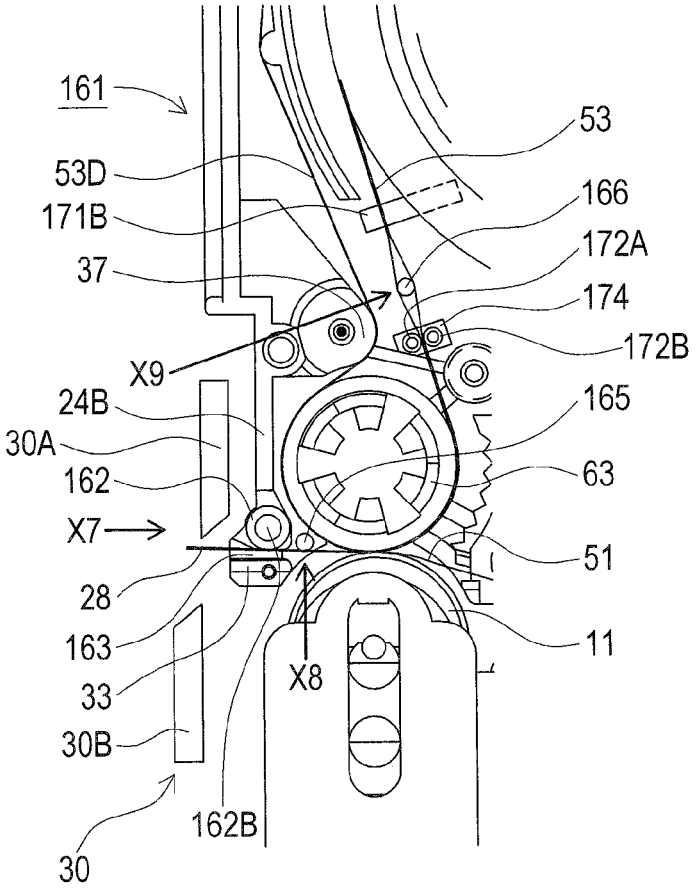
FIG. 27 is a main-part-enlarged view of surroundings of a tape ejecting port shown in FIG. 26.
Figure 28:
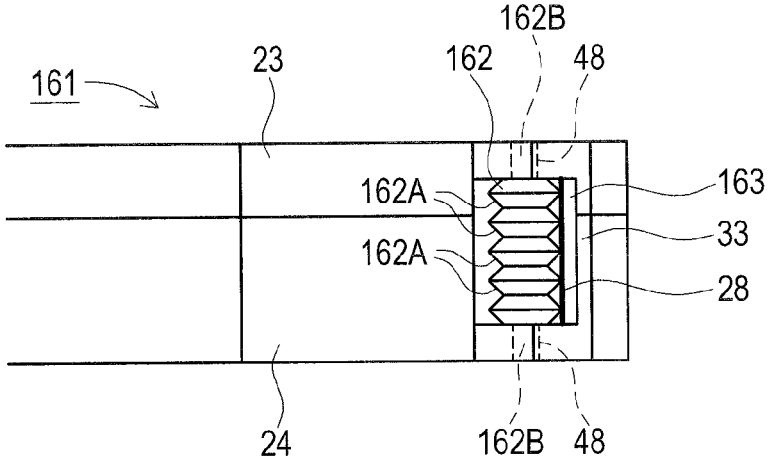
FIG. 28 is a view of the tape ejecting port seen from a view point indicated with an arrow X7 shown in FIG. 27.

The schematic configuration of the tape cassette 161 directed to the eleventh embodiment is almost the same as that of the tape cassette 21 directed to the first embodiment. However, as shown in FIG. 26 through FIG. 28, instead of the separating roller 65, the tape cassette 161 includes a contact roller 162 that is rotatably arranged at the downstream for tape conveying direction of the tape conveying roller 63, i.e., at the side of the tape ejecting port 163. Further, the side wall 24B faces the tape conveying roller 63 and includes an edge portion that faces the contact roller 162. The edge portion is configured to be away from the peripheral surface of the contact roller 162 by predetermined distance (e.g., 1 mm).

Further, as will be described later, the separator 53D is peeled off from the two-sided adhesive tape 53 pressed and adhered to the film tape 51 and guided to the two-sided-adhesive-tape spool 56 along the peripheral surface of the tape conveying roller 63 (refer to FIG. 31), i.e., toward the pull-out direction (upward direction in FIG. 26). As shown in FIG. 27 and FIG. 28, the peripheral surface of the contact roller 162 is formed of grooves 162A that are continuous in the axial direction thereof. Each of the grooves 162A is a V-shaped groove in cross section along the axial direction and both ends of the contact roller 162 are chamfered slantwise toward the axis thereof. That is, the peripheral surface of the contact roller 162 consists of plural convexes formed in parallel with the axial direction wherein each of the convexes is substantially triangular shaped in cross section along the axial direction.

Further, supporting shafts 162B are arranged upright on centers of both side ends of the contact roller 162 and rotatably fitted in their respective supporting holes 48. Further, the contact roller 162 is formed so as to have a silicon resin film on its peripheral surface. The contact roller 162 guides the after-printed tape 28 from the tape ejecting port 163 to the downstream of the tape conveying direction while getting in contact with the adhesive layer 53C of the after-printed tape 28 from which the separator 53D has been peeled off (refer to FIG. 31).

Further, the contact roller 162 comes out in the tape conveying direction in comparison with the side wall 24B that faces the tape conveying roller 63. At the same time, the contact roller 162 is arranged so as to closely face the fixed blade 30A. Further, the guide wall 33 faces the separating roller 65 over an after-printed tape 28 inserted therebetween, and extends at downstream side of the tape conveying direction in comparison with the contact roller 162. Thereby, the after-printed tape 28 can be guided to a position near the fixed blade 30A.

Figure 29:
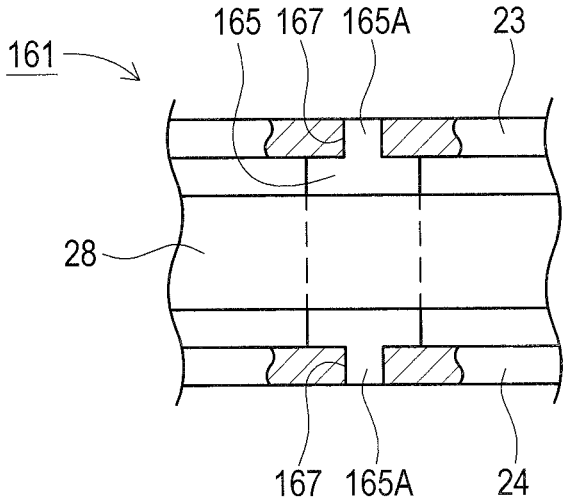
FIG. 29 is an enlarged view seen from a view point indicated with an arrow X8 shown in FIG. 27.

Further, as shown in FIG. 27 and FIG. 29, a separating pin 165, as an example of separating member, is arranged at the downstream side of the tape conveying direction near a position to peel off the separator 53D from the two-sided adhesive tape 53 that has been pressed and adhered to the film tape 51 by the tape conveying roller 63 and the tape sub roller 11. That is, the separating pin 165 is arranged so as to be inserted between a separator 53D and an adhesive layer 53C of the after-printed tape 28.

The separating pin 165 is a substantially cylindrical form of which length is longer than tape width of the after-printed tape 28 and of which cross section is a circle. Supporting shafts 165A are arranged upright at the centers of both ends of the separating pin 165. Further, the peripheral surface of the separating pin 165 is coated with a silicon resin film. Further, supporting holes 167 for rotatably supporting the supporting shafts 165A of the separating pin 165 are arranged in both the upper case 23 and the lower case 24 of the tape cassette 161.

Each supporting shaft 165A of the separating pin 165 is rotatably inserted in each supporting hole 167. Therefore, the separating pin 165 is rotatably supported at both ends thereof and configured to get in contact with the adhesive layer 53C and the separator 53D of the two-sided adhesive tape 53 across the full width thereof.

Figure 30:
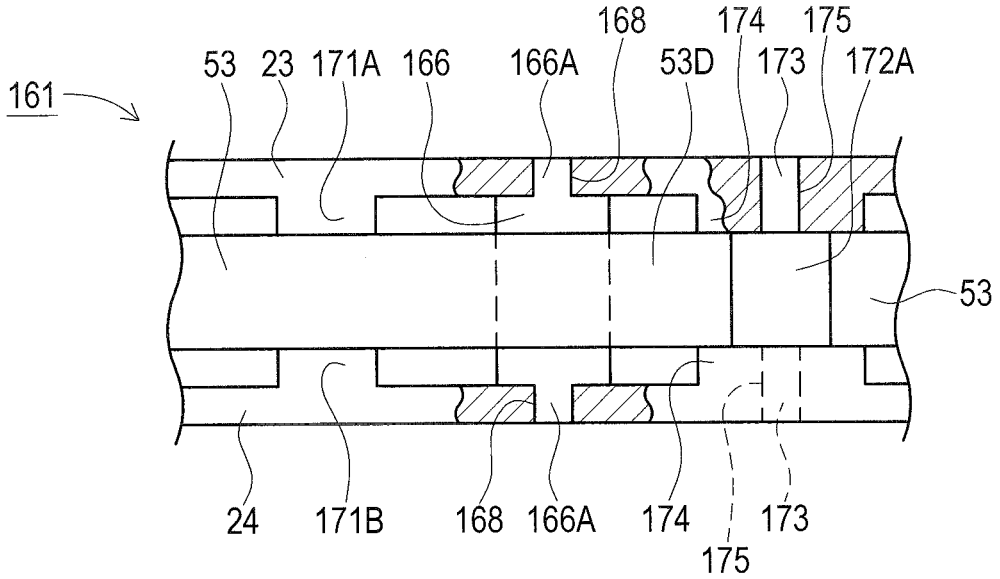
FIG. 30 is an enlarged view seen from a view point indicated with an arrow X9 shown in FIG. 27.
Figure 31:
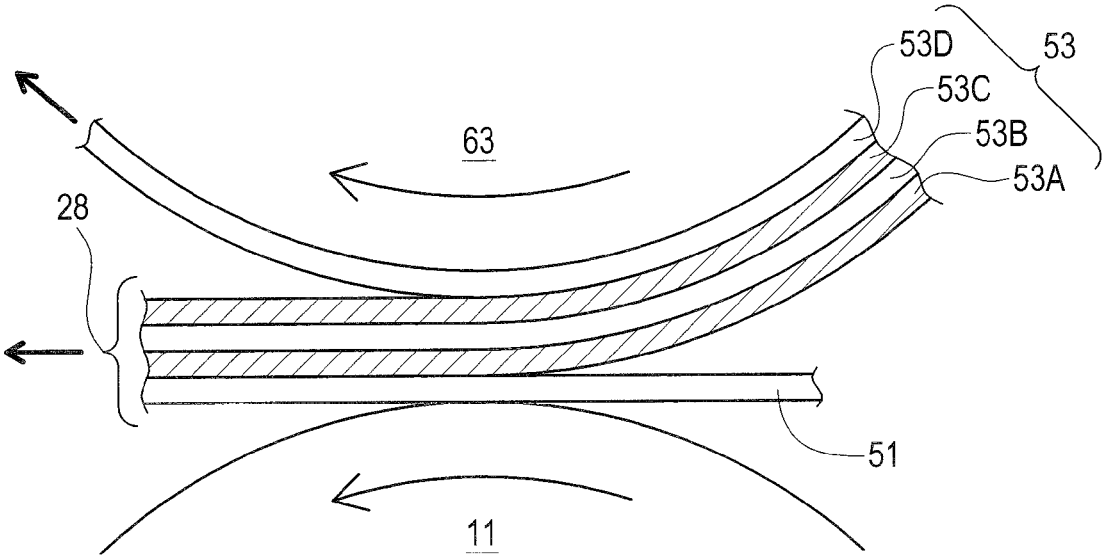
FIG. 31 is a view for exemplarily illustrating a state that a separator is peeled off after a two-sided adhesive tape is adhered to a film tape with pressure.

Further, as shown in FIG. 27 and FIG. 30, an auxiliary separating pin 166, as an example of auxiliary separating member, is arranged between the two-sided-adhesive-tape spool 56 and the tape conveying roller 63 in the path of a two-sided adhesive tape 53, namely between a pull-out port of the two sided adhesive tape 53 and the tape conveying roller 63. The auxiliary separating pin 166 is arranged so as to be inserted between a separator 53D and an adhesive layer 53C of the two-sided adhesive tape 53.

Further, at the upstream for the auxiliary separating pin 166 with reference to the conveying direction of the two-sided adhesive tape 53, a pair of upstream side guiding members 171A and 171B are arranged so as to protrude from the upper case 23 and the lower case 24 of the tape cassette 161, respectively, and face each other with a distance almost the same as the width of the two-sided adhesive tape 53. Each of the pair of upstream side guiding members 171A and 171B is substantially rectangular shaped when seen from top. Thereby, the pair of upstream side guiding members 171A and 171B make it possible to restrict the two-sided adhesive tape 53 to moving in its width directions and to fluently guide the two-sided adhesive tape 53 to the auxiliary separating pin 166. It is to be noted that arrangement of the pair of upstream side guiding members 171A and 171B is optional.

Further, at the downstream for the auxiliary separating pin 166 with reference to the conveying direction of the two-sided adhesive tape 53, a pair of downstream side rollers 172A and 172B for holding the two-sided adhesive tape 53 are arranged so as to face each other with a distance almost the same as the thickness of the two-sided adhesive tape 53. Through the space between the pair of the downstream side rollers 172A and 172B, there are pulled out the separator 53D once peeled off from the two-sided adhesive tape 53 by the auxiliary separating pin 166 and the two-sided adhesive tape 53 from which the separator 53D is peeled off.

That is, the two-sided adhesive tape 53 pulled out from the two-sided-adhesive-tape spool 56 passes through the space between the pair of upstream side guiding members 171A and 171B that restrict the two-sided adhesive tape 53 to moving in its width directions and further travels to reach the auxiliary separating pin 166. Thereafter, the separator 53D is once peeled off from the two-sided adhesive tape 53 by the auxiliary separating pin 166. The separator 53D once peeled off from the two-sided adhesive tape 53 by the auxiliary separating pin 166 as well as the two-sided adhesive tape 53 from which the separator 53D is peeled off pass through the auxiliary separating pin 166 and further travel to pass through the space between the pair of downstream side rollers 172A and 172B. Thereafter, the separator 53D passing through the space between the pair of downstream side rollers 172A and 172B is adhered to the adhesive layer 53C of the two-sided adhesive tape 53 again and pulled out along the peripheral surface of the tape conveying roller 63.

The auxiliary separating pin 166 is a substantially cylindrical form of which length is longer than tape width of the two-sided adhesive tape 53 and of which cross section is a circle. Supporting shafts 166A are arranged upright at the centers of both ends of the auxiliary separating pin 166. Further, the peripheral surface of the auxiliary separating pin 166 is coated with a silicon resin film. Further, supporting holes 168 for rotatably supporting the supporting shafts 166A of the auxiliary separating pin 166 are arranged in both the upper case 23 and the lower case 24 of the tape cassette 161.

Each supporting shaft 166A of the auxiliary separating pin 166 is rotatably inserted in each supporting hole 168, whereby the auxiliary separating pin 166 is rotatably supported at both ends thereof and configured to get in contact with the adhesive layer 53C and the separator 53D of the two-sided adhesive tape 53 across the full width thereof.

Further, each of the pair of downstream side rollers 172A and 172B is a substantially cylindrical form of which length is almost the same as the tape width of the two-sided adhesive tape 53 and of which cross section is a circle. Supporting shafts 173 are arranged upright at the center of both ends with respect to each of the pair of downstream side rollers 172A and 172B. Further, the peripheral surfaces of the pair of downstream side rollers 172A and 172B each are coated with a silicon resin film. Further, stepped portions 174, 174 are arranged in the upper case 23 and the lower case 24 of the tape cassette 161, respectively. The stepped portions 174, 174, rectangular shaped when seen from top, are configured to protrude from the upper case 23 and the lower case 24, respectively, in contact with longitudinal two edges of the two-sided adhesive tape 53 so as to restrict to moving in width direction of the two-sided adhesive tape 53 and guide the two-sided adhesive tape 53 in its conveying direction fluently.

Further, a pair of supporting holes 175 are formed in their respective stepped portions 174, 174 so as to rotatably support the supporting shafts 173 of the pair of downstream side rollers 172A and 172B. Further, the supporting shafts 173 of the pair of downstream side rollers 172A and 172B are inserted in their respective supporting holes 175 and rotatably supported thereat. In addition, the pair of downstream side rollers 172A and 172B are arranged so as to face each other taking a distance almost the same as the thickness of the two-sided adhesive tape 53. Out of the downstream side rollers 172A and 172B, at least the downstream side roller 172B may be configured to have a peripheral surface coated with a silicon resin film, as the downstream side roller 172B gets in contact with the adhesive layer 53A of the two-sided adhesive tape 53.

As shown in FIG. 26 through FIG. 31, in the thus configured tape cassette 161, the two-sided adhesive tape 53 pulled out from the two-sided-adhesive-tape spool 56 passes through the space between the pair of upstream side guiding members 171A and 171B that restrict the two-sided adhesive tape 53 to moving in its width directions and further travels to reach the auxiliary separating pin 166. Thereafter, the separator 53D is once peeled off from the two-sided adhesive tape 53 by the auxiliary separating pin 166 of which end portions are rotatably supported. After that, the separator 53D as well as the two-sided adhesive tape 53 from which the separator 53 is peeled off travel to pass through the space between the stepped portions 174, 174 and the space between the pair of downstream side rollers 172A and 172B. Thereafter, the separator 53D gets adhered to the adhesive layer 53C of the two-sided adhesive tape 53 again and pulled out along the peripheral surface of the tape conveying roller 63. Thereafter, the two-sided adhesive tape 53 further travels to pass through the path between the tape conveying roller 63 driven by the tape-driving-roller shaft 14 for rotation and the tape sub roller 11. Thereafter, the adhesive layer 53A on which the separator 53D is not overlaid is pressed against a printing surface of the film tape 51.

After that, the separator 53D is peeled off from the two-sided adhesive tape 53 pressed and adhered to the film tape 51 and from there, further guided toward the two-sided adhesive spool 56 along the peripheral surface of the tape conveying roller 63, i.e., the pull-out direction (upward direction in FIG. 26). After that, the separator 53D is further guided to reach the external of the guide rib 35 along a wall surface of the separator guide wall 37. From there, the separator 53D further travels the outside of the periphery of the wound two-sided adhesive tape 53 passing through peripheral surfaces of the convex part 35A, the guide pin 36 and the convex part 35B. The separator 53D finally reaches the separator-take-up spool 62 inwardly at a substantially right angle.

Thereafter, the front end of the separator 53D is fixedly adhered to the peripheral surface of the separator-take-up spool 62 by an adhesive tape or the like and taken up into the separator-take-up spool 62 that is driven by the separator-take-up shaft 16 for rotation. It is to be noted that the separator-take-up shaft 16 is driven for rotation in synchronous with rotation of the tape-driving-roller shaft 14 and the ribbon-take-up shaft 15.

After passing through the path between the tape conveying roller 63 driven by the tape-driving-roller shaft 14 for rotation and the tape sub roller 11, the film tape 51 reaches the contact roller 162 in a state that the adhesive layer 53A, the base film 53B, and the adhesive layer 53C are overlaid on the printing surface thereof. Thereafter, the film tape 51 placed in a state that the adhesive layer 53A, the base film 53B and the adhesive layer 53C are overlaid on the printing surface thereof, i.e., a sticky after-printed tape 28 from which its separator 53D has been peeled, is guided along the guide wall 33 that faces the contact roller 162 over the after-printed tape 28 inserted therebetween and conveyed to the outside of the tape cassette 161 through the tape ejecting port 163. After that, through the cutter unit 30, the sticky after-printed tape 28 from which the separator 53D has been peeled off is conveyed outside from the label ejecting port 17 of the tape printing apparatus 1.

The after-printed tape 28 is conveyed by predetermined length and a not-shown cutting motor is driven for operating the movable blade 30B. Consequently, from the label ejecting port 17, there is ejected the predetermined length of the sticky after-printed tape 28 from which the separator 53D has been peeled off.

Next, there will be described on positioning relation with respect to the tape spool 54, the two-sided-adhesive-tape spool 56 and the separator-take-up spool 62 of the tape cassette 161 by referring to FIG. 32.

As is already described, in the tape cassette 161, the film tape 51 wound around the tape spool 54 is pulled out from there every time the tape printing apparatus 1 carries out printing. Accordingly, when the tape cassette 161 is used for the first time, the film tape 51 is wound around the tape spool 54 with its greatest dimension (refer to FIG. 26). It is to be noted that a region occupied by the film tape 51 that is wound around the tape spool 54 with its greatest dimension when the tape cassette 21 is used for the first time is referred to as "film tape occupying region 177". Further, the radius of the film tape occupying region 177 is referred to as "wound film tape radius R7".

Further, in similar with the film tape 51, the two-sided adhesive tape 53 wound around the two-sided-adhesive-tape spool 56 is pulled out from there every time the tape printing apparatus 1 carries out printing. Accordingly, when the tape cassette 161 is used for the first time, the two-sided adhesive tape 53 is wound around the two-sided-adhesive-tape spool 56 with its greatest dimension (refer to FIG. 26). It is to be noted that a region occupied by the two-sided adhesive tape 53 that is wound around the two-sided-adhesive-tape spool 56 with its greatest dimension when the tape cassette 161 is used for the first time is referred to as "two-sided adhesive tape occupying region 178". Further, the radius of the two-sided adhesive tape occupying region 178 is referred to as "wound two-sided adhesive tape radius R8".

In the tape cassette 161, the separator 53D is peeled off from the two-sided adhesive tape 53 and taken up into the separator-take-up spool 62 every time the tape printing apparatus 1 carries out printing. Accordingly, when the tape cassette 161 is used up (i.e., when the film tape 51 etc. in the tape cassette 161 are used up for creating labels), the separator 53D is thoroughly wound around the separator-take-up spool 62 with its greatest dimension so as to occupy the greatest space inside the tape cassette 161. In the following description, the radius of the greatest space occupied by the separator 53D thoroughly wound around the separator-take-up spool 62 is referred to as "wound separator radius R9".

As described in the above, the separator-take-up spool 62 is rotatably arranged between the tape spool 54 and the two-sided-adhesive-tape spool 56. Further, as shown in FIG. 32, the tape cassette 161 is configured so that straight line distance between rotational central axis of the tape spool 54 and that of the separator-take-up spool 62 (termed as fifth axial distance L5, hereinafter) is smaller than a sum of the wound separator radius R9 and the wound film tape radius R7. Accordingly, when the tape cassette 161 is used up, the separator 53D thoroughly wound around the separator-take-up spool 62 occupies a part of the film tape occupying region 177.

That is, since the fifth axial distance L5 is made smaller than the sum of the wound separator radius R9 and the wound film tape radius R7, there arises a fifth overlap region 179 to be shared by the film tape 51 and the separator 53D. The preparation of the fifth overlap region 179 makes it possible to prevent the tape cassette 161 from growing in size in proportion to the size of the fifth overlap region 179. Further, by preventing the tape cassette 161 from growing in size, the tape cassette 161 can prevent the main body of the tape printing apparatus 1 from growing in size, as well.

Further, the tape cassette 161 is configured so that straight line distance between rotational central axis of the two-sided-adhesive-tape spool 56 and that of the separator-take-up spool 62 (termed as sixth axial distance L6) is smaller than a sum of the wound separator radius R9 and the wound two-sided adhesive tape radius R8. Accordingly, when the tape cassette 161 is used up, the separator 53D thoroughly wound around the separator-take-up spool 62 occupies a part of the two-sided adhesive tape occupying region 178.

That is, since the sixth axial distance L6 is made smaller than the sum of the wound separator radius R9 and the wound two-sided adhesive tape radius R8, there arises a sixth overlap region 180 to be shared by the two-sided adhesive tape 53 and the separator 53D. The preparation of the sixth overlap region 180 makes it possible to prevent the tape cassette 161 from growing in size in proportion to the size of the sixth overlap region 180. Further, by preventing the tape cassette 161 from growing in size, the tape cassette 161 can prevent the main body of the tape printing apparatus 1 from growing in size, as well.

Figure 32:
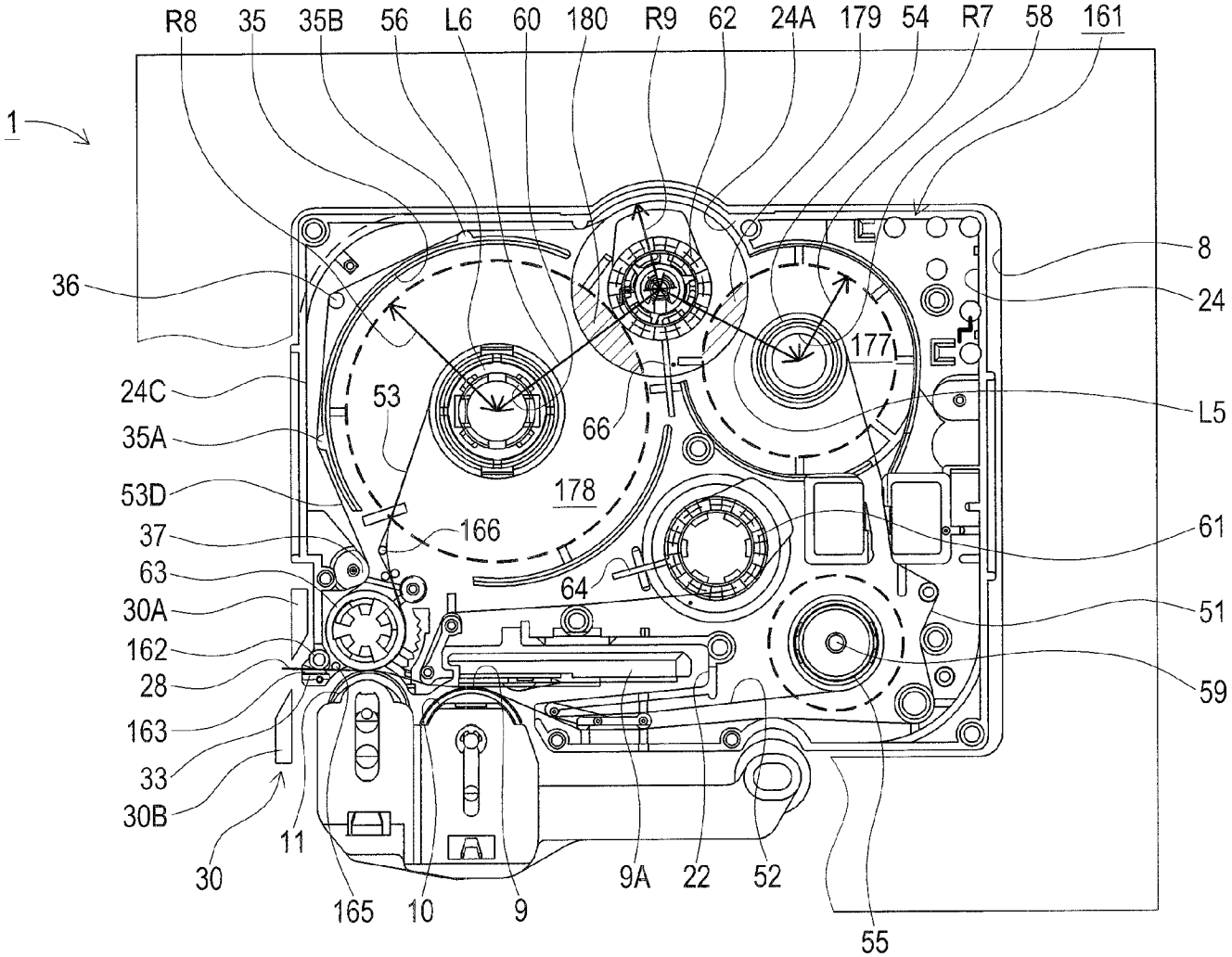
FIG. 32 is a view for illustrating positioning relation of a tape spool, a two-sided-adhesive-tape spool and a separator-take-up spool inside the tape cassette directed to the eleventh embodiment.

Accordingly, as shown in FIG. 32, since the tape cassette 161 allows both the fifth overlap region 179 and the sixth overlap region 180 to arise, the preparation of the fifth overlap region 179 and the sixth overlap region 180 makes it possible to prevent the tape cassette 161 from growing in size in proportion to the sizes of those overlap regions. Consequently, thus configured tape cassette 161 can prevent the tape printing apparatus 1 from growing in size, as well.

It is to be noted that, by making the distance between the tape spool 54 and the two-sided adhesive tape spool 56 larger than as shown in FIG. 32, the location of the separator-take-up spool 62 may be shifted inwardly inside the tape cassette 161. Further, the fifth axial distance L5 may be made larger than a sum of the wound separator radius R9 and the wound film tape radius R7 and the sixth axial distance L6 may be made smaller than a sum of the wound separator radius R9 and the wound two-sided adhesive tape radius R8. Vice versa, the fifth axial distance L5 may be made smaller than a sum of the wound separator radius R9 and the wound film tape radius R7 and the sixth axial distance L6 may be made larger than a sum of the wound separator radius R9 and the wound two-sided adhesive tape radius R8.

Thereby, since the tape cassette 161 allows either the fifth overlap region 179 or the sixth overlap region 180 to arise, the preparation of either one the fifth overlap region 179 and the sixth overlap region 180 makes it possible to prevent the tape cassette 161 from growing in size in proportion to the sizes of those overlap regions. Consequently, thus configured tape cassette 161 can prevent the tape printing apparatus 1 from growing in size, as well.

Accordingly, in the tape cassette 161 directed to the eleventh embodiment, after the two-sided adhesive tape 53 is adhered to the printing surface of the film tape 51 by pressure of the tape conveying roller 63 and the tape sub roller 11, the after-printed tape 28 is conveyed in a state that the separator 53D is peeled off therefrom. Thereby, time and effort to peel off the separator 53D is made eliminable when the after-printed tape 28 cut in predetermined length is to be pasted on a commercial product etc.

The separator 53D is guided to the separator guide wall 37 along the peripheral surface of the tape conveying roller 63 and, from there. From there, the separator 53D further travels the outside of the periphery of the wound two-sided adhesive tape 53. By the aid of the convex part 35A, the guide pin 36 and the convex part 35, the separator 53D is guided inwardly at a substantially right angle to reach the separator-take-up spool 62 and taken up into there. Since the peeled-off separator 53D can be housed inside the tape cassette 161, a user can be relieved from time and effort to discard the separator 53D peeled off from the two-sided adhesive tape 53.

Further, the after-printed tape 28 placed in a state that the two-sided adhesive tape 53 is adhered thereto and the separator 53D peeled off therefrom is held by the contact roller 162 and the guide wall 33 and conveyed, the contact roller 162 getting in contact with the adhesive layer 53C of the tow-sided adhesive tape 53 from which the separator 53D has been peeled off. Therefore, such configuration surely prevents a situation that the after-printed tape 28 bows toward the separator 53D and gets jammed at the tape ejecting port 163. Consequently, the after-printed tape 28 can be smoothly ejected outside from the tape ejecting port 163.

Further, the contact roller 162 is arranged so as to come out more in the tape conveying direction than the tape ejecting port 163, whereby outside diameter of the contact roller 162 can be made large. Consequently, such configuration can facilitate assembly of the contact roller 162 and can more surely prevent a situation that the sticky after-printed tape 28 from which the separator 53D has been peeled off gets jammed at the tape ejecting port 163.

Further, since the contact roller 162 is arranged so as to closely face the fixed blade 30A, distance between a tape cutting position and an end-of-printing position on an after-printed tape 28 can be shortened. Thereby, margins of the after-printed tape 28 can be shortened.

Further, the guide wall 33 extends at downstream side of the tape conveying direction in comparison with the contact roller 162. Therefore, the surface opposite to the printing surface of the after-printed tape 28 can more surely be guided. Further, since the contact roller 162 is arranged so as to be close to the fixed blade 30A, the surface opposite to the printing surface of the after-printed tape 28 can surely be guided to the tape cutting position, namely, the vicinity of the front edge of the fixed blade 30A.

The contact roller 162 is arranged so that its peripheral surface gets in contact with the adhesive layer 53C of the two-sided adhesive tape 53. The peripheral surface thereof consists of plural convexes formed in parallel with the axial direction wherein each of the convexes is substantially triangular shaped in cross section. Therefore, contact area for the contact roller 162 to get in contact with the adhesive layer 53C of the two-sided adhesive tape 53 can be made small. Thereby, the peripheral surface of the contact roller 162 can smoothly depart from the adhesive layer 53C of the two-sided adhesive tape 53 and consequently, the after-printed tape 28 can be ejected outside smoothly through the tape ejecting port 163.

Further, the contact roller 162 has a peripheral surface that gets in contact with the adhesive layer 53C of the two-sided adhesive tape 53 and the peripheral surface is fowled of a silicon resin film that weakens adhesibility of the two-sided adhesive tape 53. Thereby, the peripheral surface of the contact roller 162 can smoothly depart from the adhesive layer 53C of the two-sided adhesive tape 53 and consequently, the after-printed tape 28 can be ejected outside smoothly through the tape ejecting port 163.

Further, the separator-take-up spool 62 is arranged between the two-sided adhesive-tape spool 56 and the tape spool 54. Therefore, the greatest dimension of the separator 53D allowing the separator-take-up spool 62 to take up the separator 53D in the course of tape printing by the tape printing apparatus 1 can easily be made large and downsizing of the tape cassette 161 is made feasible, accordingly.

Further, along the peripheral surface of the tape conveying roller 63, the peeled-off separator 53D is guided to the pull-out side of the two-sided adhesive tape 53 that is wound around the two-sided adhesive-tape spool 56. From there, the peeled-off separator 53D further travels the outside of the periphery of the wound two-sided adhesive tape 53 with the aid of the separator guide wall 37, the convex part 35A, the guide pin 36 and the convex part 35B and finally reaches the separator-take-up spool 62. Thus, spaces inside the tape cassette 161 can be used effectively and further downsizing of the tape cassette 161 is made feasible, accordingly.

Further, the separator 53D can be peeled off smoothly from the two-sided adhesive tape 53 that has been adhered to the film tape 51 by the separating pin 165. Further, in the tape cassette 161, the presence of the separating pin 165 can surely prevent a situation that the separator 53D peeled off from the two-sided adhesive tape 53 again sticks to the adhesive layer 53C of the two-sided adhesive tape 53 due to trembles etc.

Also, after peeled off from the two-sided adhesive tape 53 by the auxiliary separating pin 166 once, the separator 53D gets adhered to the adhesive layer 53C of the two-sided adhesive tape 53 again and conveyed to the tape conveying roller 63. Thereby, the separator 53D can get adhered to the printing surface of the film tape 51 by pressure with adhesibility of the two-sided adhesive tape 53 to the separator 53D being weakened.

Accordingly, it is made easy to peel off the separator 53D from the two-sided adhesive tap 53 that has been adhered to the film tape 51. Further, it is also made possible for the separating pin 165 to smoothly peel off the separator 53D from the two-sided adhesive tape 53 adhered to the film tape 51. Thereby, it is made possible to convey the sticky after-printed tape 28 from which the separator 53D has been peeled off to the tape ejecting port 163 more smoothly.

[Twelfth Embodiment]

Figure 34:
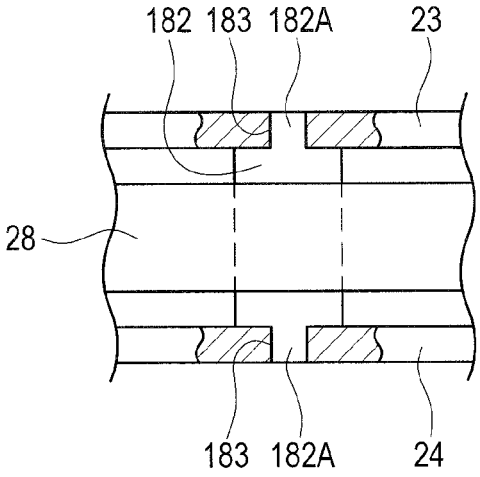
FIG. 34 is an enlarged view seen from a view point indicated with an arrow X10 shown in FIG. 33.
Figure 35:
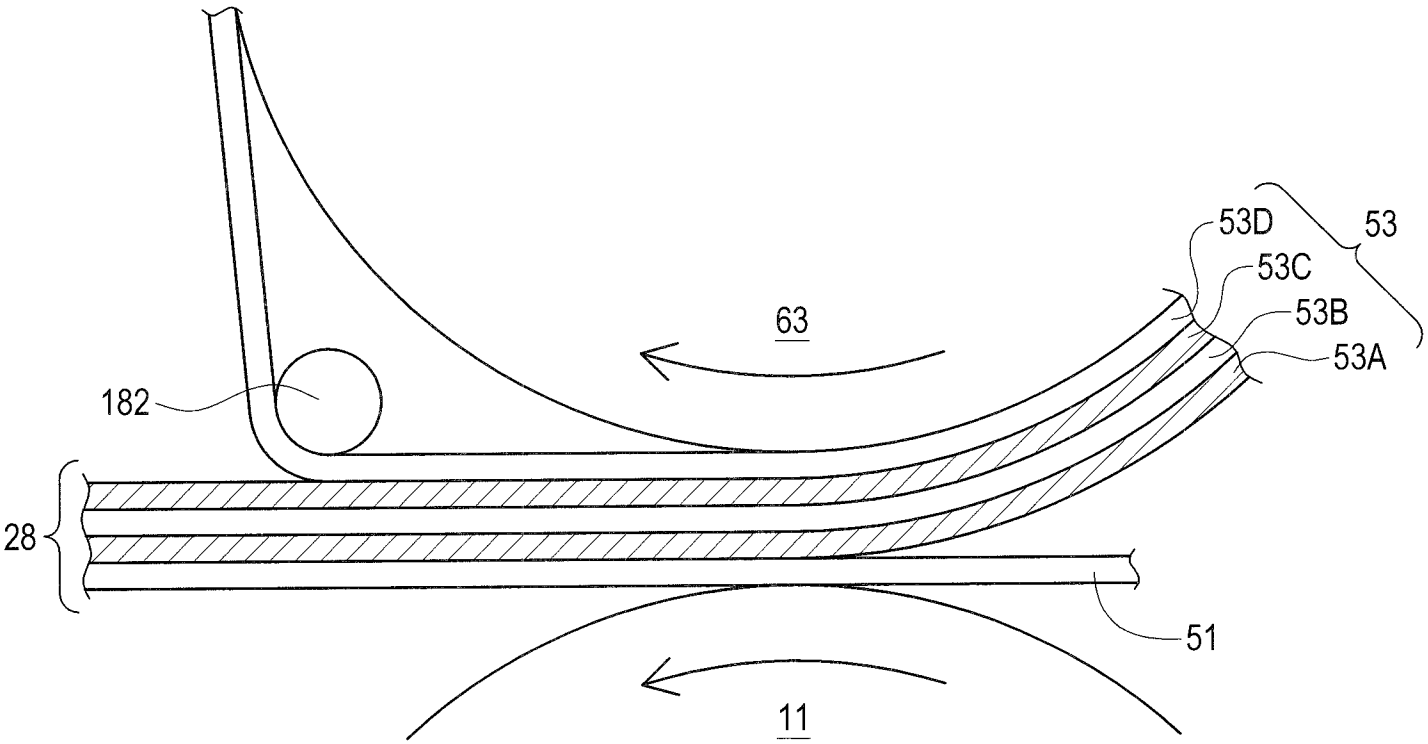
FIG. 35 is a view for exemplarily illustrating a state that a separator is peeled off after a two-sided adhesive tape is adhered to a film tape with pressure.

Next, there will be described on a tape cassette 181 directed to a twelfth embodiment by referring to FIG. 33 through FIG. 35. In the following description, there are numerals and signs identical with those assigned to constituent elements of the tape cassette 21 and the tape printing apparatus 1 directed to the first embodiment illustrated with FIG. 1 through FIG. 8. Those identical numerals and signs are assigned to constituent elements of the present embodiment that are completely or substantially identical with those constituting the tape cassette 21 and the tape printing apparatus 1 etc. directed to the first embodiment. Further, there are numerals and signs identical with those assigned to constituent elements of the tape cassette 161 directed to the eleventh embodiment illustrated with FIG. 26 through FIG. 32 and those identical numerals and signs are assigned to constituent elements of the present embodiment that are completely or substantially identical with those constituting the tape cassette 161 directed to the eleventh embodiment.

The schematic configuration of the tape cassette 181 directed to the twelfth embodiment is almost the same as that of the tape cassette 161 directed to the eleventh embodiment. However, as shown in FIG. 33 through FIG. 35, instead of the above-mentioned separating pin 165, a contact pin 182, as an example of contact member, is arranged between the tape conveying roller 63 and the two-sided adhesive tape 53 that has been adhered to the film tape 51 by the tape conveying roller 63 and the tape sub roller 11. Further, the contact pin 182 is arranged so as to be away from the tape conveying roller 63 by predetermined distance (e.g., about 0.5 mm).

Figure 33:
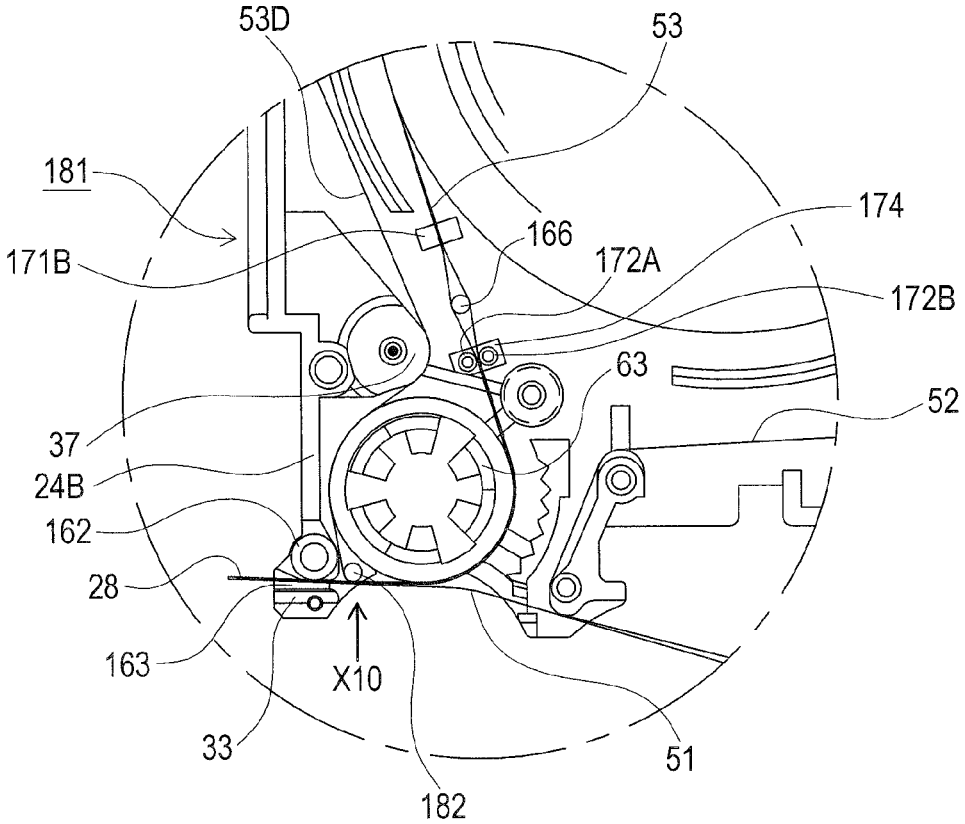
FIG. 33 is a main-part-enlarged view showing an example of a tape cassette directed to a twelfth embodiment.

The separator 53D is peeled off from the two-sided adhesive tape 53 pressed and adhered to the film tape 51, along the peripheral surface of the contact pin 182, and from there, further guided toward the two-sided adhesive spool 56 along the peripheral surface of the tape conveying roller 63, i.e., the pull-out direction (upward direction in FIG. 33). After that, in similar to the tape cassette 161 directed to the eleventh embodiment, the peeled-off separator 53D is further guided to reach the external of the guide rib 35 along a wall surface of the separator guide wall 37 and finally guided to reach the separator-take-up spool 62.

The contact pin 182 is a substantially cylindrical form of which length is longer than tape width of the after-printed tape 28 and of which cross section is a circle. Supporting shafts 182A are arranged upright at the centers of both ends of the contact pin 182. Further, supporting holes 183 for rotatably supporting the supporting shafts 182A of the separating pin 182 are arranged in both the upper case 23 and the lower case 24 of the tape cassette 181. Each supporting shaft 182A of the contact pin 182 is rotatably inserted in each supporting hole 183.

Accordingly, in the tape cassette 181 directed to the twelfth embodiment, the contact pin 182 is rotatably supported at both ends thereof and configured to get in contact with the separator 53D of the two-sided adhesive tape 53 that has been adhered to the film tape 51 across the full width thereof.

Accordingly, in the thus configured tape cassette 181, the two-sided adhesive tape 53 pulled out from the two-sided-adhesive-tape spool 56 passes through the space between the pair of upstream side guiding members 171A and 171B that restrict the two-sided adhesive tape 53 to moving in its width directions and further travels to reach the auxiliary separating pin 166. Thereafter, the separator 53D is peeled off from the two-sided adhesive tape 53 by the auxiliary separating pin 166 of which end portions are rotatably supported. After that, the separator 53D as well as the two-sided adhesive tape 53 from which the separator 53 has been peeled off travel to pass through the space between the stepped portions 174, 174 and the space between the pair of downstream side rollers 172A and 172B. Thereafter, the separator 53D gets adhered to the adhesive layer 53C of the two-sided adhesive tape 53 again and pulled out along the peripheral surface of the tape conveying roller 63. Thereafter, the two-sided adhesive tape 53 travels and passes through the path between the tape conveying roller 63 driven by the tape-driving-roller shaft 14 for rotation and the tape sub roller 11. Thereafter, the adhesive layer 53A on which the separator 53D is not overlaid is pressed against a printing surface of the film tape 51.

After that, the separator 53D is peeled off from the two-sided adhesive tape 53 pressed and adhered to the film tape 51, along the peripheral surface of the contact pin 182. From there, the separator 53D is again guided toward the two-sided-adhesive-tape spool 56 along the peripheral surface of the tape conveying roller 63, i.e., in the pull-out direction (upward direction in FIG. 33). Next, the separator 53D is further guided to reach the external of the guide rib 35 along a wall surface of the separator guide wall 37. From there, the separator 53D further travels the outside of the periphery of the wound two-sided adhesive tape 53 passing through peripheral surfaces of the convex part 35A, the guide pin 36 and the convex part 35B. The separator 53D finally reaches the separator-take-up spool 62 inwardly at a substantially right angle.

Thereafter, the front end of the separator 53D is fixedly adhered to the peripheral surface of the separator-take-up spool 62 by an adhesive tape or the like and taken up into the separator-take-up spool 62 that is driven by the separator-take-up shaft 16 for rotation. It is to be noted that the separator-take-up shaft 16 is driven for rotation in synchronous with rotation of the tape-driving-roller shaft 14 and the ribbon-take-up shaft 15.

After passing through the path between the tape conveying roller 63 driven by the tape-driving-roller shaft 14 for rotation and the tape sub roller 11, the film tape 51 reaches the contact roller 162 in a state that an adhesive layer 53A, a base film 53B and an adhesive layer 53C are overlaid on a printing surface of the film tape 51. Thereafter, the film tape 51 placed in the state that the adhesive layer 53A, the base film 53B and the adhesive layer 53C are overlaid on the printing surface thereof, namely, the sticky after-printed tape 28 from which its separator 53D has been peeled is guided outside of the tape cassette 161 through the tape ejecting port 163 by the contact roller 162 that gets in contact with the adhesive layer 53C and the guide wall 33 that faces the contact roller 162 over the after-printed tape 28 inserted therebetween. After that, through the cutter unit 30, the sticky after-printed tape 28 from which the separator 53D has been peeled off is conveyed outside from the label ejecting port 17 of the tape printing apparatus 1.

After that, the after-printed tape 28 is conveyed by predetermined length and a not-shown cutting motor is driven for operating the movable blade 30B. Consequently, from the label ejecting port 17, there is ejected the predetermined length of the sticky after-printed tape 28 from which the separator 53D has been peeled off.

Thereby, the tape cassette 181 directed to the twelfth embodiment brings working effect as below, in addition to the afore-mentioned working effect of the tape cassette 161 directed to the eleventh embodiment. Specifically, the contact pin 182 is arranged such that the separator 53D is conveyed along peripheral surface of the contact pin 182 while the two-sided adhesive tape 53 is pressed thereat. Since the conveying direction of the separator 53D is abruptly turned in different direction with reference to the conveying direction of the after-printed tape 28 at the contact pin 182, the separator 53D can be peeled off from the two-sided adhesive tape 53 smoothly. Further, the contact pin 182 makes it possible to stretch and tighten outwardly the separator 53D that has been peeled off from the two-sided adhesive tape 53. Further, the peeled-off separator 53D can smoothly be guided to the peripheral surface of the tape conveying roller 63 without getting relaxed.

Also, peeled off from the two-sided adhesive tape 53 by the auxiliary separating pin 166 once, the separator 53D gets adhered to the adhesive layer 53C of the two-sided adhesive tape 53 again and conveyed to the tape conveying roller 63. Thereby, the separator 53D can get adhered to the printing surface of the film tape 51 by pressure with adhesibility of the two-sided adhesive tape 53 to the separator 53D being weakened.

Accordingly, it is made easy for the contact pin 182 to peel off the separator 53D from the two-sided adhesive tap 53 that has been adhered to the film tape 51.

Further, it is made possible to convey the sticky after-printed tape 28 from which the separator 53D has been peeled off to the tape ejecting port 163 more smoothly.

[Thirteenth Embodiment]

Next, there will be described on a tape printing apparatus 201 and a tape cassette 221 directed to a thirteenth embodiment by referring to FIG. 36 through FIG. 40. In the following description, there are numerals and signs identical with those assigned to constituent elements of the tape printing apparatus 1 and the tape cassette 21 directed to the first embodiment illustrated with FIG. 1 through FIG. 8. Those identical numerals and signs are assigned to constituent elements of the present embodiment that are completely or substantially identical with those constituting the tape printing apparatus 1 and the tape cassette 21 etc. directed to the first embodiment.

The schematic configuration of the tape printing apparatus 201 directed to the thirteenth embodiment is almost the same as that of the tape printing apparatus 1 directed to the first embodiment. The tape printing apparatus 201, however, differs in terms of that there is arranged a cassette housing portion 202 for housing a tape cassette 221 (refer to FIG. 37), instead of the cassette housing portion 8.

Figure 36:
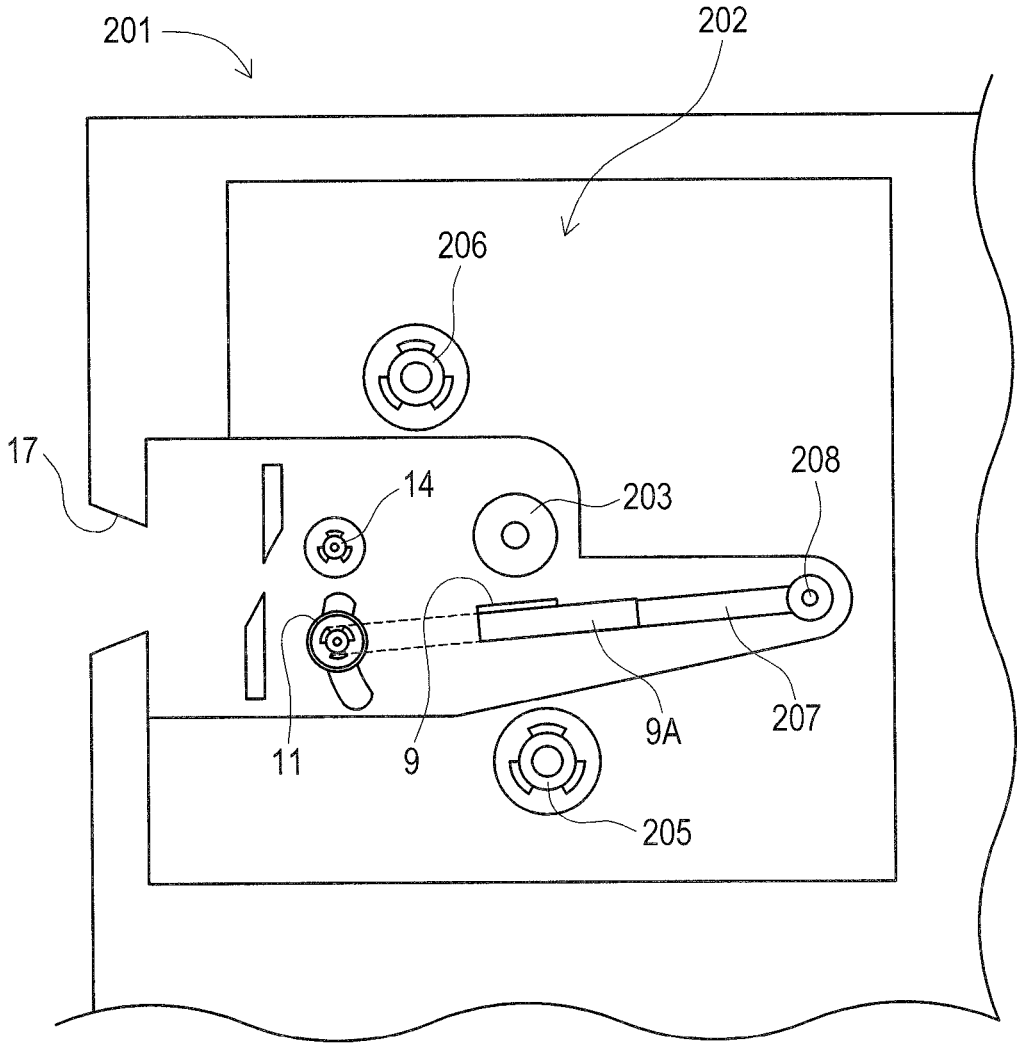
FIG. 36 is a main-part-enlarged plain view showing a cassette housing portion of a tape printing apparatus directed to a thirteenth embodiment.

There will be described on the cassette housing portion 202 by referring to FIG. 36. As shown in FIG. 36, the cassette housing portion 202 includes: a platen roller 203 that is rotatably arranged upright; a metallic tape-driving-roller shaft 14 that is arranged at downstream of the tape conveying direction in comparison with the platen roller 203; a thermal head 9 that faces the platen roller 203; a tape sub roller 11 that faces the tape-driving roller shaft 14; a ribbon-take-up shaft 205 that takes up therearound an ink ribbon 222 (refer to FIG. 37) housed in the tape cassette 221; a separator-take-up shaft 206 that takes up therearound a separator 223C (refer to FIG. 40) that is peeled off from a receptor tape 223 (refer to FIG. 37) as will be described later, and etc.

Further, in the cassette housing portion 202, a head holder 207 is pivotally supported by a supporting shaft 208. A radiator plate 9A is arranged upright at an upper end surface of the head holder 207. A thermal head 9 is attached to a side edge portion of the radiator plate 9A facing the platen roller 203 so as to be substantially perpendicular to the tape conveying direction. Further, the tape sub roller 11 is arranged at the front end portion of the head holder 207 so as to be rotatably supported therearound. When the tape cassette 221 is placed in, the head holder 207 is pivotally moved toward the platen roller 203 so that the thermal head 9 and the tape sub roller 11 are pressed against the platen roller 203 and the tape conveying roller 63, respectively (refer to FIG. 37).

Further, the ribbon-take-up shaft 205 is driven for rotation by a proper driving mechanism originated from a not-shown tape conveying motor that consists of a stepping motor or the like. As will be described later, the ribbon-take-up shaft 205 is fitted into the ribbon-take-up spool 225 arranged rotatably inside the tape cassette 221 (refer to FIG. 37) and driven for rotation. Further, the tape-driving-roller shaft 14 is driven for ration by a proper transmission mechanism originated from the tape conveying motor. Specifically, the tape-driving-roller shaft 14 is fitted into an electrically-conductive resin tape conveying roller 63 (refer to FIG. 37) that is rotatbly arranged inside the tape cassette 221 and driven for rotation. Still further, the separator-take-up shaft 206 is driven for rotation by proper transmission mechanism originated from the tape conveying motor. Specifically, the separator-take-up shaft 206 is fitted into a separator-take-up spool 226 (refer to FIG. 37) that is rotatably arranged inside the tape cassette 221 and driven for rotation.

Meanwhile, the separator-take-up shaft 206 may be driven for rotation by proper driving mechanism originated from a not-shown separator-take-up motor that consists of a stepping motor or the like that is furnished separately from the tape conveying motor. Thereby, the separator 223C can be taken up reliably even if stretch rate of the ink ribbon 222 and that of the separator 223C differ significantly.

Further, nearby of the tape ejecting port 227 (refer to FIG. 37) of the tape cassette 221, a scissor-type cutter unit 30 is arranged so as to cut off an after-printed tape 228 by predetermined length in a state that a separator 223C has been peeled off along the peripheral surface of the separating roller 65. Thereby, a sticky label from which a separator 223C has been peeled off is created. The cutter unit 30 consists of a fixed blade 30A and a movable blade 30B wherein a not-shown cutting motor serves to move the movable blade 30B toward the fixed blade 30A so as to cut off an after-printed tape 228. Further, at the side part of the cutter unit 30, i.e., the downstream of the tape conveying direction (left side in FIG. 36), there is formed a label ejecting port 17 from which an after-printed tape is ejected in a state that a separator has been peeled off therefrom, as will be described later.

Figure 37:
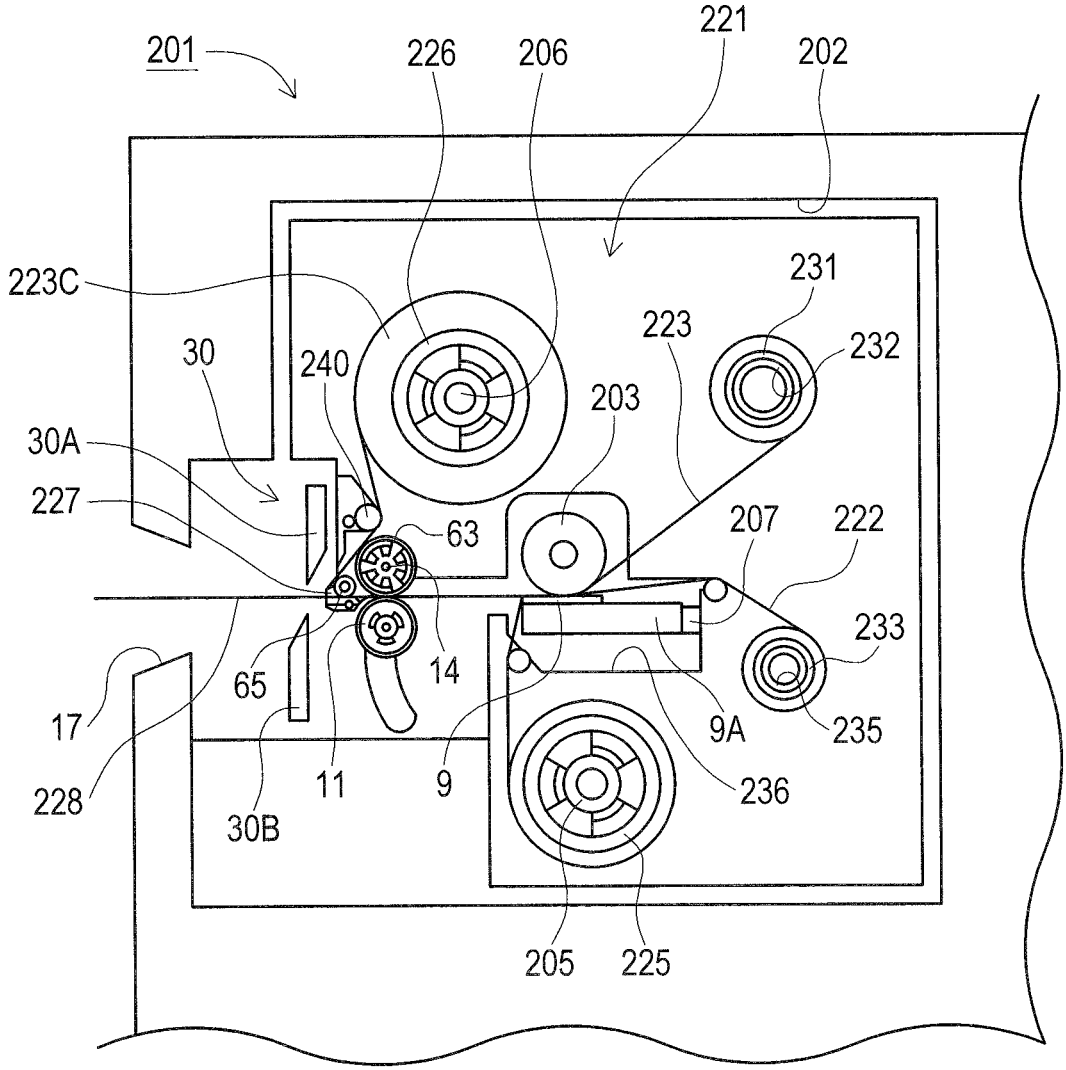
FIG. 37 is a main-part-enlarged plain view that can be seen in case an upper case of a tape cassette directed to a thirteenth embodiment is removed while the tape cassette is placed in a cassette housing portion.

Next, there will be described on the schematic configuration of the tape cassette 221 by referring to FIG. 37 through FIG. 40. As shown in FIG. 37, in the tape cassette 221, a tape spool 231 is rotatably fitted in a cassette boss 232 arranged upright on the bottom of the tape cassette 221. A receptor tape 223 is wound around the tape spool 231 in a state that the separator 223C is put innermost. The separator 223C is composed of release paper, film etc.

Figure 40:
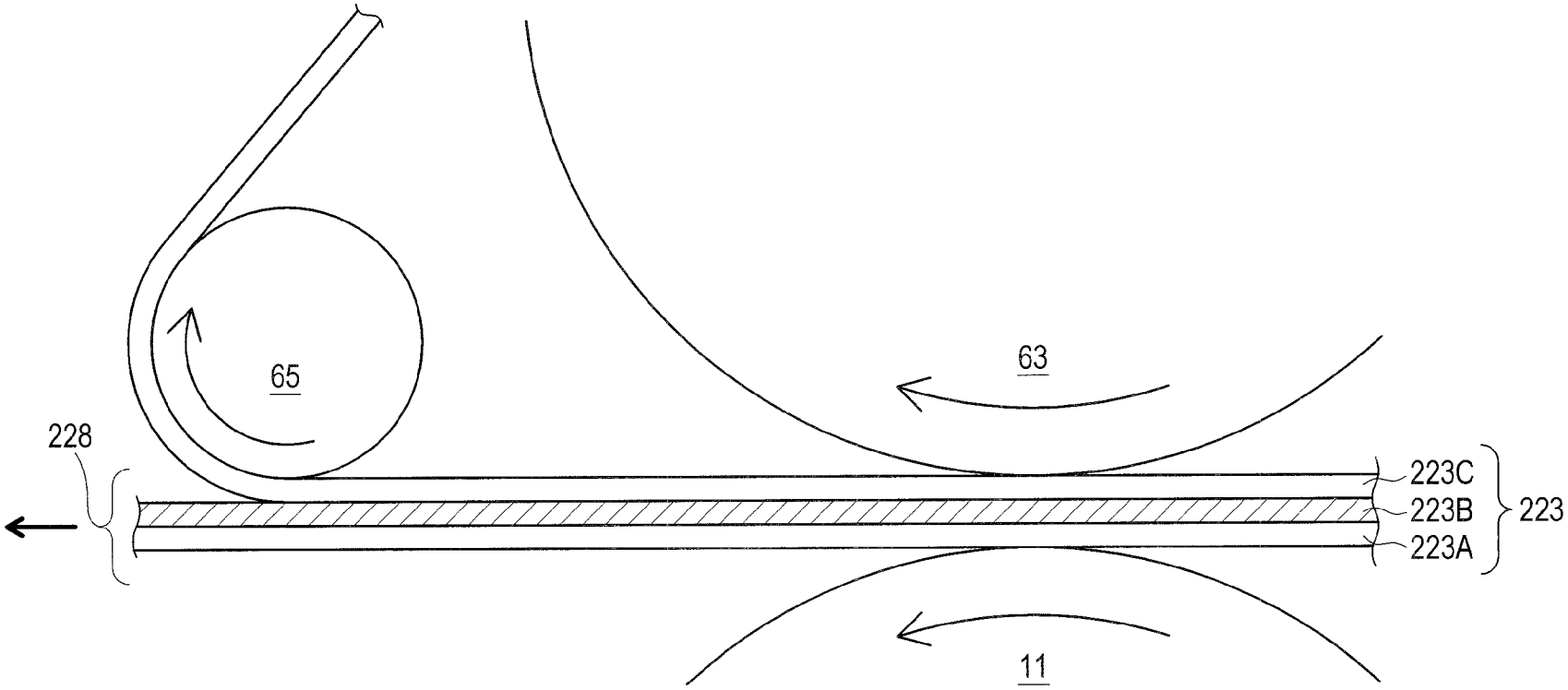
FIG. 40 is a view for exemplarily illustrating a state that a separator is peeled off at the tape ejecting port shown in FIG. 37.

As shown in FIG. 40, the receptor tape 223 wound around the tape spool 231 in the state that the separator 223C is put innermost has a three-layered configuration. The receptor tape 223 consists of three layers, namely in order from the lower to top in FIG. 40: a transparent or colored film tape 223A subject to printing on one surface (lower side surface in FIG. 40) with the aid of the ink ribbon 222 and the thermal head 9; an adhesive layer 223B subject to be pasted on a commercial product etc.; and a separator 223C for covering the to-be-pasted side of the adhesive layer 223B.

Further, as shown in FIG. 37, in the tape cassette 221, the ribbon spool 233 with the ink ribbon 222 wound therearound is rotatably fitted with the reel boss 235 that is arranged upright on the bottom of the tape cassette 221. Further, there are also arranged a ribbon-take-up spool 225 for taking up a used ink ribbon 222 and a separator-take-up spool 226 for taking up a separator 223C peeled off from a receptor tape 223 in a state that their respective axial directional ends are rotatably supported.

Further, at the upstream for the tape ejecting port 227, there is arranged an electrically-conductive resin tape conveying roller 63 in a state that its axial directional ends are rotatably supported. Still further, at the downstream for the tape conveying direction of the tape conveying roller 63, i.e., at the side of the tape ejecting port 227, there is arranged a separating roller 65 in a state that its axial directional ends are rotatably supported.

Figure 38:
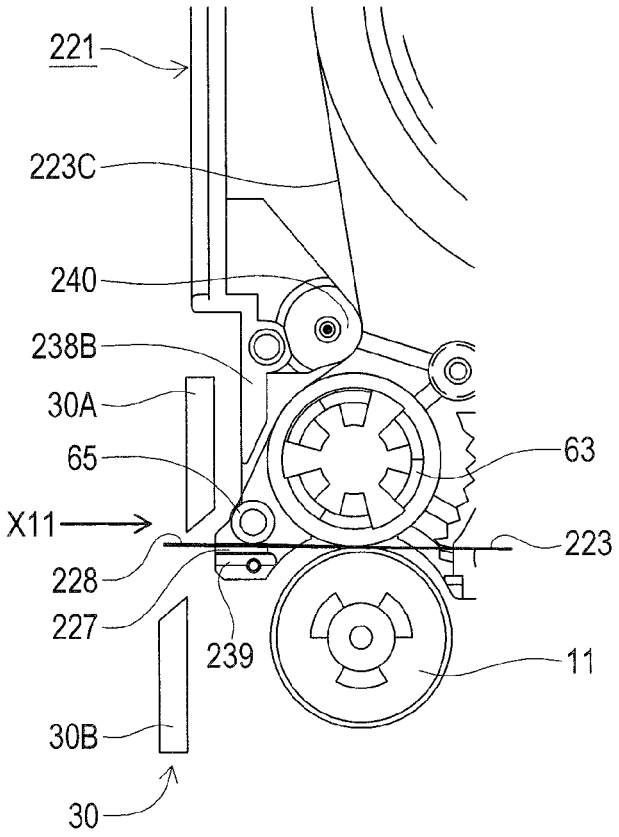
FIG. 38 is a main-part-enlarged view of surroundings of a tape ejecting port shown in FIG. 37.
Figure 39:
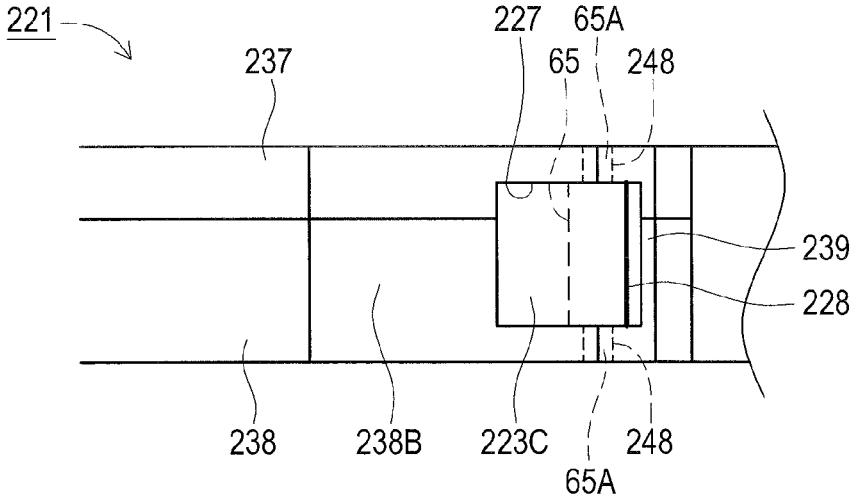
FIG. 39 is a view of the tape ejecting port seen from a view point indicated with an arrow X11 shown in FIG. 38.

Further, as shown in FIG. 38 and FIG. 39, the tape ejecting port 227 consisting of the upper case 237 and the lower case 238 is opened so as to have two widths: one width that is wider than outside diameter of the separating roller 65 and widened in tape-thickness direction of an after-printed tape 228 that is ejected by the tape conveying roller 63 and the tape sub roller 11; and another width that is almost the same as tape width of the after-printed tape 228 and widened in tape-width direction of the after-printed tape 228.

Further, the side wall 238B is arranged orthogonally with reference to the tape conveying direction at the tape ejecting port 227 and two inner side wall portions are formed in the side wall 238B. The separating roller 65 is arranged so as to be separated away by predetermined distance from an end portion of one of the two inner side wall portions, the one located at the side of the after-printed tape 228, as well as separated away by another predetermined distance from a guide wall 239. The guide wall 239 serves to guide the after-printed tape 228 to downstream side of the tape conveying direction in contact with an outer surface of a film tape 223A of the after-printed tape 228.

Further, the separating roller 65 is circular shaped in cross section and substantially cylindrical while length thereof is almost the same as tape width of the after-printed tape 228, namely, tape width of the receptor tape 223. Supporting shafts 65A are arranged upright on centers of both side ends of the separating roller 65 and rotatably fitted in their respective supporting holes 248 formed on the upper case 237 and the lower case 238. Further, the separating roller 65 is formed so as to have a silicon resin film on its peripheral surface.

With reference to the common tangent of the tape conveying roller 63 and the tape sub roller 11, the separating roller 65 is arranged so that its peripheral surface almost gets in contact with the common tangent at the side of the tape conveying roller 63. The separating roller 65 serves to guide travel of a separator 223C to the side of the tape conveying roller 63 along its peripheral surface in contact with the separator 223C of the receptor tape 223 that passes a path between the tape conveying roller 63 and the tape sub roller 11 (refer to FIG. 40).

Further, the separating roller 65 comes out in the tape conveying direction in comparison with the side wall 238B that faces the tape conveying roller 63. At the same time, the separating roller 65 is arranged so as to closely face the fixed blade 30A. Further, the guide wall 239 faces the separating roller 65 over an after-printed tape 228 inserted therebetween. At the same time, the guide wall 239 is arranged so as to extend to the downstream side of the tape conveying direction in comparison with the separating roller 65. Thereby, travel of the after-printed tape 228 from which the separator 223C has been peeled off can be guided to a position near the fixed blade 30A.

Further, the side wall 238B faces the separating roller 65 over a separator 223C inserted therebetween. An inner side surface at an edge portion of the side wall 238B is formed inwardly slantwise (diagonally upward in right, in FIG. 38) so as to be substantially parallel to a common tangent of the separating roller 65 and the tape conveying roller 63. Thereby, the configuration can prevent contact of the separator 223C with the edge portion of the side wall 238B, the separator 223C having been peeled off from the receptor tape 223 along the peripheral surface of the separating roller 65 and guided to the tape conveying roller 63. Further, at a side of the tape conveying roller 63 which is the opposite side where the tape conveying roller 63 faces the tape sub roller 11, a separator guide wall 240 is arranged. The separator guide wall 240 is formed so as to get in contact with the separator 223C and its contact surface is substantially circular shaped when seen from top. The separator guide wall 240 projects inwardly from the side wall 238B to the tape conveying roller 63 while a predetermined space is taken around the separator guide wall 240.

As shown in FIG. 37, after pulled out from the ribbon spool 233, an unused ink ribbon 222 wound around the ribbon spool 233 is overlaid on the film tape 223A side of the receptor tape 223. Thereafter, the unused ink ribbon 222 overlaid with the receptor tape 223 goes into the opening 236 and passes through a path between the thermal head 9 and the platen roller 203. After that, the ink ribbon 222 is separated from the receptor tape 223 and guided to reach the ribbon-take-up spool 225 driven by the ribbon-take-up shaft 205 for rotation. The ink ribbon 222 guided there is taken up into the ribbon-take-up spool 225.

On the other hand, as shown in FIG. 37 through FIG. 40, after passing through the path between the tape conveying roller 63 driven by the tape-driving roller shaft 14 for rotation and the tape sub roller 11, the receptor tape 223 overlaid with a printed film tape 223A thereon reaches the separating roller 65. Thereafter, the separator 223C is peeled off from the receptor tape 223 along the peripheral surface of the separating roller 65 and guided to the separator guide wall 240 along the peripheral surface of the tape conveying roller 63. After that, the separator 223C is guided along the separator guide wall 240 to reach the separator-take-up spool 226.

Thereafter, the front end of the separator 223C is fixedly adhered to the peripheral surface of the separator-take-up spool 226 by an adhesive tape or the like and taken up into the separator-take-up spool 226 that is driven by the separator-take-up shaft 206 for rotation. It is to be noted that the separator-take-up shaft 206 is driven for rotation in synchronous with rotation of the tape-driving-roller shaft 14 and the ribbon-take-up shaft 205.

The receptor tape 223 from which the separator 223C has been peeled off, i.e., a sticky after-printed tape 228, is guided along the guide wall 239 that faces the contact roller 65 over the after-printed tape 228 inserted therebetween and conveyed to the outside of the tape cassette 221 through the tape ejecting port 227. After that, through the cutter unit 30, the sticky after-printed tape 228 from which the separator 223C has been peeled off is conveyed outside from the label ejecting port 227 of the tape printing apparatus 201.

The after-printed tape 228 is conveyed by predetermined length and a not-shown cutting motor is driven for operating the movable blade 30B. Consequently, from the label ejecting port 17, there is ejected the predetermined length of the sticky after-printed tape 228 from which the separator 223C has been peeled off.

Accordingly, regarding the tape printing apparatus 201 and the tape cassette 221 directed to the thirteenth embodiment, after printing is carried out onto the film tape 223A side, overlaid with the ink ribbon 222, of the receptor tape 223 by the thermal head 9, the receptor tape 223 is conveyed in a state that the separator 223C is peeled off at the tape ejecting port 227. Thereby, time and effort to peel off the separator 223C is made eliminable when the after-printed tape 228 cut in predetermined length is to be pasted on a commercial product etc.

Further, the separator 223C that has been peeled off from the receptor tape 223 along the peripheral surface of the separating roller 65 at the tape ejecting port 227 is guided to a space between the tape conveying roller 63 and the separator guide wall 240 and consequently taken up into the separator-take-up spool 226. Since the peeled-off separator 223C can be housed inside the tape cassette 221, a user can be relieved from time and effort to discard the separator 223C peeled off from the receptor tape 223.

Further, the separator 223C is peeled off from the receptor tape 223 along the peripheral surface of the separating roller 65 at the tape ejecting port 227 and subsequently guided to the space between the tape conveying roller 63 and the separator guide wall 240. Thereby, such configuration surely makes it possible to prevent a situation that the separator 223C bows toward the after-printed tape 228 and again sticks to the adhesive layer 223B of the receptor tape 223. Consequently, the after-printed tape 228 can be smoothly ejected outside from the tape ejecting port 227.

Further, the separating roller 65 is made rotatable, which can lower load working on the after-printed tape 228 when conveyed. Consequently, the after-printed tape 228 can be smoothly ejected outside from the tape ejecting port 227. Further, the separating roller 65 is arranged so as to come out more in the tape conveying direction than the tape ejecting port 227, whereby outside diameter of the separating roller 65 can be made large. Consequently, such configuration can facilitate assembly of the separating roller 65 and can more surely prevent a situation that the sticky after-printed tape 228 gets jammed at the tape ejecting port 227.

Further, since the separating roller 65 is arranged so as to closely face the fixed blade 30A, distance between a tape cutting position and an end-of-printing position on the after-printed tape 228 can be shortened. Thereby, margins of the after-printed tape 228 can be shortened.

Further, the guide wall 239 faces the separating roller 65 over an after-printed tape 228 inserted therebetween, and extends at downstream side of the tape conveying direction in comparison with the separating roller 65. Therefore, the printing surface of the after-printed tape 228 can more surely be guided. Further, since the separating roller 65 is arranged so as to be close to the fixed blade 30A, the printing surface of the after-printed tape 228 can surely be guided to the tape cutting position, namely, the vicinity of the front edge of the fixed blade 30A.

[Fourteenth Embodiment]

Next, there will be described on a tape cassette 251 directed to a fourteenth embodiment by referring to FIG. 41 through FIG. 44. In the following description, there are numerals and signs identical with those assigned to constituent elements of the tape printing apparatus 201 and the tape cassette 221 directed to the thirteenth embodiment illustrated with FIG. 36 through FIG. 40. Those identical numerals and signs are assigned to constituent elements of the present embodiment that are completely or substantially identical with those constituting the tape printing apparatus 201 and the tape cassette 221 etc. directed to the thirteenth embodiment.

In comparison with the tape cassette 221 directed to the thirteenth embodiment, the tape cassette 251 directed to the fourteenth embodiment differs in that an ink ribbon 222, a ribbon spool 223 for winding an ink ribbon 222, a reel boss 235 and a ribbon-take-up spool 225 for taking up a used ink ribbon 222 therearound are not installed therein.

Figure 41:
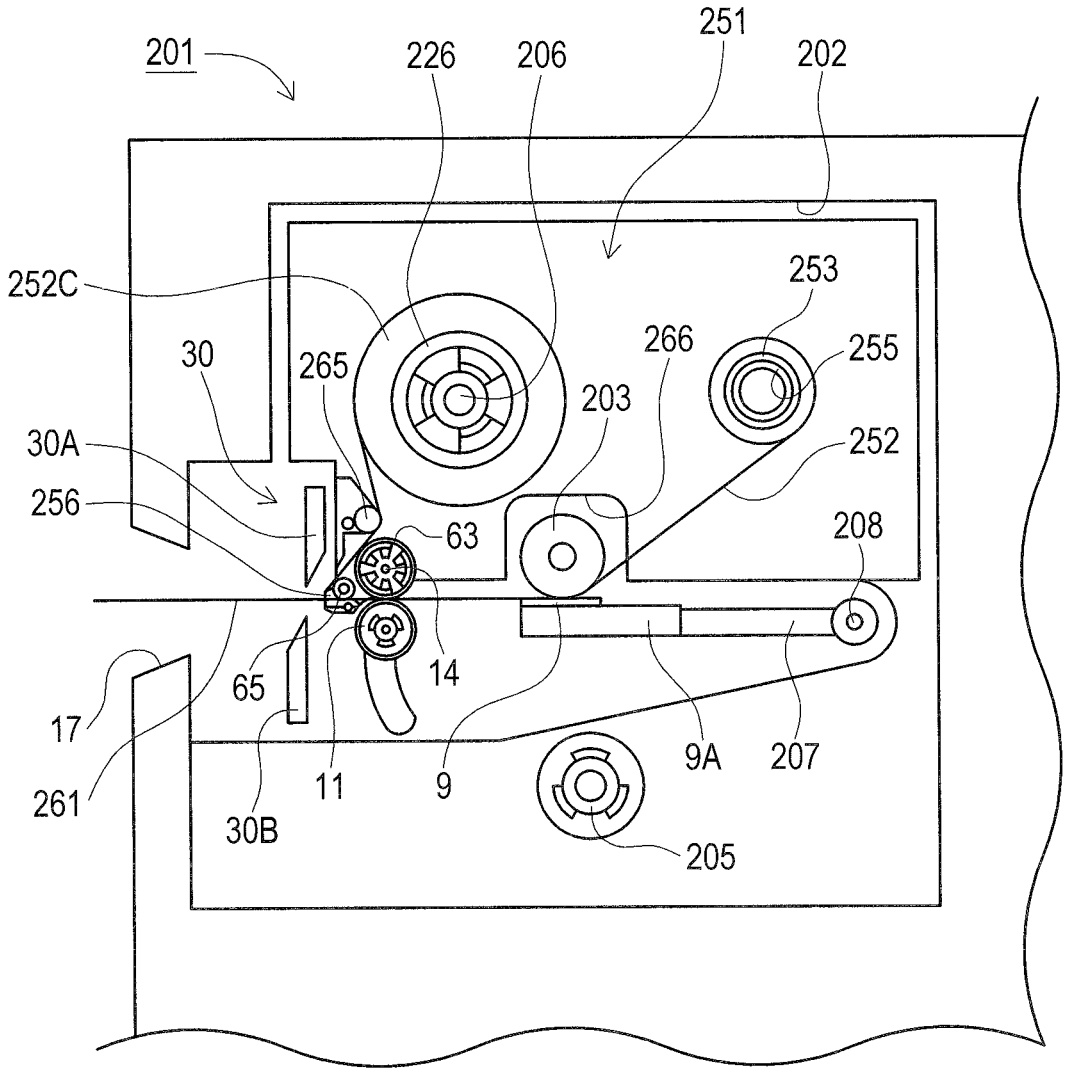
FIG. 41 is a main-part-enlarged plain view that can be seen in case an upper case of a tape cassette directed to a fourteenth embodiment is removed while the tape cassette is placed in a cassette housing portion.

As shown in FIG. 41, in the tape cassette 251, a tape spool 253 is rotatably fitted in a cassette boss 255 arranged upright on the bottom of the tape cassette 251. A thermal tape 252 is wound around the tape spool 253 in a state that the separator 252C is put innermost. The separator 252C is composed of release paper, film etc. Further, there is also arranged a separator-take-up spool 226 for taking up a separator 252C peeled off from the thermal tape 252 in a state that its axial directional ends rotatably supported.

Figure 44:
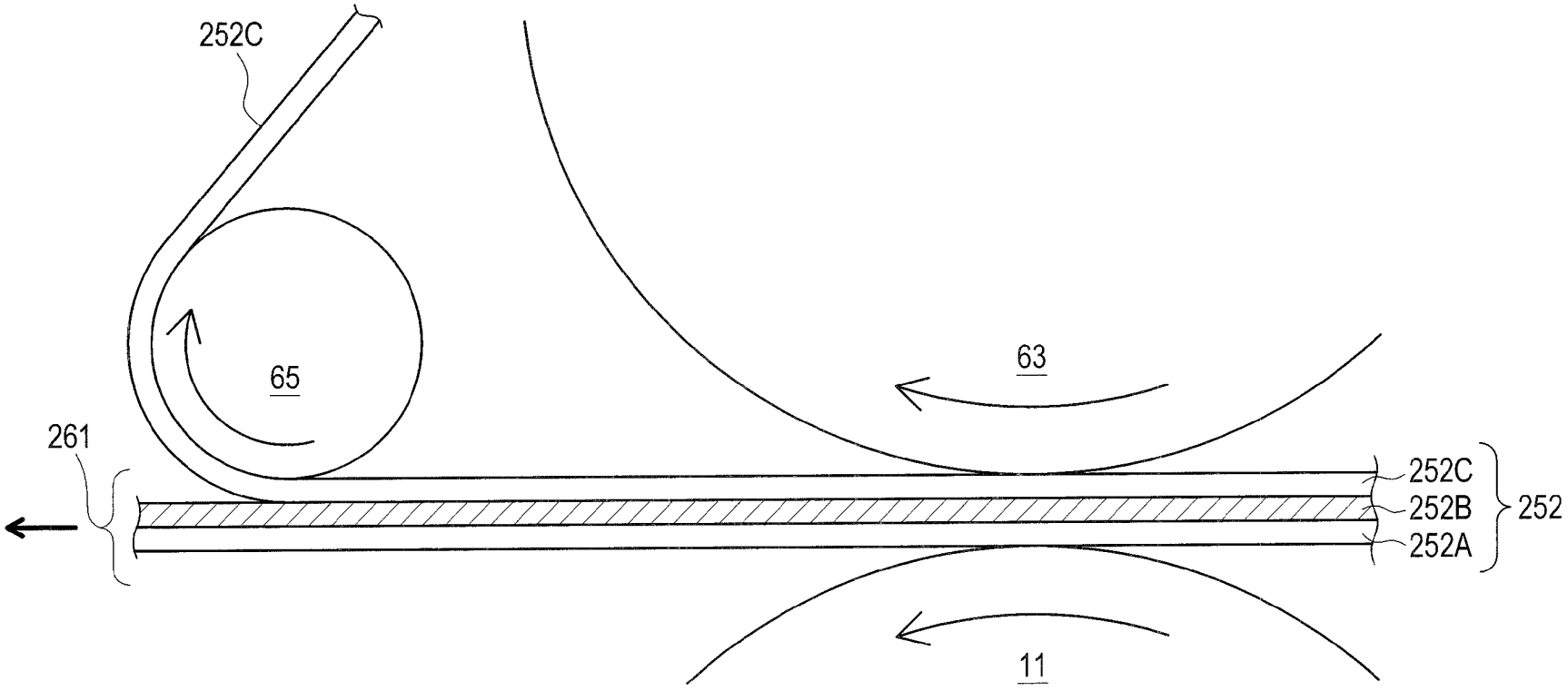
FIG. 44 is a view for exemplarily illustrating a state that a separator is peeled off at the tape ejecting port shown in FIG. 41.
Figure 45:
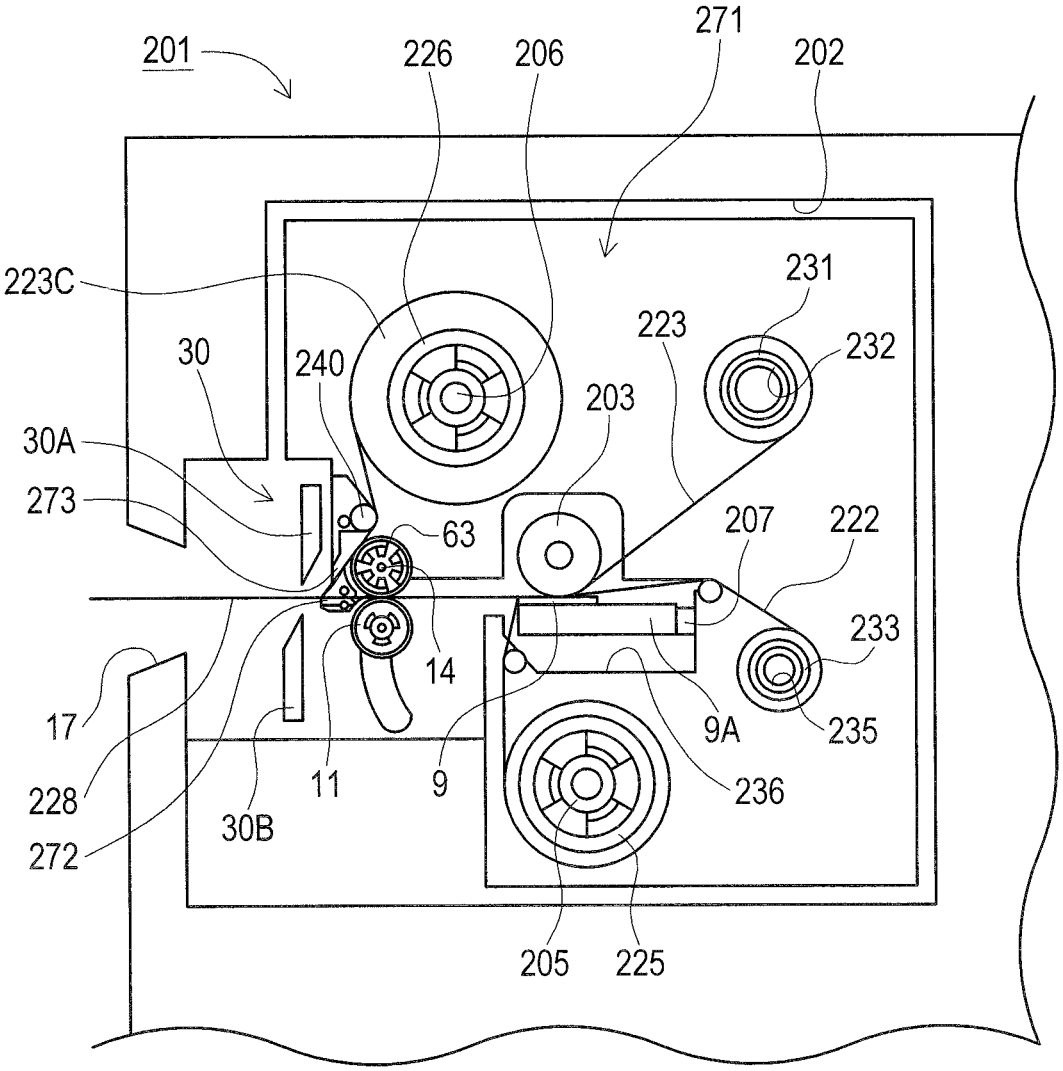
FIG. 45 is a main-part-enlarged plain view that can be seen in case an upper case of a tape cassette directed to a fifteenth embodiment is removed while the tape cassette is placed in a cassette housing portion.
Figure 46:
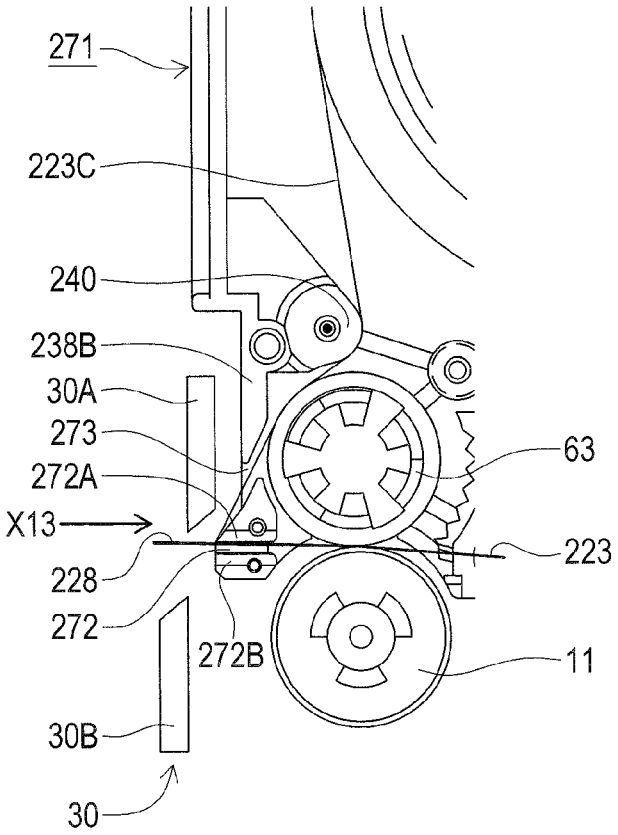
FIG. 46 is a main-part-enlarged view of surroundings of a tape ejecting port shown in FIG. 45.
Figure 47:
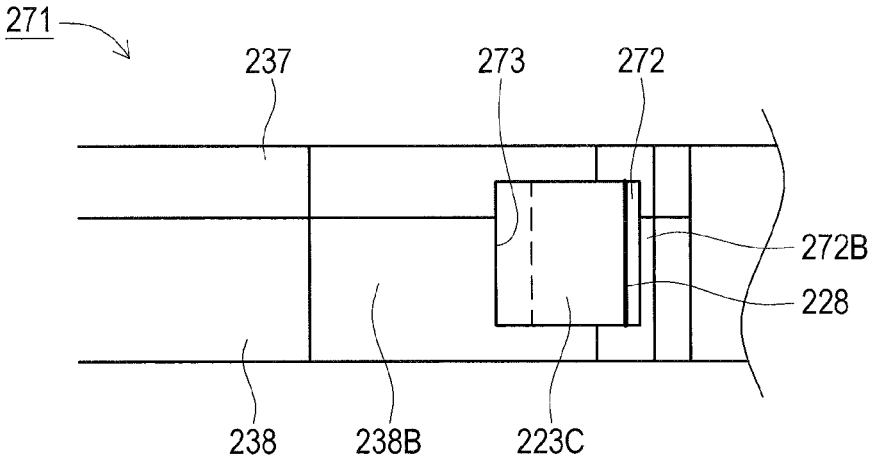
FIG. 47 is a view of the tape ejecting port seen from a view point indicated with an arrow X13 shown in FIG. 46.
Figure 48:
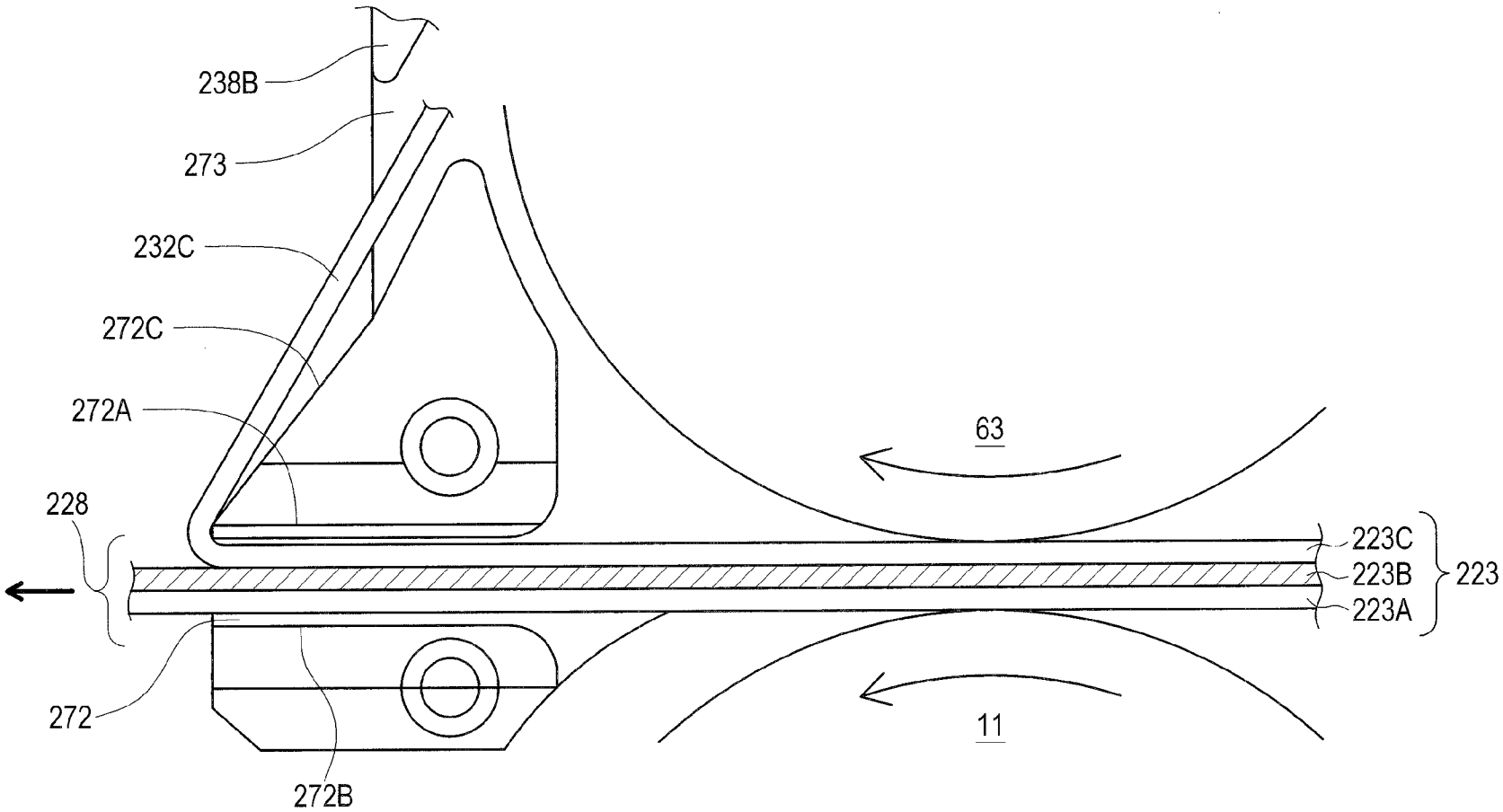
FIG. 48 is a view for exemplarily illustrating a state that a separator is peeled off at the tape ejecting port shown in FIG. 45.
Figure 49:
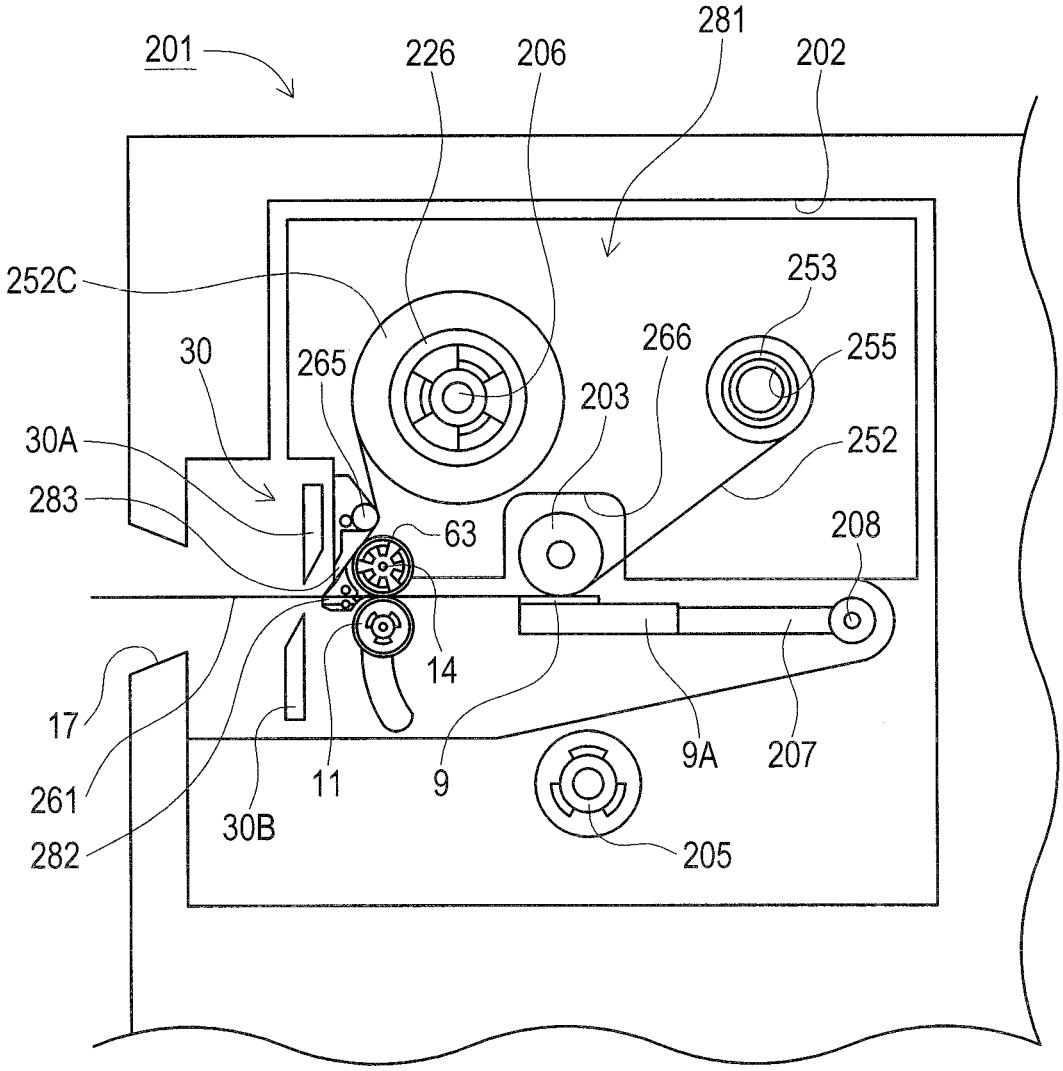
FIG. 49 is a main-part-enlarged plain view that can be seen in case an upper case of a tape cassette directed to a sixteenth embodiment is removed while the tape cassette is placed in a cassette housing portion.
Figure 50:
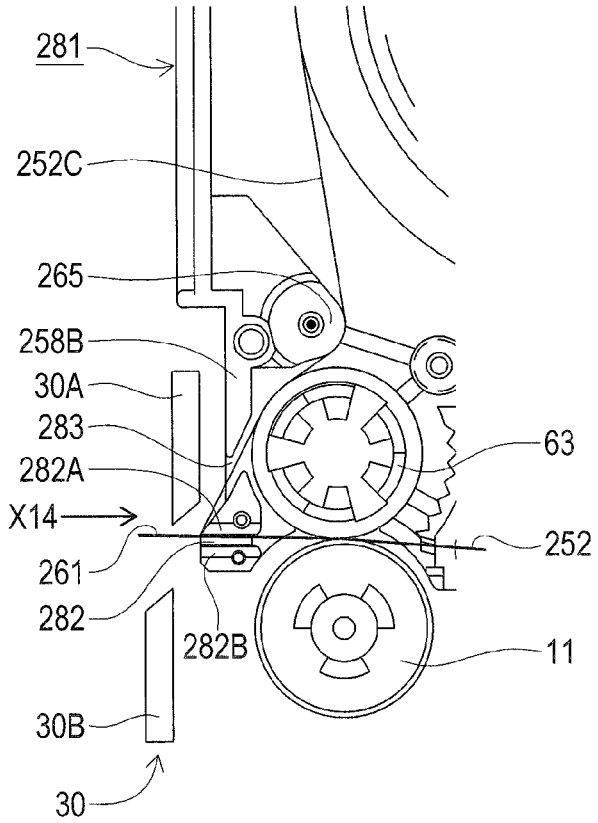
FIG. 50 is a main-part-enlarged view of surroundings of a tape ejecting port shown in FIG. 49.
Figure 51:
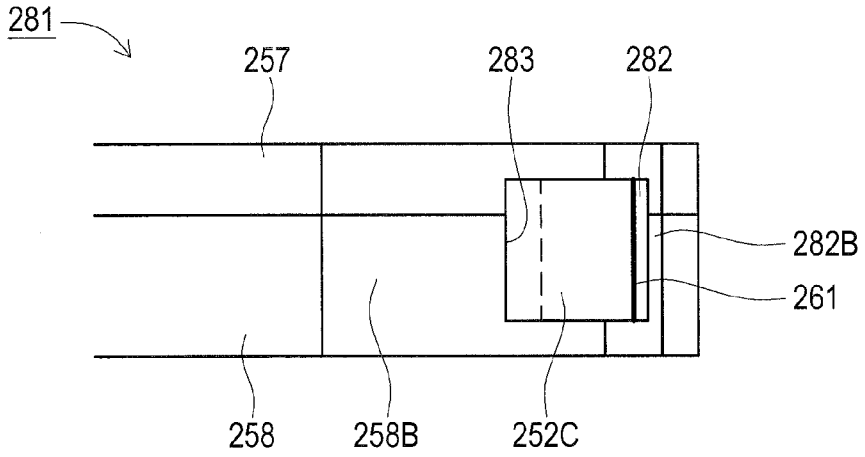
FIG. 51 is a view of the tape ejecting port seen from a view point indicated with an arrow X14 shown in FIG. 50.
Figure 52:
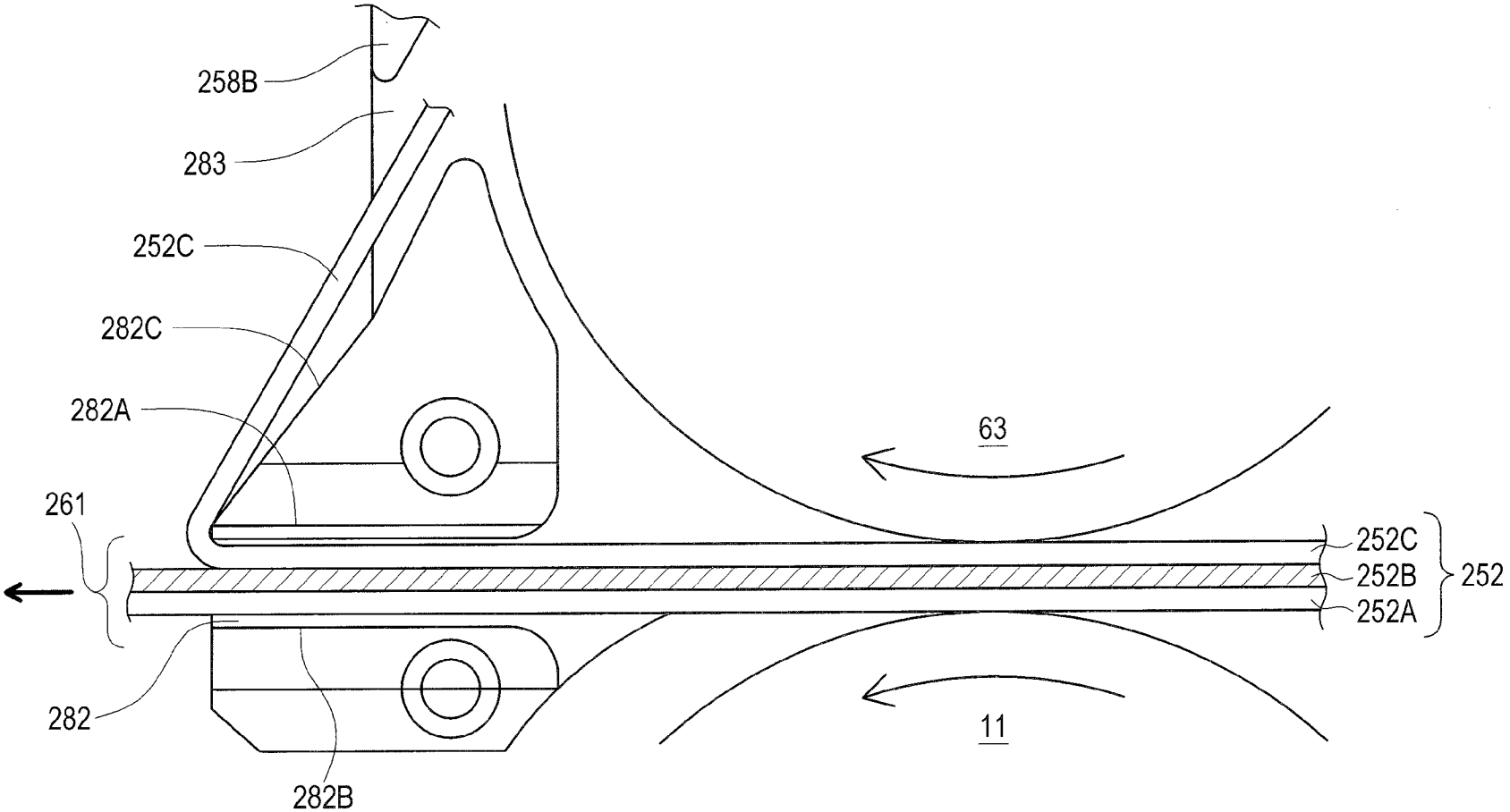
FIG. 52 is a view for exemplarily illustrating a state that a separator is peeled off at the tape ejecting port shown in FIG. 49.

As shown in FIG. 44, the thermal tape 252 wound around the tape spool 253 in the state that the separator 252C is put innermost has a three-layered configuration. The thermal tape 252 consists of three layers, namely in order from the lower to top in FIG. 44: a base tape 252A including a color former layer on its surface (lower surface thereof in FIG. 44); an adhesive layer 252B subject to be pasted on a commercial product; and a separator 252C for covering the to-be-pasted side of the adhesive layer 252B.

Further, as shown in FIG. 41, at the upstream for the tape ejecting port 256, there is arranged an electrically-conductive resin tape conveying roller 63 in a state that its axial directional ends are rotatably supported. Still further, at the downstream for the tape conveying direction of the tape conveying roller 63, i.e., at the side of the tape ejecting port 256, there is arranged a separating roller 65 in a state that its axial directional ends are rotatably supported.

Figure 42:
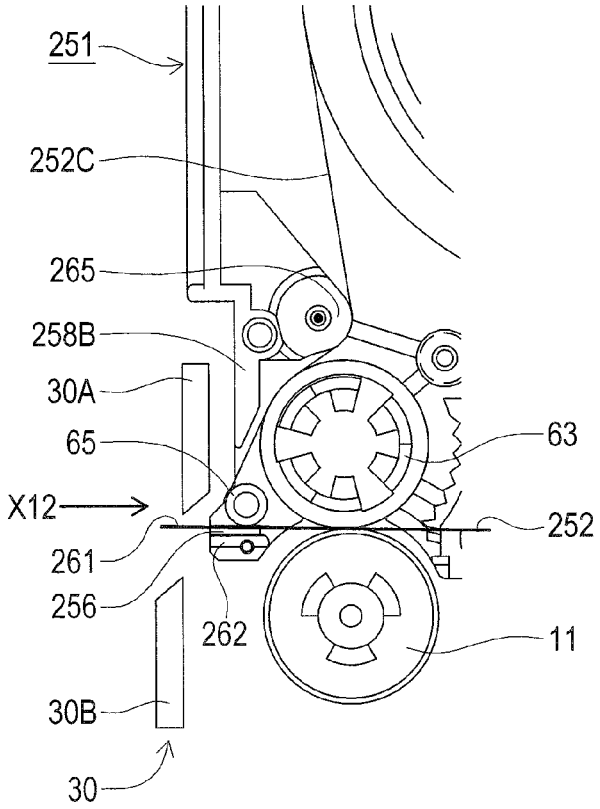
FIG. 42 is a main-part-enlarged view of surroundings of a tape ejecting port shown in FIG. 41.
Figure 43:
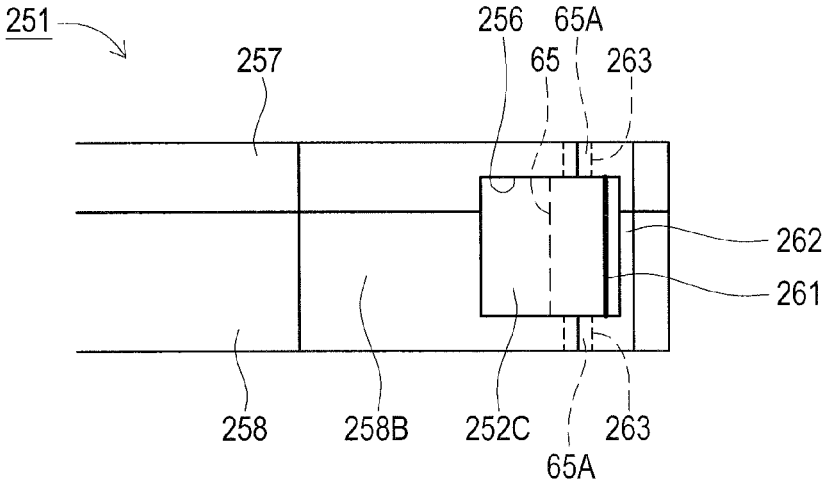
FIG. 43 is a view of the tape ejecting port seen from a view point indicated with an arrow X12 shown in FIG. 42.

Further, as shown in FIG. 42 and FIG. 43, the tape ejecting port 256 consisting of the upper case 257 and the lower case 258 is opened so as to have two widths: one width that is wider than outside diameter of the separating roller 65 and widened in tape-thickness direction of an after-printed tape 261 conveyed by the tape conveying roller 63 and the tape sub roller 11; and another width that is almost the same as tape width of the after-printed tape 261 and widened in tape width direction of the after-printed tape 261.

Further, the side wall 258B is arranged orthogonally with reference to the tape conveying direction at the tape ejecting port 256 and two inner side wall portions are formed in the side wall 258B. The separating roller 65 is arranged so as to be separated away by predetermined distance from an end portion of one of the two inner side wall portions, the one located at the side of the after-printed tape 261, as well as separated away by another predetermined distance from a guide wall 262. The guide wall 262 serves to guide the after-printed tape 261 to downstream side of the tape conveying direction in contact with an outer surface of a base tape 252A of the after-printed tape 261.

Further, the separating roller 65 is circular shaped in cross section and a substantially cylindrical while length thereof is almost the same as tape width of the after-printed tape 261, namely, tape width of the thermal tape 252. Supporting shafts 65A are arranged upright on centers of both side ends of the separating roller 65 and rotatably fitted in their respective supporting holes 263 formed on the upper case 257 and the lower case 258. Further, the separating roller 65 is formed so as to have a silicon resin film on its peripheral surface.

With reference to the common tangent of the tape conveying roller 63 and the tape sub roller 11, the separating roller 65 is arranged so that its peripheral surface almost gets in contact with the common tangent at the side of the tape conveying roller 63. The separating roller 65 serves to guide travel of a separator 252C to the side of the tape conveying roller 63 along its peripheral surface in contact with the separator 252C of the thermal tape 252 that passes a path between the tape conveying roller 63 and the tape sub roller 11 (refer to FIG. 44).

Further, the separating roller 65 comes out in the tape conveying direction in comparison with the side wall 258B that faces the tape conveying roller 63. At the same time, the separating roller 65 is arranged so as to closely face the fixed blade 30A. Further, the guide wall 262 faces the separating roller 65 over an after-printed tape 261 inserted therebetween. At the same time, the guide wall 262 is arranged so as to extend to the downstream side of the tape conveying direction in comparison with the separating roller 65. Thereby, travel of the after-printed tape 261 from which the separator 252C has been peeled off can be guided to a position near the fixed blade 30A.

Further, the side wall 258B faces the separating roll 65 over a separator 252C inserted therebetween. An inner surface at an edge portion of the side wall 258B is formed inwardly slantwise (diagonally upward in right, in FIG. 42) so as to be substantially parallel to a common tangent of the separating roller 65 and the tape conveying roller 63. Thereby, the configuration can prevent contact of the separator 252C with the edge portion of the side wall 258B, the separator 252C having been peeled off from the thermal tape 252 along the peripheral surface of the separating roll 65 and guided to the tape conveying roller 63. Further, at a side of the tape conveying roller 63 which is the opposite side where the tape conveying roller 63 faces the tape sub roller 11, a separator guide wall 265 is arranged. The separator guide wall 265 is formed so as to get in contact with the separator 252C and its contact surface is substantially circular shaped when seen from top. The separator guide wall 265 projects inwardly from the side wall 258B to the tape conveying roller 63 while a predetermined space is taken around the separator guide wall 265.

As shown in FIG. 41, the thermal tape 252 wound around the tape spool 253 is pulled out therefrom and allowed to enter the opening 266 so as to pass through a path between the thermal head 9 and the platen roller 203. As shown in FIG. 42 through FIG. 44, after passing through the path between the tape conveying roller 63 driven by the tape-driving roller shaft 14 for rotation and the tape sub roller 11, the thermal tape 252 overlaid with a printed base tape 252A thereon reaches the separating roller 65. Thereafter, the separator 252C is peeled off from the thermal tape 252 along the peripheral surface of the separating roller 65 and guided to the separator guide wall 265 along the peripheral surface of the tape conveying roller 63. After that, the separator 252CC is guided along the separator guide wall 265 to reach the separator-take-up spool 226.

Thereafter, the front end of the separator 252C is fixedly adhered to the peripheral surface of the separator-take-up spool 226 by an adhesive tape or the like and taken up into the separator-take-up spool 226 that is driven by the separator-take-up shaft 206 for rotation. It is to be noted that the separator-take-up shaft 206 is driven for rotation in synchronous with rotation of the tape-driving-roller shaft 14.

The thermal tape 252 from which the separator 252C has been peeled off, i.e., a sticky after-printed tape 261, is guided along the guide wall 262 that faces the contact roller 65 over the after-printed tape 261 inserted therebetween and conveyed outside of the tape cassette 251 through the tape ejecting port 256. After that, through the cutter unit 30, the sticky after-printed tape 261 from which the separator 252C has been peeled off is conveyed outside from the label ejecting port 17 of the tape printing apparatus 201.

The after-printed tape 261 is conveyed by predetermined length and a not-shown cutting motor is driven for operating the movable blade 30B. Consequently, from the label ejecting port 17, there is ejected the predetermined length of the sticky after-printed tape 261 from which the separator 252C has been peeled off.

Accordingly, regarding the tape printing apparatus 201 and the tape cassette 251 directed to the fourteenth embodiment, after printing is carried out onto the base tape 252A side of the thermal tape 252 by the thermal head 9, the thermal tape 252 is conveyed in a state that the separator 252C is peeled off at the tape ejecting port 256. Thereby, time and effort to peel off the separator 252C is made eliminable when the after-printed tape 261 cut in predetermined length is to be pasted on a commercial product etc.

Further, the separator 252C that has been peeled off from the thermal tape 252 along the peripheral surface of the separating roller 65 at the tape ejecting port 256 is guided to a space between the tape conveying roller 63 and the separator guide wall 265 and consequently taken up into the separator-take-up spool 226. Since the peeled-off separator 252C can be housed inside the tape cassette 251, a user can be relieved from time and effort to discard the separator 252C peeled off from the thermal tape 252.

Further, the separator 252C is peeled off from the thermal tape 252 along the peripheral surface of the separating roller 65 at the tape ejecting port 256 and subsequently guided to the space between the tape conveying roller 63 and the separator guide wall 265. Thereby, such configuration surely makes it possible to prevent a situation that the separator 252C bows toward the after-printed tape 261 and again sticks to the adhesive layer 252B of the thermal tape 252. Consequently, the after-printed tape 261 can be smoothly ejected outside from the tape ejecting port 256.

Further, the separating roller 65 is made rotatable, which can lower load working on the after-printed tape 261 when conveyed. Consequently, the after-printed tape 261 can be smoothly ejected outside from the tape ejecting port 256. Further, the separating roller 65 is arranged so as to come out more in the tape conveying direction than the tape ejecting port 256, whereby outside diameter of the separating roller 65 can be made large. Consequently, such configuration can facilitate assembly of the separating roller 65 and can more surely prevent a situation that the sticky after-printed tape 261 gets jammed at the tape ejecting port 256.

Further, since the separating roller 65 is arranged so as to closely face the fixed blade 30A, distance between a tape cutting position and an end-of-printing position on the after-printed tape 261 can be shortened. Thereby, margins of the after-printed tape 261 can be shortened.

Further, the guide wall 262 faces the separating roller 65 over an after-printed tape 261 inserted therebetween, and extends at downstream side of the tape conveying direction in comparison with the separating roller 65. Therefore, the printing surface of the after-printed tape 261 can more surely be guided. Further, since the separating roller 65 is arranged so as to be close to the fixed blade 30A, the printing surface of the after-printed tape 261 can surely be guided to the tape cutting position, namely, the vicinity of the front edge of the fixed blade 30A.

[Fifteenth Embodiment]

Next, there will be described on a tape cassette 271 directed to a fifteenth embodiment by referring to FIG. 45 through FIG. 48. In the following description, there are numerals and signs identical with those assigned to constituent elements of the tape printing apparatus 201 and the tape cassette 221 directed to the thirteenth embodiment illustrated with FIG. 36 through FIG. 40. Those identical numerals and signs are assigned to constituent elements of the present embodiment that are completely or substantially identical with those constituting the tape printing apparatus 201 and the tape cassette 221 etc. directed to the thirteenth embodiment.

The schematic configuration of the tape cassette 271 directed to the fifteenth embodiment is almost the same as that of the tape cassette 221 directed to the thirteenth embodiment. However, as shown in FIG. 45 through FIG. 48, the tape ejecting port 272 for ejecting the after-printed tape 228 therefrom is formed so as to have a slit-like shape when seen from front, with predetermined width (e.g., about 3 mm of width) in the tape conveying direction. Near the tape ejecting port 272, the side wall 238B is configured to stretch to the guide wall 272A that gets in contact with the separator 223C of the receptor tape 223. At the part where the side wall 238B faces the tape conveying roller 63, a separator entrance 273 is formed so as to run through. The separator entrance 273 allows entry of the separator 223C that has been peeled off from the receptor tape 223 at the exit side edge portion of the guide wall 272A.

Further, the tape ejecting port 272 is constituted by the guide wall 272A and the guide wall 272B that faces the guide wall 272A over the after-printed tape 228. The guide wall 272A and the guide wall 272B are arranged so as to be away from each other by predetermined distance (e.g., about 1 mm). The guide wall 272B guides the after-printed tape 228 to the downstream of the tape conveying direction while getting in contact with outer surface of the film tape 223A. Further, the exit side edge portion of the guide wall 272A and that of the guide wall 272B are configured to come out to the downstream of the tape conveying direction in comparison with the side wall 238B so as to closely face the fixed blade 30A.

Further, the guide wall 272A constituting the tape ejecting port 272 is configured to have an inclined surface 272C that inclines toward the separator entrance 273 and includes an acute-angled front edge when seen from top (e.g., front edge angle thereof is about between 30 degrees to 50 degrees). The inclined surface 272C corresponds to a part of the guide wall 272A at the downstream side of the tape conveying direction, namely, the exit side edge portion of the guide wall 272A. The inclined surface 272C is formed so as to incline to the after-printed tape 228 rather than to the common tangent of the exit side edge portion of the guide wall 272A and the tape conveying roller 63, whereby the inclined surface 272C does not get in contact with the peeled-off separator 223C.

Further, the separator entrance 273 includes an after-printed tape-228-side inner side surface that stretches to a tape-conveying-roller-63-side edge portion of the inclined surface 272C. Still further, the separator entrance 273 includes two inner side wall portions that face each other over the separator 223C placed therebetween. The two inner side wall portions are formed so as to be away from each other by predetermined distance (e.g., about 2 mm) in substantially parallel to the common tangent of the exit side edge portion of the guide wall 272A and the tape conveying roller 63.

As shown in FIG. 45 through FIG. 48, after passing through the path between the tape conveying roller 63 driven by the tape-driving roller shaft 14 for rotation and the tape sub roller 11, the receptor tape 223 overlaid with a printed film tape 223A thereon reaches the exit side edge portion of the tape ejecting port 272. Thereafter, the separator 223C is peeled off from the receptor tape 223 along the exit side edge portion of the guide wall 272A at the tape ejecting port 272, subsequently allowed to enter the separator entrance 273 and, from there, guided to the separator guide wall 240 along the peripheral surface of the tape conveying roller 63. After that, the separator 223C is guided along the separator guide wall 240 to reach the separator-take-up spool 226.

Thereafter, the front end of the separator 223C is fixedly adhered to the peripheral surface of the separator-take-up spool 226 by an adhesive tape or the like and taken up into the separator-take-up spool 226 that is driven by the separator-take-up shaft 206 for rotation. It is to be noted that the separator-take-up shaft 206 is driven for rotation in synchronous with rotation of the tape-driving-roller shaft 14 and the ribbon-take-up shaft 205.

The receptor tape 223 from which the separator 223C has been peeled off, i.e., a sticky after-printed tape 228, is conveyed to the outside of the tape cassette 271 from the tape ejecting port 272. After that, through the cutter unit 30, the sticky after-printed tape 228 from which the separator 223C has been peeled off is conveyed outside from the label ejecting port 17 of the tape printing apparatus 201.

The after-printed tape 228 is conveyed by predetermined length and a not-shown cutting motor is driven for operating the movable blade 30B. Consequently, from the label ejecting port 17, there is ejected the predetermined length of the sticky after-printed tape 228 from which the separator 223C has been peeled off.

Accordingly, regarding the tape printing apparatus 201 and the tape cassette 271 directed to the fifteenth embodiment, after printing is carried out onto the film tape 223A side, overlaid with the ink ribbon 222, of the receptor tape 223 by the thermal head 9, the receptor tape 223 is conveyed in a state that the separator 223C is peeled off at the tape ejecting port 227. Thereby, time and effort to peel off the separator 223C is made eliminable when the after-printed tape 228 cut in predetermined length is to be pasted on a commercial product etc.

The separator 223C that has been peeled off from the receptor tape 223 along the exit side edge portion of the guide wall 272A at the tape ejecting port 227 is allowed to enter the tape cassette 271 through the separator entrance 273 and subsequently guided to a space between the tape conveying roller 63 and the separator guide wall 240, i.e., to the side of the separator-take-up spool 226. Consequently, the separator 223 is taken up into the separator-take-up spool 226. Since the separator 223C that has been peeled off from the receptor tape 223 can be housed inside the tape cassette 271, a user can be relieved from time and effort to discard the separator 223C peeled off from the receptor tape 223.

Further, the separator 223C is peeled off from the receptor tape 223 along the exit side edge portion of the guide wall 272A at the tape ejecting port 272. After that the separator 223C is allowed to enter the separator entrance 273 and subsequently guided to a space between the tape conveying roller 63 and the separator guide wall 240. Thereby, such configuration surely makes it possible to prevent a situation that the separator 223C bows toward the after-printed tape 228 and again sticks to the adhesive layer 223B of the receptor tape 223. Consequently, the after-printed tape 228 can be smoothly ejected outside from the tape ejecting port 272.

Further, the exit side edge portion of the guide wall 272A and that of the guide wall 272B are configured to come out to the downstream of the tape conveying direction in comparison with the side wall 238B so as to closely face the fixed blade 30A. Thereby, distance between a tape cutting position and an end-of-printing position on the after-printed tape 228 can be shortened. Further, margins of the after-printed tape 228 can be shortened.

Since the exit side edge portion of the guide wall 272A and that of the guide wall 272B are arranged so as to closely face the fixed blade 30A, the printing surface of the after-printed tape 228 can surely be guided to the tape cutting position, namely, the vicinity of the front edge of the fixed blade 30A.

[Sixteenth Embodiment]

Next, there will be described on a tape cassette 281 directed to a sixteenth embodiment by referring to FIG. 49 through FIG. 52. In the following description, there are numerals and signs identical with those assigned to constituent elements of the tape printing apparatus 201 and the tape cassette 251 directed to the fourteenth embodiment illustrated with FIG. 41 through FIG. 44. Those identical numerals and signs are assigned to constituent elements of the present embodiment that are completely or substantially identical with those constituting the tape printing apparatus 201 and the tape cassette 251 etc. directed to the fourteenth embodiment.

The schematic configuration of the tape cassette 281 directed to the sixteenth embodiment is almost the same as that of the tape cassette 251 directed to the fourteenth embodiment. However, as shown in FIG. 49 through FIG. 52, the tape ejecting port 282 for ejecting the after-printed tape 261 therefrom is formed so as to have a slit-like shape when seen from front, with predetermined width (e.g., about 3 mm of width) in the tape conveying direction. Further, near the tape ejecting port 282, the side wall 258B is configure to stretch to the guide wall 282A that gets in contact with the separator 252C of the thermal tape 252. At the part where the side wall 258B faces tape conveying roller 63, a separator entrance 283 is formed so as to run through. The separator entrance 283 allows entry of the separator 252C that has been peeled off from the thermal tape 252 at the exit side edge portion of the guide wall 282A.

Further, the tape ejecting port 282 is constituted by the guide wall 282A and the guide wall 282B that faces the guide wall 282A over the after-printed tape 261. The guide wall 282A and the guide wall 282B are arranged so as to be away from each other by predetermined distance (e.g., about 1 mm). The guide wall 282B guides the after-printed tape 261 to the downstream of the tape conveying direction while getting in contact with outer surface of the base tape 252A. Further, the exit side edge portion of the guide wall 282A and that of the guide wall 282B are configured to come out to the downstream of the tape conveying direction in comparison with the side wall 258B so as to closely face the fixed blade 30A.

Further, the guide wall 282A constituting the tape ejecting port 282 is configured to have an inclined surface 282C that inclines toward the separator entrance 283 and includes an acute-angled front edge when seen from top (e.g., front edge angle thereof is about between 30 degrees to 50 degrees). The inclined surface 282C corresponds to a part of the guide wall 282A at the downstream side of the tape conveying direction, namely, the exit side edge portion of the guide wall 282A. The inclined surface 282C is formed so as to incline to the after-printed tape 261 rather than to the common tangent of the exit side edge portion of the guide wall 282A and the tape conveying roller 63, whereby the inclined surface 282C does not get in contact with the peeled-off separator 252C.

Further, the separator entrance 283 includes an after-printed tape-26'-side inner side surface that stretches to a tape-conveying-roller-63-side edge portion of the inclined surface 282C. Still further, the separator entrance 283 includes two inner side wall portions that face each other over the separator 252C placed therebetween. The two inner side wall portions are formed so as to be away from each other by predetermined distance (e.g., about 2 mm) in substantially parallel to the common tangent of the exit side edge portion of the guide wall 282A and the tape conveying roller 63.

As shown in FIG. 49 through FIG. 52, after passing through the path between the tape conveying roller 63 driven by the tape-driving roller shaft 14 for rotation and the tape sub roller 11, the thermal tape 252 overlaid with a printed base tape 252A thereon reaches the exit side edge portion of the tape ejecting port 282. Thereafter, the separator 252C is peeled off from the thermal tape 252 along the exit side edge portion of the guide wall 282A at the tape ejecting port 282, subsequently allowed to enter the separator entrance 283 and, from there, guided to the separator guide wall 265 along the peripheral surface of the tape conveying roller 63. After that, the separator 252C is guided along the separator guide wall 265 to reach the separator-take-up spool 226.

Thereafter, the front end of the separator 252C is fixedly adhered to the peripheral surface of the separator-take-up spool 226 by an adhesive tape or the like and taken up into the separator-take-up spool 226 that is driven by the separator-take-up shaft 206 for rotation. It is to be noted that the separator-take-up shaft 206 is driven for rotation in synchronous with rotation of the tape-driving-roller shaft 14.

The thermal tape 252 from which the separator 252C has been peeled off, i.e., a sticky after-printed tape 261, is conveyed to the outside of the tape cassette 281 from the tape ejecting port 282. After that, through the cutter unit 30, the sticky after-printed tape 261 from which the separator 252C has been peeled off is conveyed outside from the label ejecting port 17 of the tape printing apparatus 201.

The after-printed tape 261 is conveyed by predetermined length and a not-shown cutting motor is driven for operating the movable blade 30B. Consequently, from the label ejecting port 17, there is ejected the predetermined length of the sticky after-printed tape 261 from which the separator 252C has been peeled off.

Accordingly, regarding the tape printing apparatus 201 and the tape cassette 281 directed to the sixteenth embodiment, after printing is carried out onto the base tape 252A side of the thermal tape 252 by the thermal head 9, the thermal tape 252 is conveyed in a state that the separator 252C is peeled off at the tape ejecting port 282. Thereby, time and effort to peel off the separator 252C is made eliminable when the after-printed tape 261 cut in predetermined length is to be pasted on a commercial product etc.

The separator 252C that has been peeled off from the thermal tape 252 along the exit side edge portion of the guide wall 282A at the tape ejecting port 282 is allowed to enter the tape cassette 281 through the separator entrance 283 and subsequently guided to a space between the tape conveying roller 63 and the separator guide wall 265, and thereafter taken up into the separator-take-up spool 226. Since the separator 252C that has been peeled off from the thermal tape 252 can be housed inside the tape cassette 281 and at the same time, a user can be relieved from time and effort to discard the separator 252C peeled off from the thermal tape 252.

Further, the separator 252C is peeled off from the thermal tape 252 along the exit side edge portion of the guide wall 282A at the tape ejecting port 282, allowed to enter the separator entrance 283 and subsequently guided to a space between the tape conveying roller 63 and the separator guide wall 265. Thereby, such configuration surely makes it possible to prevent a situation that the separator 252C bows toward the after-printed tape 261 and again sticks to the adhesive layer 252B of the thermal tape 252. Consequently, the after-printed tape 261 can be smoothly ejected outside from the tape ejecting port 282.

Further, the exit side edge portions of the guide wall 282A and that of the guide wall 282B are configured to come out to the downstream of the tape conveying direction in comparison with the side wall 258B so as to closely face the fixed blade 30A. Thereby, distance between a tape cutting position and an end-of-printing position on the after-printed tape 261 can be shortened. Further, margins of the after-printed tape 261 can be shortened.

Since the exit side edge portion the guide wall 282A and that of the guide wall 282B are arranged so as to closely face the fixed blade 30A, the printing surface of the after-printed tape 261 can surely be guided to the tape cutting position, namely, the vicinity of the front edge of the fixed blade 30A.

It is to be noted that the disclosure is not restricted to aspects directed to the first through sixteenth embodiments and that various changes and modification may be made without departing from the gist of the disclosure.

What is claimed is:

1. A tape cassette placed in a tape printing apparatus in a replaceable manner, the tape printing apparatus comprising a tape conveying device for conveying a tape having long length and a printing device for carrying out printing on the tape, wherein the tape cassette comprises:

a tape ejecting port for ejecting outside the tape with a separator being adhered to one of surfaces thereof;

a tape conveying roller arranged at an upstream side of a tape conveying direction at the tape ejecting port, the tape conveying roller pulling out and conveying the tape while getting in contact with the separator being adhered to one surface of the tape;

a separator guiding portion for guiding the separator peeled off from the tape inwardly at the tape ejecting port to contact a peripheral surface of the tape conveying roller;

a separator-take-up spool arranged so as to fix thereto a front end of the separator that has been guided inwardly along the peripheral surface of the tape conveying roller from the separator guiding portion and to take up the separator;

a two-sided adhesive tape of which one of surfaces is covered with the separator, the two-sided adhesive tape being rotatably arranged, being wound with the one of surfaces covered with the separator being put outside, and being adhered onto a print-carried-out surface of the tape; and a guiding member arranged on a route that guides the separator guided from the separator guiding portion to the side of the wound two-sided adhesive tape, and configured to guide the separator to reach the separator-take-up spool, wherein the tape conveying device of the tape printing apparatus includes a tape sub roller arranged so as to be able to rotate and to press the tape conveying roller, wherein the tape is rotatably wound and arranged so as to face the wound two-sided adhesive tape, wherein the separator-take-up spool is arranged between the wound two-sided adhesive tape and the wound tape, wherein the tape conveying roller pulls and conveys the tape and the two-sided adhesive tape together in a state where the tape and the two-sided adhesive tape are held between the tape conveying roller and the tape sub roller, the tape conveying roller adhering the two-sided adhesive tape onto the print-carried-out surface of the tape by pressure, and wherein the separator guiding portion guides the separator that has been peeled off from the two-sided adhesive tape at the tape ejecting port from the separator guiding portion to a side of the wound two-sided adhesive tape along the peripheral surface of the tape conveying roller, and further guides the separator to reach the separator take-up spool along an outer periphery of the wound two-sided adhesive tape via the guiding member so that the separator is taken up by the separator-take-up spool.

2. The tape cassette according to claim 1, wherein the separator guiding portion forms two inner side walls perpendicular to the tape conveying direction at the tape ejecting port and includes a separating roller rotatably arranged so as to get in contact with the separator adhered to the tape while taking a predetermined space between the two inner side walls and the separating roller, and wherein the separator peeled off from the tape at the tape ejecting port is guided toward the peripheral surface of the tape conveying roller along a peripheral surface of the separating roller.

3. The tape cassette according to claim 2, wherein the tape sub roller is arranged so as to be able to rotate therearound and to press the tape conveying roller over the tape with the separator being adhered to one of surfaces thereof, wherein the separating roller is arranged so as to get in contact with the separator at a position closer to the tape sub roller than a common tangent of the tape conveying roller and the tape sub roller, and wherein the tape is inclined to a separator-not-adhered surface of the tape and ejected from the tape ejecting port.

4. The tape cassette according to claim 2 further comprising an auxiliary separating member arranged between the separating roller and the tape conveying roller so as to be inserted between the separator and the tape.

5. The tape cassette according to claim 2, wherein the separating roller is arranged so as to come out more in the tape conveying direction than the tape ejecting port.

6. The tape cassette according to claim 2, wherein the tape printing apparatus further comprises a cutting device for cutting off the tape, wherein the cutting device includes a fixed blade and a movable blade, and wherein the separating roller is arranged so as to closely face the fixed blade when the tape cassette is placed in the tape printing apparatus.

7. The tape cassette according to claim 2, wherein an inner side wall portion of the tape ejecting port faces the separating roller over the tape arranged therebetween and extends more at a downstream side of the tape conveying direction than the separating roller.

8. The tape cassette according to claim 1, wherein the separator guiding portion includes a separator entrance formed so as to penetrate one of side wall portions that gets in contact with the separator adhered to the tape at the tape ejecting port, the separator entrance allowing entering of the separator peeled off from the tape, and the separator peeled off from the tape at an outer edge portion of the tape ejecting port is allowed to enter from the separator entrance and guided toward the peripheral surface of the tape conveying roller.

9. The tape cassette according to claim 8, wherein the tape sub roller is arranged so as to be able to rotate therearound and to press the tape conveying roller over the tape with the separator being adhered to one of surfaces thereof, wherein the tape ejecting port is formed so that an exit-side edge portion of the tape ejecting port facing the separator gets in contact with the separator at a position closer to the tape sub roller than a common tangent of the tape conveying roller and the tape sub roller, and wherein the tape is inclined to a separator-not-adhered surface of the tape and ejected from the tape ejecting port.

10. The tape cassette according to claim 8 further comprising an auxiliary separating member arranged between an entrance side edge portion of the tape ejecting port and the tape conveying roller so as to be inserted between the separator and the tape.

11. The tape cassette according to claim 1 further comprising a separate auxiliary separating member arranged so as to be inserted between the separator and the two-sided adhesive tape on a route of the two-sided adhesive tape that travels between the two-sided adhesive tape to be wound and the tape conveying roller.

12. A tape cassette placed in a tape printing apparatus in a replaceable manner, the tape printing apparatus comprising a tape conveying device for conveying a tape having long length and a printing device for carrying out printing on the tape, wherein the tape cassette comprises:

a tape ejecting port for ejecting outside the tape with a separator being adhered to one of surfaces thereof;

a tape conveying roller arranged at an upstream side of a tape conveying direction at the tape ejecting port, the tape conveying roller pulling out and conveying the tape while getting in contact with the separator being adhered to one surface of the tape;

a separator guiding portion for guiding the separator peeled off from the tape inwardly at the tape ejecting port to contact a peripheral surface of the tape conveying roller;

a separator-take-up spool arranged so as to fix thereto a front end of the separator that has been guided inwardly along the peripheral surface of the tape conveying roller from the separator guiding portion and to take up the separator; and a two-sided adhesive tape of which one of surfaces is covered with the separator, the two- sided adhesive tape being rotatably arranged, being wound with the one of surfaces covered with the separator being put outside, and being adhered onto a print-carried-out surface of the tape, wherein the tape conveying device of the tape printing apparatus includes a tape sub roller arranged so as to be able to rotate and to press the tape conveying roller, wherein the tape is rotatably wound and arranged so as to face the wound two-sided adhesive tape, wherein the tape conveying roller pulls and conveys the tape and the two-sided adhesive tape together in a state where the tape and the two-sided adhesive tape are held between the tape conveying roller and the tape sub roller, the tape conveying roller adhering the two-sided adhesive tape onto the print-carried-out surface of the tape by pressure, wherein the separator guiding portion guides the separator that has been peeled off from the two-sided adhesive tape at the tape ejecting port inwardly along the peripheral surface of the tape conveying roller, and further guides the separator to a side of the wound two-sided adhesive tape so that the separator is taken up by the separator-take-up spool, and wherein the separator-take-up spool is arranged between the wound tape and the wound two-sided adhesive tape so that the separator to be wound at the separator-take-up spool with greatest dimension thereof occupies a part of at least one of:

a printing tape occupying region occupied by the wound tape with greatest dimension thereof; and a two-sided adhesive tape occupying region occupied by the wound two-sided adhesive tape with greatest dimension thereof.

13. A tape cassette comprising:

a tape ejecting port for ejecting outside a tape with a separator being adhered to one of surfaces thereof;

a tape conveying roller arranged at an upstream side of a tape conveying direction at the tape ejecting port, the tape conveying roller pulling out and conveying the tape while getting in contact with the separator being adhered to one surface of the tape;

a separator guiding portion for guiding the separator peeled off from the tape inwardly at the tape ejecting port to contact a peripheral surface of the tape conveying roller;

a separator-take-up spool arranged so as to fix thereto a front end of the separator that has been guided inwardly along the peripheral surface of the tape conveying roller from the separator guiding portion and to take up the separator;

a two-sided adhesive tape of which one of surfaces is covered with the separator, the two- sided adhesive tape being rotatably arranged, being wound with the one of surfaces covered with the separator being put outside, and being adhered onto a print-carried-out surface of the tape; and a guiding member arranged on a route that guides the separator guided from the separator guiding portion to the side of the wound two-sided adhesive tape, and configured to guide the separator to reach the separator-take-up spool, wherein the tape is rotatably wound and arranged so as to face the wound two-sided adhesive tape, wherein the separator-take-up spool is arranged between the wound two-sided adhesive tape and the wound tape, wherein the tape conveying roller is arranged so as to face the tape in a state where the two-sided adhesive tape is placed between the tape conveying roller and the tape, wherein the separator guiding portion guides the separator that has been peeled off from the two-sided adhesive tape at the tape ejecting port from the separator guiding portion to a side of the wound two-sided adhesive tape along the peripheral surface of the tape conveying roller, and further guides the separator to reach the separator take-up spool along an outer periphery of the wound two-sided adhesive tape via the guiding member so that the separator is taken up by the separator-take-up spool.

14. A tape cassette comprising:

a tape ejecting port for ejecting outside a tape with a separator being adhered to one of surfaces thereof;

a tape conveying roller arranged at an upstream side of a tape conveying direction at the tape ejecting port, the tape conveying roller pulling out and conveying the tape while getting in contact with the separator being adhered to one surface of the tape;

a separator guiding portion for guiding the separator peeled off from the tape inwardly at the tape ejecting port to contact a peripheral surface of the tape conveying roller;

a separator-take-up spool arranged so as to fix thereto a front end of the separator that has been guided inwardly along the peripheral surface of the tape conveying roller from the separator guiding portion and to take up the separator; and a two-sided adhesive tape of which one of surfaces is covered with the separator, the two- sided adhesive tape being rotatably arranged, being wound with the one of surfaces covered with the separator being put outside, and being adhered onto a print-carried-out surface of the tape, wherein the tape is rotatably wound and arranged so as to face the wound two-sided adhesive tape, wherein the tape conveying roller is arranged so as to face the tape in a state where the two-sided adhesive tape is placed between the tape conveying roller and the tape, wherein the separator guiding portion guides the separator that has been peeled off from the two-sided adhesive tape at the tape ejecting port inwardly along the peripheral surface of the tape conveying roller, and further guides the separator to a side of the wound two-sided adhesive tape so that the separator is taken up by the separator-take-up spool, and wherein the separator-take-up spool is arranged between the wound tape and the wound two-sided adhesive tape so that the separator to be wound at the separator-take-up spool with greatest dimension thereof occupies a part of at least one of:

a printing tape occupying region occupied by the wound tape with greatest dimension thereof; and a two-sided adhesive tape occupying region occupied by the wound two-sided adhesive tape with greatest dimension thereof.

* * * * *